US009156042B2

(12) United States Patent
Hanson et al.

(10) Patent No.: US 9,156,042 B2
(45) **Date of Patent: *Oct. 13, 2015**

(54) SYSTEMS AND METHODS FOR DISPENSING TEXTURE MATERIAL USING DUAL FLOW ADJUSTMENT

(75) Inventors: Randal W. Hanson, Bellingham, WA (US); Jason Morris, Bellingham, WA (US); Darrel Vander Griend, Everson, WA (US); John Kordosh, Simi Valley, CA (US)

(73) Assignee: Homax Products, Inc., Bellingham, WA (US)

( * ) Notice: Subject to any disclaimer, the term of this patent is extended or adjusted under 35 U.S.C. 154(b) by 503 days.

This patent is subject to a terminal disclaimer.

(21) Appl. No.: 13/560,733

(22) Filed: Jul. 27, 2012

(65) Prior Publication Data

US 2013/0026252 A1 Jan. 31, 2013

Related U.S. Application Data

(60) Provisional application No. 61/513,382, filed on Jul. 29, 2011, provisional application No. 61/664,678, filed on Jun. 26, 2012.

(51) Int. Cl.
*B05B 1/30* (2006.01)
*B05B 1/32* (2006.01)
(Continued)

(52) U.S. Cl.
CPC ..... *B05B 1/30* (2013.01); *B05B 1/3013* (2013.01); *B05B 1/3026* (2013.01); *B65D 83/206* (2013.01); *B65D 83/752* (2013.01)

(58) Field of Classification Search
CPC ..... B05B 1/30; B05B 1/3013; B05B 1/3026; B05B 1/3033; B05B 1/304; B05B 1/32; B05B 1/326; B65D 83/206; B65D 83/28; B65D 83/44; B65D 83/48
See application file for complete search history.

(56) References Cited

U.S. PATENT DOCUMENTS 208,330 A 9/1878 Palmer
351,968 A 11/1886 Derrick
(Continued)

FOREIGN PATENT DOCUMENTS

CA 770467 10/1967
CA 976125 10/1975
(Continued)

OTHER PUBLICATIONS

Homax Products, Inc., "Easy Touch Spray Texture" brochure, Mar. 1992, 1 page.
(Continued)

*Primary Examiner* — Dareen W Gorman
(74) *Attorney, Agent, or Firm* — Michael R. Schacht

(57) ABSTRACT

An aerosol dispensing system for dispensing stored material in a spray comprises a container, a conduit, a valve system, a first adjustment system, and a second adjustment system. The container defines a chamber containing the stored material and pressurized material. The conduit defines a conduit passageway having a conduit inlet and a conduit outlet. The conduit inlet is arranged within the chamber, and the conduit outlet is arranged outside of the chamber. The valve system is arranged to allow and prevent flow of stored material along the conduit passageway. The first adjustment system is arranged to control flow of stored material along the conduit passageway. The first adjustment system is arranged between the conduit inlet and the conduit outlet. The second adjustment system is arranged to control flow of stored material along the conduit passageway. The second adjustment system is arranged between the first adjustment system and the conduit outlet.

26 Claims, 22 Drawing Sheets

(51) Int. Cl.

| | |
|---|---|
| ***B65D 83/16*** | (2006.01) |
| ***B65D 83/28*** | (2006.01) |
| ***B65D 83/54*** | (2006.01) |
| ***B65D 83/20*** | (2006.01) |
| ***B65D 83/14*** | (2006.01) |

(56) References Cited

U.S. PATENT DOCUMENTS

| | | | | |
|---|---|---|---|---|
| D25,916 | S | | 8/1896 | Woods |
| 568,876 | A | | 10/1896 | Regan |
| 579,418 | A | | 3/1897 | Bookwalter |
| 582,397 | A | | 5/1897 | Shone |
| 604,151 | A | | 5/1898 | Horn |
| 625,594 | A | | 5/1899 | Oldham |
| 658,586 | A | | 9/1900 | Reiling |
| 930,095 | A | | 8/1909 | Seagrave |
| 931,757 | A | | 8/1909 | Harmer |
| 941,671 | A | | 11/1909 | Campbell |
| 1,093,907 | A | | 4/1914 | Birnbaum |
| 1,154,974 | A | | 9/1915 | Custer |
| 1,162,170 | A | | 11/1915 | Johnson |
| 1,294,190 | A | | 2/1919 | Sturcke |
| 1,332,544 | A | | 3/1920 | Davis |
| 1,486,156 | A | | 3/1924 | Needham |
| 1,590,430 | A | | 6/1926 | Erby |
| 1,609,465 | A | | 12/1926 | Day |
| 1,643,969 | A | | 10/1927 | Tittemore et al. |
| 1,650,686 | A | | 11/1927 | Binks |
| 1,656,132 | A | | 1/1928 | Arrasmith et al. |
| 1,674,510 | A | | 6/1928 | Hagman |
| 1,755,329 | A | | 4/1930 | McCormack |
| 1,770,011 | A | | 7/1930 | Poston |
| 1,809,073 | A | | 6/1931 | Schylander |
| 1,863,924 | A | | 6/1932 | Dunn |
| 1,988,017 | A | | 1/1935 | Norwick |
| 2,127,188 | A | | 8/1938 | Schellin et al. |
| 2,149,930 | A | | 3/1939 | Plastaras |
| 2,197,052 | A | | 4/1940 | Lowen |
| 2,198,271 | A | | 4/1940 | McCallum |
| D134,562 | S | | 7/1942 | Murphy |
| 2,305,269 | A | | 12/1942 | Moreland |
| 2,307,014 | A | | 1/1943 | Becker et al. |
| 2,320,964 | A | | 6/1943 | Yates |
| 2,353,318 | A | | 7/1944 | Scheller |
| 2,361,407 | A | | 10/1944 | McNair |
| 2,388,093 | A | | 10/1945 | Smith |
| 2,530,808 | A | | 11/1950 | Cerasi |
| 2,565,954 | A | | 8/1951 | Dey |
| 2,612,293 | A | | 9/1952 | Michel |
| 2,686,652 | A | | 8/1954 | Carlson et al. |
| 2,704,690 | A | | 3/1955 | Eichenauer |
| 2,723,200 | A | | 11/1955 | Pyenson |
| 2,763,406 | A | | 9/1956 | Countryman |
| 2,764,454 | A | | 9/1956 | Edelstein |
| 2,785,926 | A | | 3/1957 | Lataste |
| 2,790,680 | A | | 4/1957 | Rosholt |
| 2,801,880 | A | | 8/1957 | Rienecker |
| 2,831,618 | A | | 4/1958 | Soffer et al. |
| 2,839,225 | A | | 6/1958 | Soffer et al. |
| 2,887,274 | A | | 5/1959 | Swenson |
| 2,908,446 | A | | 10/1959 | Strouse |
| 2,923,481 | A | | 2/1960 | Pinke |
| 2,932,434 | A | | 4/1960 | Abplanalp |
| 2,962,743 | A | | 12/1960 | Henriksson |
| 2,965,270 | A | | 12/1960 | Soffer et al. |
| 2,968,441 | A | | 1/1961 | Holcomb |
| 2,976,897 | A | | 3/1961 | Beckworth |
| 2,997,243 | A | | 8/1961 | Kolb |
| 2,999,646 | A | | 9/1961 | Wagner |
| 3,016,561 | A | | 1/1962 | Hulsh |
| 3,027,096 | A | | 3/1962 | Giordano |
| 3,032,803 | A | | 5/1962 | Walshauser |
| 3,061,203 | A | * | 10/1962 | Kitabayashi ..... 239/337 |
| 3,072,953 | A | | 1/1963 | Bunke |
| 3,083,872 | A | | 4/1963 | Meshberg |
| 3,107,059 | A | | 10/1963 | Frechette |
| 3,116,879 | A | | 1/1964 | Wagner |
| 3,121,906 | A | | 2/1964 | Hulsh |
| 3,135,007 | A | | 6/1964 | Howell |
| 3,157,360 | A | | 11/1964 | Heard |
| 3,167,525 | A | | 1/1965 | Thomas |
| 3,191,809 | A | | 6/1965 | Schultz et al. |
| 3,196,819 | A | | 7/1965 | Lechner et al. |
| 3,198,394 | A | | 8/1965 | Lefer |
| 3,207,444 | A | | 9/1965 | Kelley et al. |
| 3,216,628 | A | | 11/1965 | Fergusson |
| 3,236,459 | A | | 2/1966 | McRitchie |
| 3,246,850 | A | | 4/1966 | Bourke |
| 3,258,208 | A | | 6/1966 | Greenebaum, II |
| 3,271,810 | A | | 9/1966 | Raffe |
| 3,284,007 | A | | 11/1966 | Clapp |
| 3,307,788 | A | | 3/1967 | Ingram |
| 3,314,571 | A | | 4/1967 | Greenebaum, II |
| 3,317,140 | A | | 5/1967 | Smith |
| 3,342,382 | A | | 9/1967 | Huling |
| 3,346,195 | A | | 10/1967 | Groth |
| 3,373,908 | A | | 3/1968 | Crowell |
| 3,377,028 | A | | 4/1968 | Bruggeman |
| 3,390,121 | A | | 6/1968 | Burford |
| 3,405,845 | A | | 10/1968 | Cook et al. |
| 3,414,171 | A | | 12/1968 | Grisham et al. |
| 3,415,425 | A | | 12/1968 | Knight et al. |
| 3,425,600 | A | | 2/1969 | Abplanalp |
| 3,428,224 | A | | 2/1969 | Eberhardt et al. |
| 3,433,391 | A | | 3/1969 | Krizka et al. |
| 3,445,068 | A | | 5/1969 | Wagner |
| 3,450,314 | A | | 6/1969 | Gross |
| 3,467,283 | A | | 9/1969 | Kinnavy |
| 3,472,457 | A | | 10/1969 | McAvoy |
| 3,482,738 | A | | 12/1969 | Bartels |
| 3,491,951 | A | | 1/1970 | Knibb |
| 3,498,541 | A | | 3/1970 | Taylor, Jr. et al. |
| 3,513,886 | A | | 5/1970 | Easter et al. |
| 3,514,042 | A | | 5/1970 | Freed |
| 3,544,258 | A | | 12/1970 | Presant et al. |
| 3,548,564 | A | | 12/1970 | Bruce et al. |
| 3,550,861 | A | | 12/1970 | Teson |
| 3,575,319 | A | | 4/1971 | Safianoff |
| 3,592,359 | A | | 7/1971 | Marraffino |
| 3,596,835 | A | | 8/1971 | Smith et al. |
| 3,608,822 | A | | 9/1971 | Berthoud |
| 3,613,954 | A | | 10/1971 | Bayne |
| 3,647,143 | A | | 3/1972 | Gauthier et al. |
| 3,648,932 | A | | 3/1972 | Ewald et al. |
| 3,653,558 | A | | 4/1972 | Shay |
| 3,680,789 | A | | 8/1972 | Wagner |
| 3,698,645 | A | | 10/1972 | Coffey |
| 3,700,136 | A | | 10/1972 | Ruekberg |
| 3,703,994 | A | | 11/1972 | Nigro |
| 3,704,811 | A | | 12/1972 | Harden, Jr. |
| 3,704,831 | A | | 12/1972 | Clark |
| 3,705,669 | A | | 12/1972 | Cox et al. |
| 3,711,030 | A | | 1/1973 | Jones |
| 3,756,732 | A | | 9/1973 | Stoffler |
| 3,764,067 | A | | 10/1973 | Coffey et al. |
| 3,770,166 | A | | 11/1973 | Marand |
| 3,773,706 | A | | 11/1973 | Dunn, Jr. |
| 3,776,470 | A | | 12/1973 | Tsuchiya |
| 3,776,702 | A | | 12/1973 | Chant |
| 3,777,981 | A | | 12/1973 | Probst et al. |
| 3,788,521 | A | | 1/1974 | Laauwe |
| 3,788,526 | A | | 1/1974 | Thornton et al. |
| 3,795,366 | A | | 3/1974 | McGhie et al. |
| 3,797,946 | A | | 3/1974 | Witzmann et al. |
| 3,799,398 | A | | 3/1974 | Morane et al. |
| 3,806,005 | A | | 4/1974 | Prussin et al. |
| 3,811,369 | A | | 5/1974 | Ruegg |
| 3,813,011 | A | | 5/1974 | Harrison et al. |
| 3,814,326 | A | | 6/1974 | Bartlett |
| 3,819,119 | A | | 6/1974 | Coffey et al. |
| 3,828,977 | A | | 8/1974 | Borchert |
| 3,848,778 | A | | 11/1974 | Meshberg |
| 3,848,808 | A | | 11/1974 | Fetty et al. |
| 3,862,705 | A | | 1/1975 | Beres et al. |

(56) References Cited

U.S. PATENT DOCUMENTS 3,871,553 A 3/1975 Steinberg
3,876,154 A 4/1975 Griebel
3,891,128 A 6/1975 Smrt
3,899,134 A 8/1975 Wagner
3,912,132 A 10/1975 Stevens
3,913,803 A 10/1975 Laauwe
3,913,804 A 10/1975 Laauwe
3,913,842 A 10/1975 Singer
D237,796 S 11/1975 Wagner
3,932,973 A 1/1976 Moore
3,936,002 A 2/1976 Geberth, Jr.
3,938,708 A 2/1976 Burger
3,945,571 A 3/1976 Rash
3,961,756 A * 6/1976 Martini ..... 239/337
3,975,554 A 8/1976 Kummins et al.
3,982,698 A 9/1976 Anderson
3,987,811 A 10/1976 Finger
3,989,165 A 11/1976 Shaw et al.
3,991,916 A 11/1976 Del Bon
3,992,003 A 11/1976 Visceglia et al.
4,032,064 A 6/1977 Giggard
4,036,438 A 7/1977 Soderlind et al.
4,036,673 A 7/1977 Murphy et al.
4,040,134 A 8/1977 Downing
4,045,860 A 9/1977 Winckler
4,058,287 A 11/1977 Fromfield
4,078,578 A 3/1978 Buchholz
4,089,443 A 5/1978 Zrinyi
4,096,974 A 6/1978 Haber et al.
4,117,951 A 10/1978 Winckler
4,123,005 A 10/1978 Blunk
4,129,448 A 12/1978 Greenfield et al.
4,147,284 A 4/1979 Mizzi
4,148,416 A 4/1979 Gunn-Smith
4,154,378 A 5/1979 Paoletti et al.
4,159,079 A 6/1979 Phillips, Jr.
4,164,492 A 8/1979 Cooper
RE30,093 E 9/1979 Burger
4,171,757 A 10/1979 Diamond
4,173,558 A 11/1979 Beck
4,185,758 A 1/1980 Giggard
4,187,959 A 2/1980 Pelton
4,187,985 A 2/1980 Goth
4,195,780 A 4/1980 Inglis
4,198,365 A 4/1980 Pelton
4,202,470 A 5/1980 Fujii
4,204,645 A 5/1980 Hopp
4,232,828 A 11/1980 Shelly, Jr.
4,238,264 A 12/1980 Pelton
4,240,940 A 12/1980 Vasishth et al.
4,258,141 A 3/1981 Jarre et al.
4,275,172 A 6/1981 Barth et al.
4,293,353 A 10/1981 Pelton et al.
4,308,973 A 1/1982 Irland
4,310,108 A 1/1982 Motoyama et al.
4,322,020 A 3/1982 Stone
4,346,743 A 8/1982 Miller
4,354,638 A 10/1982 Weinstein
4,358,388 A 11/1982 Daniel et al.
4,364,521 A 12/1982 Stankowitz
4,370,930 A 2/1983 Strasser et al.
4,372,475 A 2/1983 Goforth et al.
4,401,271 A 8/1983 Hansen
4,401,272 A 8/1983 Merton et al.
4,411,387 A 10/1983 Stern et al.
4,417,674 A 11/1983 Giuffredi
4,434,939 A 3/1984 Stankowitz
4,438,221 A 3/1984 Fracalossi et al.
4,438,884 A 3/1984 O'Brien et al.
4,442,959 A 4/1984 Del Bon et al.
4,460,719 A 7/1984 Danville
4,482,662 A 11/1984 Rapaport et al.
4,496,081 A 1/1985 Farrey
4,546,905 A 10/1985 Nandagiri et al.
4,595,127 A 6/1986 Stoody
4,609,608 A 9/1986 Solc
4,620,669 A 11/1986 Polk
4,641,765 A 2/1987 Diamond
4,674,903 A 6/1987 Chen
4,683,246 A 7/1987 Davis et al.
4,685,622 A 8/1987 Shimohira et al.
4,702,400 A 10/1987 Corbett
4,706,888 A 11/1987 Dobbs
4,728,007 A 3/1988 Samuelson et al.
4,744,495 A 5/1988 Warby
4,744,516 A 5/1988 Peterson et al.
4,761,312 A 8/1988 Koshi et al.
4,792,062 A 12/1988 Goncalves
4,793,162 A 12/1988 Emmons
4,804,144 A 2/1989 Denman
4,815,414 A 3/1989 Duffy et al.
4,819,838 A 4/1989 Hart, Jr.
4,830,224 A 5/1989 Brison
4,839,393 A 6/1989 Buchanan et al.
4,850,387 A 7/1989 Bassill
4,854,482 A 8/1989 Bergner
4,863,104 A 9/1989 Masterson
4,870,805 A 10/1989 Morane
4,878,599 A 11/1989 Greenway
4,887,651 A 12/1989 Santiago
4,893,730 A 1/1990 Bolduc
4,896,832 A 1/1990 Howlett
D307,649 S 5/1990 Henry
RE33,235 E 6/1990 Corsette
4,940,171 A 7/1990 Gilroy
4,948,054 A 8/1990 Mills
4,949,871 A 8/1990 Flanner
4,951,876 A 8/1990 Mills
4,953,759 A 9/1990 Schmidt
4,954,544 A 9/1990 Chandaria
4,955,545 A 9/1990 Stern et al.
4,961,537 A 10/1990 Stern
4,969,577 A 11/1990 Werding
4,969,579 A 11/1990 Behar
4,988,017 A 1/1991 Schrader et al.
4,989,787 A 2/1991 Nikkel et al.
4,991,750 A 2/1991 Moral
5,007,556 A 4/1991 Lover
5,009,390 A 4/1991 McAuliffe, Jr. et al.
5,037,011 A 8/1991 Woods
5,038,964 A 8/1991 Bouix
5,039,017 A 8/1991 Howe
5,052,585 A 10/1991 Bolduc
5,059,187 A 10/1991 Sperry et al.
5,065,900 A 11/1991 Scheindel
5,069,390 A 12/1991 Stern et al.
5,083,685 A 1/1992 Amemiya et al.
5,100,055 A 3/1992 Rokitenetz et al.
5,115,944 A 5/1992 Nikolich
5,126,086 A 6/1992 Stoffel
5,150,880 A 9/1992 Austin, Jr. et al.
5,169,037 A 12/1992 Davies et al.
5,182,316 A 1/1993 DeVoe et al.
5,188,263 A 2/1993 Woods
5,188,295 A 2/1993 Stern et al.
5,211,317 A 5/1993 Diamond et al.
5,219,609 A 6/1993 Owens
5,232,161 A 8/1993 Clemmons
5,250,599 A 10/1993 Swartz
5,255,846 A 10/1993 Ortega
5,277,336 A 1/1994 Youel
5,288,024 A 2/1994 Vitale
5,297,704 A 3/1994 Stollmeyer
5,307,964 A 5/1994 Toth
5,310,095 A 5/1994 Stern et al.
5,312,888 A 5/1994 Nafziger et al.
5,314,097 A 5/1994 Smrt et al.
5,323,963 A 6/1994 Ballu
5,341,970 A 8/1994 Woods
5,342,597 A 8/1994 Tunison, III
5,360,127 A 11/1994 Barriac et al.
5,368,207 A 11/1994 Cruysberghs
5,374,434 A 12/1994 Clapp et al.
5,405,051 A 4/1995 Miskell

(56) References Cited

U.S. PATENT DOCUMENTS

| | | | |
|---|---|---|---|
| 5,409,148 | A | 4/1995 | Stern et al. |
| 5,415,351 | A | 5/1995 | Otto et al. |
| 5,417,357 | A | 5/1995 | Yquel |
| D358,989 | S | 6/1995 | Woods |
| 5,421,519 | A | 6/1995 | Woods |
| 5,425,824 | A | 6/1995 | Marwick |
| 5,443,211 | A | 8/1995 | Young et al. |
| 5,450,983 | A | 9/1995 | Stern et al. |
| 5,467,902 | A | 11/1995 | Yquel |
| 5,476,879 | A | 12/1995 | Woods et al. |
| 5,489,048 | A | 2/1996 | Stern et al. |
| 5,498,282 | A | 3/1996 | Miller et al. |
| 5,501,375 | A | 3/1996 | Nilson |
| 5,505,344 | A | 4/1996 | Woods |
| 5,523,798 | A | 6/1996 | Hagino et al. |
| 5,524,798 | A | 6/1996 | Stern et al. |
| 5,544,783 | A | 8/1996 | Conigliaro |
| 5,548,010 | A | 8/1996 | Franer |
| 5,549,228 | A | 8/1996 | Brown |
| 5,558,247 | A | 9/1996 | Caso |
| 5,562,235 | A | 10/1996 | Cruysberghs |
| 5,570,813 | A | 11/1996 | Clark, II |
| 5,573,137 | A | 11/1996 | Pauls |
| 5,577,851 | A | 11/1996 | Koptis |
| 5,583,178 | A | 12/1996 | Oxman et al. |
| 5,597,095 | A | 1/1997 | Ferrara, Jr. |
| 5,615,804 | A | 4/1997 | Brown |
| 5,638,990 | A | 6/1997 | Kastberg |
| 5,639,026 | A | 6/1997 | Woods |
| 5,641,095 | A | 6/1997 | de Laforcade |
| 5,645,198 | A | 7/1997 | Stern et al. |
| 5,655,691 | A | 8/1997 | Stern et al. |
| 5,695,788 | A | 12/1997 | Woods |
| 5,715,975 | A | 2/1998 | Stern et al. |
| 5,727,736 | A | 3/1998 | Tryon |
| 5,752,631 | A | 5/1998 | Yabuno et al. |
| 5,775,432 | A | 7/1998 | Burns et al. |
| 5,792,465 | A | 8/1998 | Hagarty |
| 5,799,879 | A | 9/1998 | Ottl et al. |
| 5,865,351 | A | 2/1999 | De Laforcade |
| 5,868,286 | A | 2/1999 | Mascitelli |
| 5,887,756 | A | 3/1999 | Brown |
| 5,894,964 | A | 4/1999 | Barnes et al. |
| D409,487 | S | 5/1999 | Wadsworth et al. |
| D409,917 | S | 5/1999 | Wadsworth et al. |
| D409,918 | S | 5/1999 | Wadsworth et al. |
| 5,915,598 | A | 6/1999 | Yazawa et al. |
| 5,921,446 | A | 7/1999 | Stern |
| 5,934,518 | A | 8/1999 | Stern et al. |
| 5,941,462 | A | 8/1999 | Sandor |
| 5,957,333 | A | 9/1999 | Losenno et al. |
| 5,975,356 | A | 11/1999 | Yquel et al. |
| 5,979,797 | A | 11/1999 | Castellano |
| 5,988,575 | A | 11/1999 | Lesko |
| 5,988,923 | A | 11/1999 | Arai |
| 6,000,583 | A | 12/1999 | Stern et al. |
| 6,027,042 | A | 2/2000 | Smith |
| 6,032,830 | A | 3/2000 | Brown |
| 6,039,306 | A | 3/2000 | Pericard et al. |
| 6,062,494 | A | 5/2000 | Mills |
| 6,070,770 | A | 6/2000 | Tada et al. |
| 6,092,698 | A | 7/2000 | Bayer |
| 6,095,377 | A | 8/2000 | Sweeton et al. |
| 6,095,435 | A | 8/2000 | Greer, Jr. et al. |
| 6,112,945 | A | 9/2000 | Woods |
| 6,113,070 | A | 9/2000 | Holzboog |
| 6,116,473 | A | 9/2000 | Stern et al. |
| 6,126,090 | A | 10/2000 | Wadsworth et al. |
| 6,129,247 | A | 10/2000 | Thomas et al. |
| 6,131,777 | A | 10/2000 | Warby |
| 6,131,820 | A | 10/2000 | Dodd |
| 6,139,821 | A | 10/2000 | Fuerst et al. |
| 6,152,335 | A | 11/2000 | Stern et al. |
| 6,161,735 | A | 12/2000 | Uchiyama et al. |
| 6,168,093 | B1 | 1/2001 | Greer, Jr. et al. |
| 6,170,717 | B1 | 1/2001 | Di Giovanni et al. |
| D438,111 | S | 2/2001 | Woods |
| D438,786 | S | 3/2001 | Ghali |
| 6,225,393 | B1 | 5/2001 | Woods |
| 6,227,411 | B1 | 5/2001 | Good |
| 6,254,015 | B1 | 7/2001 | Abplanalp |
| 6,257,503 | B1 | 7/2001 | Baudin |
| 6,261,631 | B1 | 7/2001 | Lomasney et al. |
| 6,265,459 | B1 | 7/2001 | Mahoney et al. |
| 6,276,570 | B1 | 8/2001 | Stern et al. |
| 6,283,171 | B1 | 9/2001 | Blake |
| 6,290,104 | B1 | 9/2001 | Bougamont et al. |
| 6,296,155 | B1 | 10/2001 | Smith |
| 6,296,156 | B1 | 10/2001 | Lasserre et al. |
| 6,299,679 | B1 | 10/2001 | Montoya |
| 6,299,686 | B1 | 10/2001 | Mills |
| 6,315,152 | B1 | 11/2001 | Kalisz |
| 6,325,256 | B1 | 12/2001 | Liljeqvist et al. |
| 6,328,185 | B1 | 12/2001 | Stern et al. |
| 6,328,197 | B1 | 12/2001 | Gapihan |
| 6,334,727 | B1 | 1/2002 | Gueret |
| 6,352,184 | B1 | 3/2002 | Stern et al. |
| 6,362,302 | B1 | 3/2002 | Boddie |
| 6,375,036 | B1 | 4/2002 | Woods |
| 6,382,474 | B1 | 5/2002 | Woods et al. |
| 6,386,402 | B1 | 5/2002 | Woods |
| 6,394,321 | B1 | 5/2002 | Bayer |
| 6,394,364 | B1 | 5/2002 | Abplanalp |
| 6,395,794 | B2 | 5/2002 | Lucas et al. |
| 6,398,082 | B2 | 6/2002 | Clark et al. |
| 6,399,687 | B2 | 6/2002 | Woods |
| 6,415,964 | B2 | 7/2002 | Woods |
| 6,439,430 | B1 | 8/2002 | Gilroy, Sr. et al. |
| 6,446,842 | B2 | 9/2002 | Stern et al. |
| D464,395 | S | 10/2002 | Huang |
| 6,474,513 | B2 | 11/2002 | Burt |
| 6,478,198 | B2 | 11/2002 | Haroian |
| 6,478,561 | B2 | 11/2002 | Braun et al. |
| 6,482,392 | B1 | 11/2002 | Zhou et al. |
| 6,510,969 | B2 | 1/2003 | Di Giovanni et al. |
| 6,520,377 | B2 | 2/2003 | Yquel |
| 6,531,528 | B1 | 3/2003 | Kurp |
| 6,536,633 | B2 | 3/2003 | Stern et al. |
| 6,581,807 | B1 | 6/2003 | Mekata |
| 6,588,628 | B2 | 7/2003 | Abplanalp et al. |
| 6,595,393 | B1 | 7/2003 | Loghman-Adham et al. |
| 6,615,827 | B2 | 9/2003 | Greenwood et al. |
| 6,637,627 | B1 | 10/2003 | Liljeqvist et al. |
| 6,641,005 | B1 | 11/2003 | Stern et al. |
| 6,641,864 | B2 | 11/2003 | Woods |
| 6,652,704 | B2 | 11/2003 | Green |
| 6,659,312 | B1 | 12/2003 | Stern et al. |
| 6,666,352 | B1 | 12/2003 | Woods |
| 6,688,492 | B2 | 2/2004 | Jaworski et al. |
| 6,712,238 | B1 | 3/2004 | Mills |
| 6,726,066 | B2 | 4/2004 | Woods |
| 6,736,288 | B1 | 5/2004 | Green |
| 6,758,373 | B2 | 7/2004 | Jackson et al. |
| 6,797,051 | B2 | 9/2004 | Woods |
| 6,802,461 | B2 | 10/2004 | Schneider |
| 6,831,110 | B2 | 12/2004 | Ingold et al. |
| 6,832,704 | B2 | 12/2004 | Smith |
| 6,837,396 | B2 | 1/2005 | Jaworski et al. |
| 6,843,392 | B1 | 1/2005 | Walker |
| D501,538 | S | 2/2005 | Zeng |
| D501,914 | S | 2/2005 | Chen |
| 6,848,601 | B2 | 2/2005 | Greer, Jr. |
| 6,851,575 | B2 | 2/2005 | van't Hoff |
| D502,533 | S | 3/2005 | Chen |
| 6,880,733 | B2 | 4/2005 | Park |
| 6,883,688 | B1 | 4/2005 | Stern et al. |
| 6,894,095 | B2 | 5/2005 | Russo et al. |
| 6,905,050 | B1 | 6/2005 | Stern et al. |
| 6,910,608 | B2 | 6/2005 | Greer, Jr. et al. |
| 6,913,407 | B2 | 7/2005 | Greer et al. |
| 6,926,178 | B1 | 8/2005 | Anderson |
| 6,929,154 | B2 | 8/2005 | Grey et al. |
| 6,932,244 | B2 | 8/2005 | Meshberg |
| 6,966,467 | B2 | 11/2005 | Di Giovanni et al. |

(56) References Cited

U.S. PATENT DOCUMENTS

| | | | |
|---|---|---|---|
| D512,309 | S | 12/2005 | Geier |
| 6,971,353 | B2 | 12/2005 | Heinze et al. |
| 6,971,553 | B2 | 12/2005 | Brennan et al. |
| 6,978,916 | B2 | 12/2005 | Smith |
| 6,978,947 | B2 | 12/2005 | Jin |
| 6,981,616 | B2 | 1/2006 | Loghman-Adham et al. |
| 7,014,073 | B1 | 3/2006 | Stern et al. |
| 7,014,127 | B2 | 3/2006 | Valpey, III et al. |
| 7,036,685 | B1 | 5/2006 | Green |
| 7,059,497 | B2 | 6/2006 | Woods |
| 7,059,546 | B2 | 6/2006 | Ogata et al. |
| 7,063,236 | B2 | 6/2006 | Greer, Jr. et al. |
| 7,104,424 | B2 | 9/2006 | Kolanus |
| 7,104,427 | B2 | 9/2006 | Pericard et al. |
| 7,121,434 | B1 | 10/2006 | Caruso |
| 7,163,962 | B2 | 1/2007 | Woods |
| 7,182,227 | B2 | 2/2007 | Poile et al. |
| 7,189,022 | B1 | 3/2007 | Greer, Jr. et al. |
| 7,192,985 | B2 | 3/2007 | Woods |
| 7,204,393 | B2 | 4/2007 | Strand |
| 7,226,001 | B1 | 6/2007 | Stern et al. |
| 7,226,232 | B2 | 6/2007 | Greer, Jr. et al. |
| 7,232,047 | B2 | 6/2007 | Greer, Jr. et al. |
| 7,237,697 | B2 | 7/2007 | Dunne |
| 7,240,857 | B1 | 7/2007 | Stern et al. |
| 7,249,692 | B2 | 7/2007 | Walters et al. |
| 7,261,225 | B2 | 8/2007 | Rueschhoff et al. |
| 7,267,248 | B2 | 9/2007 | Yerby et al. |
| 7,278,590 | B1 | 10/2007 | Greer, Jr. et al. |
| 7,303,152 | B2 | 12/2007 | Woods |
| 7,307,053 | B2 | 12/2007 | Tasz et al. |
| 7,337,985 | B1 | 3/2008 | Greer, Jr. et al. |
| 7,341,169 | B2 | 3/2008 | Bayer |
| 7,350,676 | B2 | 4/2008 | Di Giovanni et al. |
| 7,374,068 | B2 | 5/2008 | Greer, Jr. |
| 7,383,968 | B2 | 6/2008 | Greer, Jr. et al. |
| 7,383,970 | B2 | 6/2008 | Anderson |
| 7,445,166 | B2 | 11/2008 | Williams |
| 7,448,517 | B2 | 11/2008 | Shieh et al. |
| 7,481,338 | B1 | 1/2009 | Stern et al. |
| 7,487,891 | B2 | 2/2009 | Yerby et al. |
| 7,487,893 | B1 | 2/2009 | Greer, Jr. et al. |
| 7,494,075 | B2 | 2/2009 | Schneider |
| 7,500,621 | B2 | 3/2009 | Tryon et al. |
| 7,510,102 | B2 | 3/2009 | Schmitt |
| 7,556,841 | B2 | 7/2009 | Kimball et al. |
| D600,119 | S | 9/2009 | Sweeton |
| 7,588,171 | B2 | 9/2009 | Reedy et al. |
| 7,597,274 | B1 | 10/2009 | Stern et al. |
| 7,600,659 | B1 | 10/2009 | Greer, Jr. et al. |
| 7,624,932 | B1 | 12/2009 | Greer, Jr. et al. |
| 7,631,785 | B2 | 12/2009 | Paas et al. |
| 7,641,079 | B2 | 1/2010 | Lott et al. |
| 7,673,816 | B1 | 3/2010 | Stern et al. |
| 7,677,420 | B1 | 3/2010 | Greer, Jr. et al. |
| 7,699,190 | B2 | 4/2010 | Hygema |
| 7,721,920 | B2 | 5/2010 | Ruiz De Gopegui et al. |
| 7,744,299 | B1 | 6/2010 | Greer, Jr. et al. |
| 7,748,572 | B2 | 7/2010 | Althoff et al. |
| 7,757,905 | B2 | 7/2010 | Strand et al. |
| 7,766,196 | B2 | 8/2010 | Sugano et al. |
| 7,775,408 | B2 | 8/2010 | Yamamoto et al. |
| 7,784,647 | B2 | 8/2010 | Tourigny |
| 7,784,649 | B2 | 8/2010 | Greer, Jr. |
| 7,789,278 | B2 | 9/2010 | Ruiz de Gopegui et al. |
| 7,845,523 | B1 | 12/2010 | Greer, Jr. et al. |
| 7,854,356 | B2 | 12/2010 | Eberhardt |
| 7,886,995 | B2 | 2/2011 | Togashi |
| 7,891,529 | B2 | 2/2011 | Paas et al. |
| 7,913,877 | B2 | 3/2011 | Neuhalfen |
| 7,922,041 | B2 | 4/2011 | Gurrisi et al. |
| 7,926,741 | B2 | 4/2011 | Laidler et al. |
| 7,947,753 | B2 | 5/2011 | Greer, Jr. |
| 7,980,487 | B2 | 7/2011 | Mirazita et al. |
| 7,984,827 | B2 | 7/2011 | Hygema |
| 7,984,834 | B2 | 7/2011 | McBroom et al. |
| 8,128,008 | B2 | 3/2012 | Chevalier |
| 8,328,053 | B2 | 12/2012 | Bargo |
| 8,328,120 | B2 | 12/2012 | Vanblaere et al. |
| 8,356,734 | B2 | 1/2013 | Oshimo et al. |
| 8,360,280 | B2 | 1/2013 | Tournier |
| 8,371,481 | B2 | 2/2013 | Kopp |
| 2001/0002676 | A1 | 6/2001 | Woods |
| 2002/0003147 | A1 | 1/2002 | Corba |
| 2002/0100769 | A1 | 8/2002 | McKune |
| 2002/0119256 | A1 | 8/2002 | Woods |
| 2003/0102328 | A1 | 6/2003 | Abplanalp et al. |
| 2003/0134973 | A1 | 7/2003 | Chen et al. |
| 2003/0183651 | A1 | 10/2003 | Greer, Jr. |
| 2003/0205580 | A1 | 11/2003 | Yahav |
| 2004/0012622 | A1 | 1/2004 | Russo et al. |
| 2004/0099697 | A1 | 5/2004 | Woods |
| 2004/0141797 | A1 | 7/2004 | Garabedian et al. |
| 2004/0157960 | A1 | 8/2004 | Rowe |
| 2004/0195277 | A1 | 10/2004 | Woods |
| 2005/0121474 | A1 | 6/2005 | Lasserre et al. |
| 2005/0161531 | A1 | 7/2005 | Greer, Jr. et al. |
| 2005/0236436 | A1 | 10/2005 | Woods |
| 2005/0256257 | A1 | 11/2005 | Betremieux et al. |
| 2006/0049205 | A1 | 3/2006 | Green |
| 2006/0079588 | A1 | 4/2006 | Greer, Jr. |
| 2006/0180616 | A1 | 8/2006 | Woods |
| 2006/0219808 | A1 | 10/2006 | Woods |
| 2006/0219811 | A1 | 10/2006 | Woods |
| 2006/0273207 | A1 | 12/2006 | Woods |
| 2007/0117916 | A1 | 5/2007 | Anderson et al. |
| 2007/0119984 | A1 | 5/2007 | Woods |
| 2007/0125879 | A1 | 6/2007 | Khamenian |
| 2007/0142260 | A1 | 6/2007 | Tasz et al. |
| 2007/0155892 | A1 | 7/2007 | Gharapetian et al. |
| 2007/0178243 | A1 | 8/2007 | Houck et al. |
| 2007/0194040 | A1 | 8/2007 | Tasz et al. |
| 2007/0219310 | A1 | 9/2007 | Woods |
| 2007/0228086 | A1 | 10/2007 | Delande et al. |
| 2007/0235563 | A1 | 10/2007 | Woods |
| 2007/0260011 | A1 | 11/2007 | Woods |
| 2007/0272765 | A1 | 11/2007 | Kwasny |
| 2007/0272768 | A1 | 11/2007 | Williams et al. |
| 2008/0017671 | A1 | 1/2008 | Shieh et al. |
| 2008/0029551 | A1 | 2/2008 | Lombardi |
| 2008/0033099 | A1 | 2/2008 | Bosway |
| 2008/0041887 | A1 | 2/2008 | Scheindel |
| 2008/0128203 | A1 | 6/2008 | Greer |
| 2008/0164347 | A1 | 7/2008 | Leuliet et al. |
| 2008/0229535 | A1 | 9/2008 | Walter |
| 2009/0020621 | A1 | 1/2009 | Clark et al. |
| 2009/0283545 | A1 | 11/2009 | Kimball |
| 2010/0108716 | A1 | 5/2010 | Bilko |
| 2010/0155432 | A1 | 6/2010 | Christianson |
| 2010/0200612 | A1 | 8/2010 | Smith |
| 2010/0322892 | A1 | 12/2010 | Burke |
| 2011/0036872 | A1 | 2/2011 | Greer, Jr. et al. |
| 2011/0101025 | A1 | 5/2011 | Walters et al. |
| 2011/0127300 | A1 | 6/2011 | Ghavami-Nasr et al. |

FOREIGN PATENT DOCUMENTS

| | | |
|---|---|---|
| CA | 1191493 | 8/1985 |
| CA | 1210371 | 8/1986 |
| CA | 2145129 | 9/1995 |
| CA | 2090185 | 10/1998 |
| CA | 2291599 | 6/2000 |
| CA | 2381994 | 2/2001 |
| CA | 2327903 | 6/2001 |
| CA | 2065534 | 8/2003 |
| CA | 2448794 | 5/2004 |
| CA | 2504509 | 10/2005 |
| CA | 2504513 | 10/2005 |
| CH | 680849 | 11/1992 |
| DE | 210449 | 5/1909 |
| DE | 250831 | 9/1912 |
| DE | 634230 | 8/1936 |
| DE | 1047686 | 10/1957 |
| DE | 1926796 | 3/1970 |

(56) References Cited

FOREIGN PATENT DOCUMENTS

| | | |
|---|---|---|
| DE | 3527922 | 8/1985 |
| DE | 3808438 | 4/1989 |
| DE | 3806991 | 9/1989 |
| EP | 2130788 | 12/2009 |
| FR | 463476 | 2/1914 |
| FR | 84727 | 4/1964 |
| FR | 1586067 | 2/1970 |
| FR | 2336186 | 7/1977 |
| FR | 2659847 | 9/1991 |
| FR | 2792296 | 10/2000 |
| GB | 470488 | 11/1935 |
| GB | 491396 | 5/1937 |
| GB | 494134 | 1/1938 |
| GB | 508734 | 3/1939 |
| GB | 534349 | 2/1940 |
| GB | 675664 | 2/1949 |
| GB | 726455 | 4/1953 |
| GB | 867713 | 5/1961 |
| GB | 970766 | 9/1964 |
| GB | 977860 | 12/1964 |
| GB | 1144385 | 5/1969 |
| GB | 1536312 | 12/1978 |
| GB | 2418959 | 12/2006 |
| JP | 461392 | 1/1971 |
| JP | 55142073 | 11/1980 |
| JP | 8332414 | 6/1995 |
| NL | 8000344 | 8/1981 |
| WO | 8904796 | 6/1989 |
| WO | 9418094 | 8/1994 |
| WO | 2005087617 | 9/2005 |
| WO | 2005108240 | 11/2005 |
| WO | 2006090229 | 8/2006 |
| WO | 2008060157 | 5/2008 |

OTHER PUBLICATIONS

Chadwick, "Controlling Particle Size in Self-Pressurized Aerosol Packages", Metal Finishing, Jul./Aug. 2004, vol. 102 No. 7/8.

Newman-Green, Inc., "Aerosol Valves, Sprayheads & Accessories Catalog", Apr. 1, 1992, pp. 14, 20, and 22.

Chinese document disclosing a trigger spray assembly for a spray bottle; 2004; 1 page.

Chinese document disclosing a trigger spray assembly for a spray bottle; Jun. 4, 2004; 1 page.

Chinese document disclosing a trigger spray assembly for a spray bottle; Jun. 5, 2004; 1 page.

Saint-Gobain Calmar; "Mixor HP Trigger Sprayer Brochure", Dec. 2001; 2 pages.

ASTM, "Standard Test Method for Conducting Cyclic Potentiodynamic Polarization Measurements for Localized Corrosion Susceptibility of Iron—Nickel, or Cobalt-Based Alloys," 1993, 5 pages.

Tait, "An Introduction to Electrochemical Corrosion Testing for Practicing Engineers and Scientists," 1994, 17 pages.

* cited by examiner

SYSTEMS AND METHODS FOR DISPENSING TEXTURE MATERIAL USING DUAL FLOW ADJUSTMENT

RELATED APPLICATIONS

This application, U.S. patent application Ser. No. 13/560,733 filed Jul. 27, 2012 claims benefit of U.S. Provisional Application Ser. Nos. 61/513,382 filed Jul. 29, 2011, and 61/664,678 filed Jun. 26, 2012, the contents of which are incorporated herein by reference.

TECHNICAL FIELD

This application relates to the dispensing of texture material and, more particularly, to systems and methods for dispensing small amounts of texture material to an un-textured portion of a target surface such that an applied texture pattern of the texture material substantially matches a preexisting texture pattern on a textured portion of the target surface.

BACKGROUND

The present invention generally relates to systems and methods for applying texture material to an interior surface such as a wall or ceiling. In particular, buildings are typically constructed with a wood or metal framework. To form interior wall and ceiling surfaces, drywall material is attached to the framework. Typically, at least one primer layer and at least one paint layer is applied to the surface of the drywall material to form a finished wall surface.

For aesthetic and other reasons, a bumpy or irregular texture layer is often formed on the drywall material after the drywall material has been primed and before it has been painted. The appearance of the texture layer can take a number of patterns. As its name suggests, an "orange peel" texture pattern generally has the appearance of the surface of an orange and is formed by a spray of relatively small droplets of texture material applied in a dense, overlapping pattern. A "splatter" texture pattern is formed by larger, more spaced out droplets of texture material. A "knockdown" texture patter is formed by spraying texture material in larger droplets (like a "splatter" texture pattern) and then lightly working the surfaces of the applied droplets with a knife or scraper so that the highest points of the applied droplets are flattened. In some situations, a visible aggregate material such as polystyrene chips is added to the texture material to form what is commonly referred to as an "acoustic" or "popcorn" texture pattern. The principles of the present invention are of primary significance when applied to a texture material without visible aggregate material.

For larger applications, such as a whole room or structure, the texture layer is typically initially formed using a commercial texture sprayer. Commercial texture sprayers typically comprise a spray gun, a hopper or other source of texture material, and a source of pressurized air. The texture material is mixed with a stream of pressurized air within the texture gun, and the stream of pressurized air carries the texture material in droplets onto the target surface to be textured. Commercial texture sprayers contain numerous points of adjustment (e.g., amount of texture material, pressure of pressurized air, size of outlet opening, etc.) and thus allow precise control of the texture pattern and facilitate the quick application of texture material to large surface areas. However, commercial texture sprayers are expensive and can be difficult to set up, operate, and clean up, especially for small jobs where overspray may be a problem.

For smaller jobs and repairs, especially those performed by non-professionals, a number of "do-it-yourself" (DIY) products for applying texture material are currently available in the market. Perhaps the most common type of DIY texturing products includes aerosol systems that contain texture material and a propellant. Aerosol systems typically include a container, a valve, and an actuator. The container contains the texture material and propellant under pressure. The valve is mounted to the container selectively to allow the pressurized propellant to force the texture material out of the container. The actuator defines an outlet opening, and, when the actuator is depressed to place the valve in an open configuration, the pressurized propellant forces the texture material out of the outlet opening in a spray. The spray typically approximates only one texture pattern, so it was difficult to match a variety of perhaps unknown preexisting texture patterns with original aerosol texturing products.

A relatively crude work around for using an aerosol texturing system to apply more than one texture pattern is to reduce the pressure of the propellant material within the container prior to operating the valve. In particular, when maintained under pressure within the container, typical propellant materials exist in both a gas phase and in a liquid phase. The propellant material in the liquid phase is mixed with the texture material, and the texture material in the gas state pressurizes the mixture of texture material and liquid propellant material. When the container is held upright, the liquid contents of the container are at the bottom of the container chamber, while the gas contents of the container collect at the top of the container chamber. A dip tube extends from the valve to the bottom of the container chamber to allow the propellant in the gas phase to force the texture material up from the bottom of the container chamber and out of the outlet opening when the valve is opened. To increase the size of the droplets sprayed out of the aerosol system, the container can be inverted, the valve opened, and the gas phase propellant material allowed to flow out of the aerosol system, reducing pressure within the container chamber. The container is then returned upright and the valve operated again before the pressure of the propellant recovers such that the liquid contents are forced out in a coarser texture pattern. This technique of adjusting the applied texture pattern result in only a limited number of texture patterns that are not highly repeatable and can drain the can of propellant before the texture material is fully dispensed.

A more refined method of varying the applied texture pattern created by aerosol texturing patterns involved adjusting the size of the outlet opening formed by the actuator structure. Initially, it was discovered that the applied texture pattern could be varied by attaching one of a plurality of straws or tubes to the actuator member, where each tube defined an internal bore of a different diameter. The straws or tubes were sized and dimensioned to obtain fine, medium, and coarse texture patterns appropriate for matching a relatively wide range of pre-existing texture patterns. Additional structures such as caps and plates defining a plurality of openings each having a different cross-sectional area could be rotatably attached relative to the actuator member to change the size of the outlet opening. More recently, a class of products has been developed using a resilient member that is deformed to alter the size of the outlet opening and thus the applied texture pattern.

Existing aerosol texturing products are acceptable for many situations, especially by DIY users who do not expect perfect or professional results. Professional users and more demanding DIY users, however, will sometimes forego aerosol texturing products in favor of commercial texture sprayers because of the control provided by commercial texture sprayers.

The need thus exists for improved aerosol texturing systems and methods that can more closely approximate the results obtained by commercial texture sprayers.

SUMMARY

A first example of an aerosol dispensing system for dispensing stored material in a spray comprises a container, a conduit, a valve system, a first adjustment system, and a second adjustment system. The container defines a chamber containing the stored material and pressurized material. The conduit defines a conduit passageway having a conduit inlet and a conduit outlet. The conduit inlet is arranged within the chamber, and the conduit outlet is arranged outside of the chamber. The valve system is arranged to allow and prevent flow of stored material along the conduit passageway. The first adjustment system is arranged to control flow of stored material along the conduit passageway. The first adjustment system is arranged between the conduit inlet and the conduit outlet. The second adjustment system is arranged to control flow of stored material along the conduit passageway. The second adjustment system is arranged between the first adjustment system and the conduit outlet.

The present invention may also be embodied as a method of dispensing stored material in a spray comprising the following steps. The stored material and pressurized material are arranged in a chamber. A conduit defining a conduit passageway having a conduit inlet and a conduit outlet is provided. The conduit inlet is arranged within the chamber and the conduit outlet is arranged outside of the chamber. A first cross-sectional area of the conduit passageway is altered to allow and prevent flow of stored material at a first location along a conduit passageway. Flow of stored material is controlled at a second location along the conduit passageway. The second location is arranged between the first location and a conduit outlet defined by the conduit passageway. Flow of stored material is controlled at a third location along the conduit passageway. The third location is arranged between the second location and the conduit outlet.

The present invention may also be embodied as an aerosol dispensing system for dispensing stored material in a spray comprising a container, a conduit, a valve assembly, a first adjustment system, and a second adjustment system. The container defines a chamber containing the stored material and pressurized material. The conduit comprises an inlet tube defining a conduit inlet, a valve housing, an actuator member, an outlet member defining a conduit outlet, and a conduit passageway. The conduit passageway extends through conduit inlet defined by the inlet tube, the valve housing, the actuator member, and the conduit outlet defined by the outlet member. The valve assembly is supported by the valve housing. The valve assembly is normally in a closed configuration in which fluid is substantially prevented from flowing along the conduit passageway. The actuator member is supported relative to the valve assembly such that displacement of the actuator member towards the container places the valve assembly in an open configuration in which fluid is allowed to flow along the conduit passageway. The first adjustment system comprises a first adjustment member and a seal member. The first adjustment member is supported for movement relative to the actuator member. A valve portion of the first adjustment member is arranged within the conduit passageway. Movement of the first adjustment member relative to the actuator member causes the valve portion of the first adjustment member to alter an effective cross-sectional area of the conduit passageway at a first location. The seal member is arranged to prevent fluid flow between the first adjustment member and the actuator member. The second adjustment member is supported for movement relative to the actuator member. Movement of the second adjustment member relative to the actuator member deforms the outlet member to alter an effective cross-sectional area of the conduit passageway at a second location.

DETAILED DESCRIPTION

The present invention may be embodied in many forms, and several examples of aerosol dispensing systems of the present invention will be discussed below.

I. First Example Aerosol Dispensing System

Figure 1:
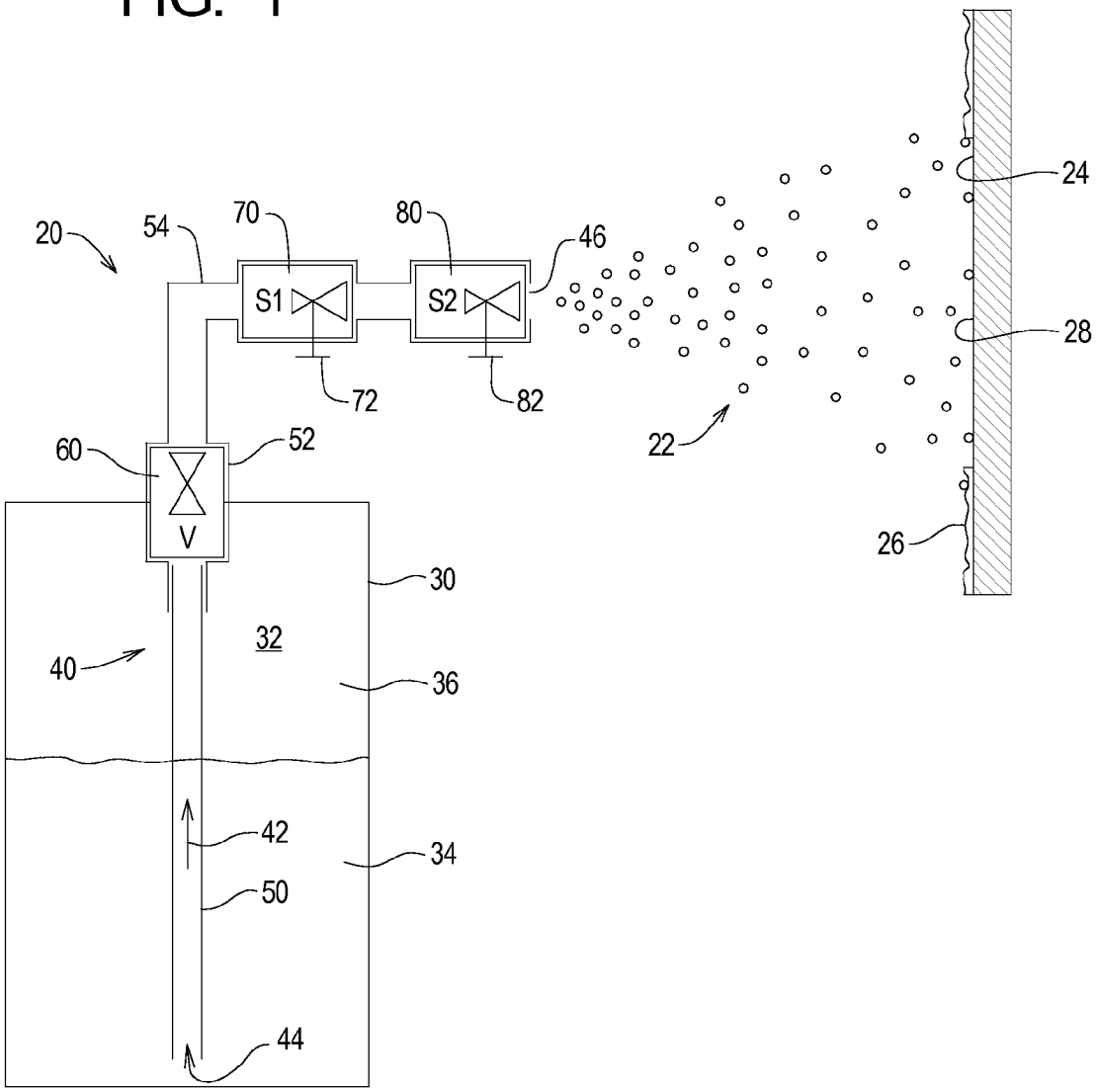
FIG. 1 schematically represents a first example aerosol texturing system of the present invention.

Referring initially to FIG. 1 of the drawing, depicted at 20 therein is a first example aerosol dispensing system constructed in accordance with, and embodying, the principles of the present invention. The first example dispensing system is adapted to spray droplets of dispensed material 22 onto a target surface 24. The example target surface 24 has a textured portion 26 and an un-textured portion 28. Accordingly, in the example use of the dispensing system 20 depicted in FIG. 1, the dispensed material 22 is or contains texture material, and the dispensing system 20 is being used to form a coating on the untextured portion 28 having a desired texture pattern that substantially matches a pre-existing texture pattern of the textured portion 26.

FIG. 1 further illustrates that the example dispensing system 20 comprises a container 30 defining a chamber 32 in which stored material 34 and pressurized material 36 are contained. The stored material 34 is a mixture of texture material and propellant material in liquid phase, while the pressurized material is propellant material in gas phase.

A typical texture material forming a part of the dispensed material 22 and/or stored material 34 will comprise a base or carrier, a binder, a filler, and, optionally, one or more additives such as surfactants, biocides and thickeners. Examples of the base or carrier include water, solvent (oil-based texture material) such as xylene, toluene, acetone, methyl ethyl ketone, and combinations of water and water soluble solvents. Examples of binders include starch, polyvinyl alcohol and latex resins (water-based systems) and a wide variety of polymers such as ethylene vinyl acetate, thermoplastic acrylics, styrenated alkyds, etc. (solvent-based systems.). Examples of fillers include calcium carbonate, titanium dioxide, attapulgite clay, talc, magnesium aluminum silicate, etc.

The stored material 34 will also comprise a liquid phase propellant material, and the pressurized material will typically comprise a gas phase propellant material. The following propellant materials are appropriate for use as the propellant material forming the stored material 34 and the pressurized material 36: dimethyl ether, propane, butane, isobutene, difluoroethane, and tetrafluoroethane.

The following Tables A-1, A-2, and A-3 and Tables A-4 and A-5 attached hereto as Exhibit A contain example formulations of the texture material that may be used to form part of the dispensed material 22 and stored material 34 of the first example aerosol dispensing 20.

TABLE A-1

(Solvent Based)

| Material | Purpose | First Example | Second Example | Third Example |
|---|---|---|---|---|
| Solvent | Base | 35% | 30-40% | 20-60% |
| Pigment | Filler | 60% | 55-65% | 40-80% |
| Resin | Binder | 2.5% | 0-5% | 0-15% |

To the example texture material described in Table A-1 is added propellant material in the form of a propane/butane/isobutane blend. A first range of approximately 10-20% by weight of the propellant material is added to the example texture material of Table A-1, but the propellant material should in any event be within a second range of approximately 5-25% by weight of the propellant material.

TABLE A-2

(Knockdown)

| Material | Purpose | First Example | Second Example | Third Example |
|---|---|---|---|---|
| Water | Base | 48% | 45-55% | 40-60% |
| Pigment | Filler | 50% | 45-55% | 40-60% |
| Resin | Binder | 2% | 0-5% | 0-10% |

To the example texture material described in Table A-2 is added propellant material in the form of DME. A first range of approximately 7-15% by weight of the propellant material is added to the example texture material of Table A-2, but the propellant material should in any event be within a second range of approximately 5-25% by weight of the propellant material.

TABLE A-3

| (No Prime) | | | | |
|---|---|---|---|---|
| Material | Purpose | First Example | Second Example | Third Example |
| Water | Base | 42% | 40-50% | 30-60% |
| Pigment | Filler | 47% | 40-50% | 30-60% |
| Resin | Binder | 10% | 5-15% | 0-20% |

To the example texture material described in Table A-3 is added propellant material in the form of DME. A first range of approximately 10-15% by weight of the propellant material is added to the example texture material of Table A-3, but the propellant material should in any event be within a second range of approximately 5-25% by weight of the propellant material.

With reference to Tables A-4 and A-5 in Exhibit A, that table contains examples of a texture material composition adapted to be combined with an aerosol and dispensed using an aerosol dispensing system in accordance with the principles of the present invention. Each value or range of values in Tables A-4 and A-5 represents the percentage of the overall weight of the example texture material composition formed by each material of the texture material composition for a specific example, a first example range, and a second example range. The composition described in Table A-5 is similar to that of Table A-4, but Table A-5 contains a number of additional materials that may optionally be added to the example texture material composition of Table A-4.

One example of a method of combining the materials set forth in Table A-4 is as follows. Materials A, B, C, and D are combined to form a first sub-composition. The first sub-composition is mixed until material D is dissolved (e.g., 30-40 minutes). Materials E and F are then added to the first sub-composition to form a second sub-composition. The second sub-composition is mixed until materials E and F are well-dispersed (e.g., at high speed for 15-20 minutes). Material G is then added to the second sub-composition to form a third sub-composition. The third sub-composition is mixed well (e.g., 10 minutes). Typically, the speed at which the third sub-composition is mixed is reduced relative to the speed at which the second sub-composition is mixed. Next, materials H, I, and J are added to the third sub-composition to form the example texture material composition of the present invention. The example texture material composition is agitated. Material K may be added as necessary to adjust (e.g., reduce) the viscosity of the example texture material composition.

The example texture material composition of the present invention may be combined with an aerosol propellant in any of the aerosol dispensing systems described herein to facilitate application of the example texture material composition to a surface to be textured.

FIG. 1 further illustrates that the first example aerosol dispensing system 20 comprises a conduit 40 defining a conduit passageway 42. The conduit 40 is supported by the container 30 such that the conduit passageway 42 defines a conduit inlet 44 arranged within the chamber 32 and a conduit outlet 46 arranged outside of the chamber 32. The conduit outlet 46 may alternatively be referred to herein as an outlet opening 46. The example conduit 40 is formed by an inlet tube 50, a valve housing 52, and an actuator structure 54. The conduit passageway 42 extends through the inlet tube 50, the valve housing 52, and the actuator structure 54 such that the valve housing 52 is arranged between the conduit inlet 44 and the actuator structure 54 and the actuator structure 54 is arranged between the valve housing 52 and the conduit outlet 46.

Arranged within the valve housing 52 is a valve system 60. A first flow adjustment system 70 having a first adjustment member 72 is arranged at an intermediate location along the conduit passageway 42 between the valve system 60 and the conduit outlet 46. A second flow adjustment system 80 having a second adjustment member 82 is arranged in the conduit passageway 42 to form at least a portion of the conduit outlet 46.

The valve system 60 operates in a closed configuration and an open configuration. In the closed configuration, the valve system 60 substantially prevents flow of fluid along the conduit passageway 42. In the open configuration, the valve system 60 allows flow of fluid along the conduit passageway 42. The valve system 60 is normally in the closed configuration. The valve system 60 engages the actuator member structure 54 and is placed into the open configuration by applying deliberate manual force on the actuator structure 54 towards the container 30.

The first flow adjustment system 70 is supported by the actuator structure 54 between the valve system 60 and the second adjustment system 80 such that manual operation of the first adjustment member 72 affects the flow of fluid material along the conduit passageway 42. In particular, the second adjustment system 80 functions as a flow restrictor, where operation of the first adjustment member 72 variably reduces the size of the conduit passageway 42 such that a pressure of the fluid material upstream of the first flow adjustment system 70 is relatively higher than the pressure of the fluid material downstream of the first flow adjustment system 70.

In one example implementation of the first flow adjustment system 70, the first adjustment system 70 is operable in a plurality or continuum of configurations ranging between a fully open configuration and a terminal configuration. The fully open configuration typically represents no restriction of the cross-sectional area of the conduit passageway 42 and may be numerically represented as 100% open (i.e., the cross-sectional area defined by the first adjustment system is substantially the same as the cross-sectional area of the conduit passageway upstream of the first adjustment system). The terminal configuration typically represents the greatest amount of restriction of the cross-sectional area of the conduit passageway 42 and may be numerically represented as a fraction of the cross-sectional area of the conduit passageway, such as 12% open (i.e., the cross-sectional area defined by the first adjustment system is approximately 12% of the cross-sectional area of the conduit passageway upstream of the first adjustment system).

The second adjustment system 80 is supported by the actuator structure 54 downstream of the second adjustment system 80. Manual operation of the second adjustment member 82 affects the flow of fluid material flowing out of the conduit passageway 42 through the conduit outlet 46. In particular, the second adjustment system 80 functions as a variable orifice, where operation of the second adjustment member 72 variably reduces the size of the conduit outlet 46 relative to the size of the conduit passageway 42 upstream of the second adjustment system 80.

To operate the first example aerosol dispensing system 20, the container 30 is grasped such that the finger can depress the actuator structure 54. The conduit outlet or outlet opening 46 is initially aimed at a test surface and the actuator structure 54 is depressed to place the valve system 60 in the open configuration such that the pressurized material 36 forces some of the stored material 34 out of the container 30 and onto the test surface to form a test texture pattern. The test texture pattern is compared to the pre-existing texture pattern defined by the textured portion 26 of the target surface 24. If the test texture pattern does not match the pre-existing texture pattern, one or both of the first and second adjustment systems 70 and 80 are adjusted to alter the spray pattern of the droplets of dispensed material 22.

The process of spraying a test pattern and comparing it to the pre-existing pattern and adjusting the first and second adjustment members 72 and 82 is repeated until the dispensed material forms a desired texture pattern that substantially matches the pre-existing texture pattern.

Leaving the first and second adjustment systems 70 and 80 as they were when the test texture pattern matched the pre-existing texture pattern, the aerosol dispensing system 20 is then arranged such that the conduit outlet or outlet opening 46 is aimed at the un-textured portion 28 of the target surface 24. The actuator structure 54 is again depressed to place the valve system 60 in the open configuration such that the pressurized material 36 forces the stored material 34 out of the container 30 and onto the un-textured portion 28 of the target surface to form the desired texture pattern.

II. Second Example Aerosol Dispensing System

Referring now to FIGS. 2-13 of the drawing, depicted at 120 therein is a second example aerosol dispensing system constructed in accordance with, and embodying, the principles of the present invention. Like the first example aerosol dispensing system 20, the second example dispensing system is adapted to spray droplets of dispensed material 122 onto a target surface (not shown). In the example use of the dispensing system 120 depicted in FIG. 2, the dispensed material 122 is or contains texture material, and the dispensing system 120 is being used to form a coating on an untextured portion of the target surface having a desired texture pattern that substantially matches a pre-existing texture pattern of a textured portion of the target surface.

Figure 2:
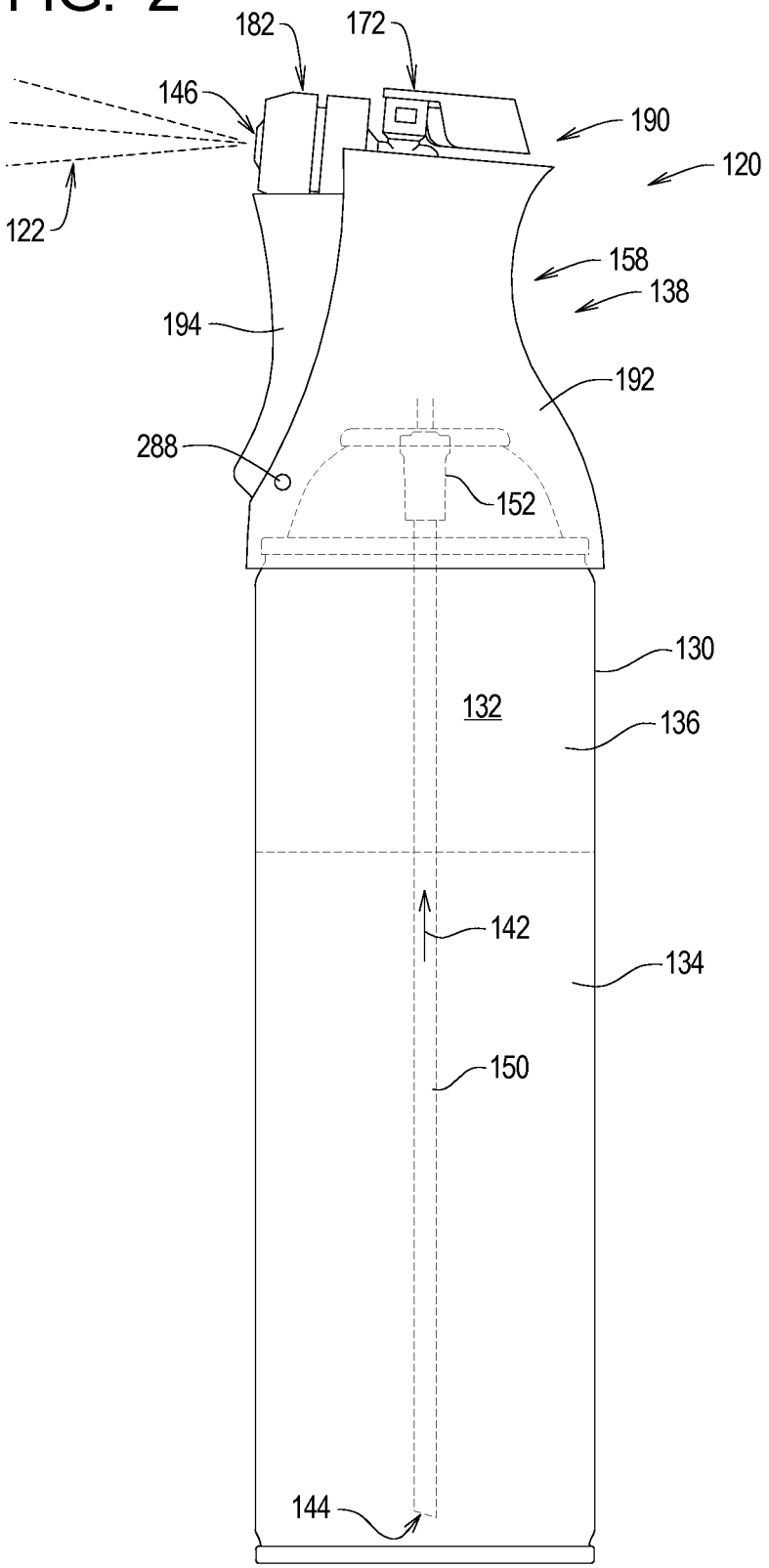
FIG. 2 is a side elevation view of a second example aerosol texturing system of the present invention.

FIG. 2 further illustrates that the example dispensing system 120 comprises a container 130 defining a chamber 132 in which stored material 134 and pressurized material 136 are contained. Like the stored material 34 described above, the stored material 134 is a mixture of texture material and propellant material in liquid phase, while the pressurized material is propellant material in gas phase. An actuator assembly 138 is mounted on the container assembly 130 to facilitate the dispensing of the dispensed material 122 as will be described in further detail below.

Figure 3:
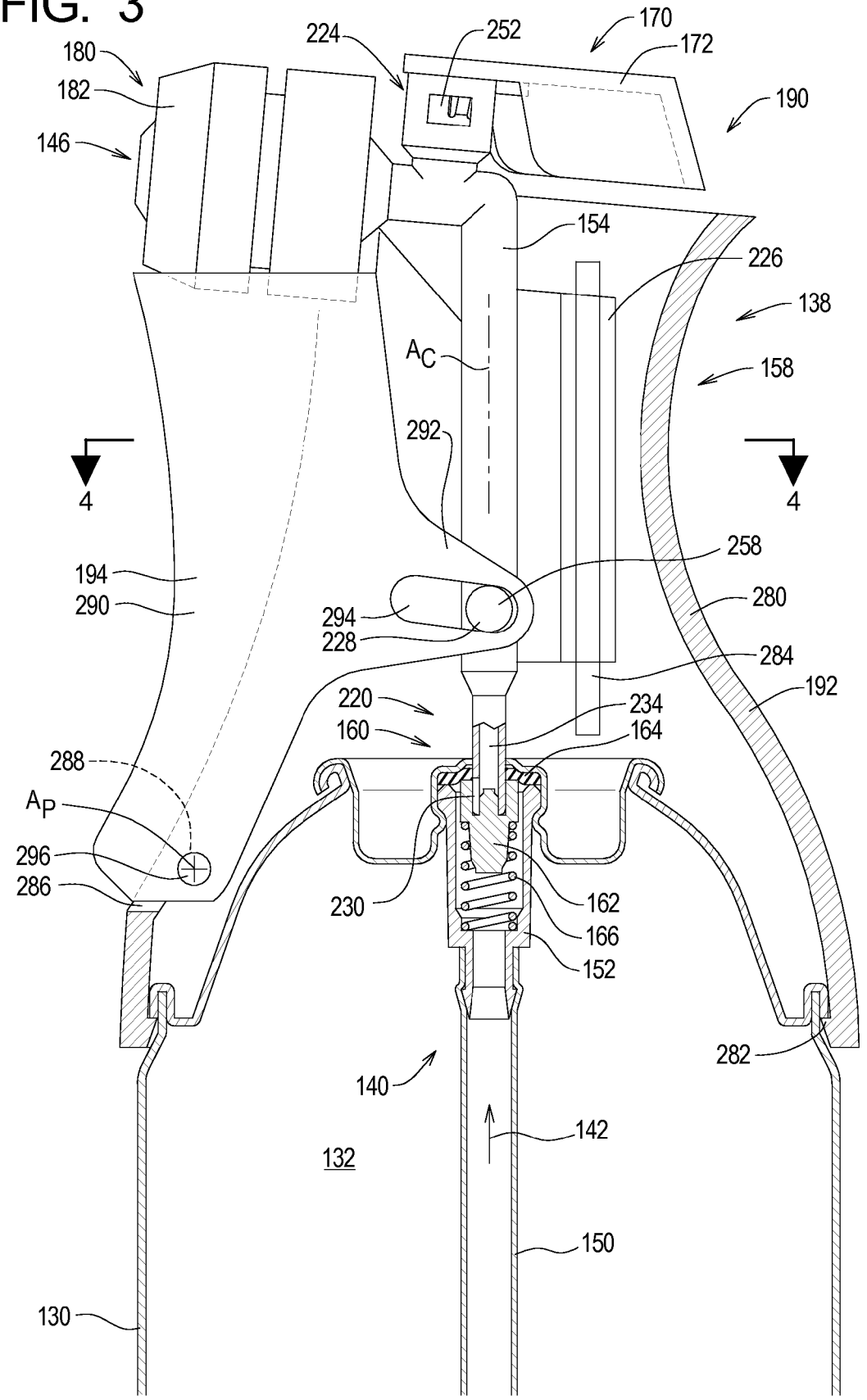
FIG. 3 is a side elevation, partial section view of the second example aerosol texturing system in a closed configuration.
Figure 7:
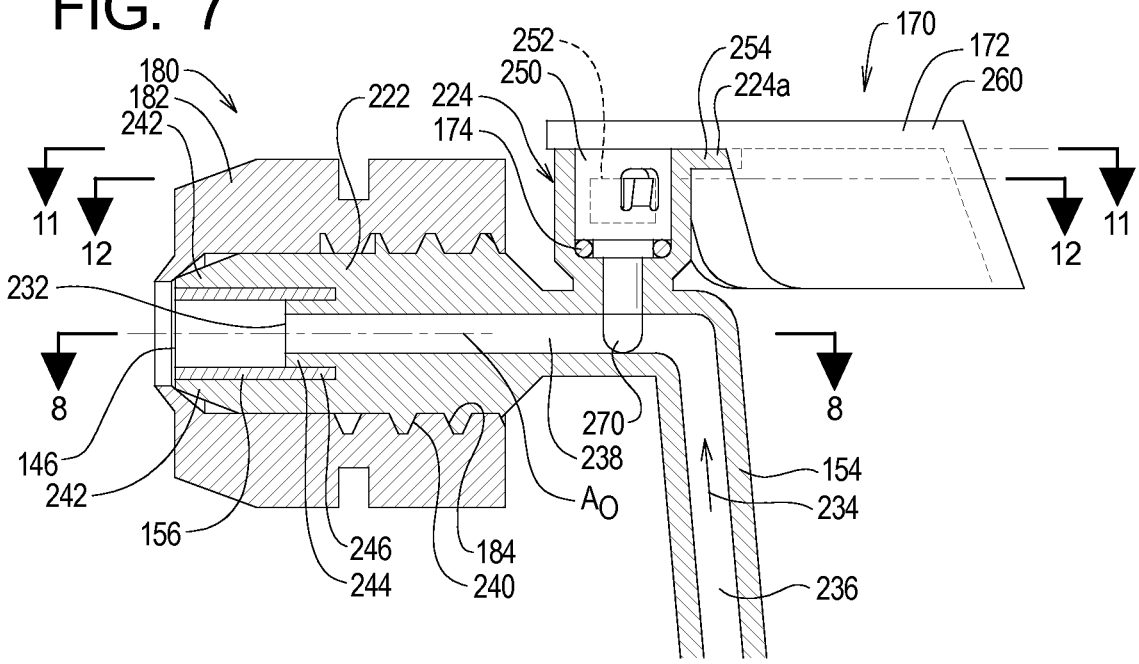
FIG. 7 is a side elevation, partial section view of an actuator member and first and second adjustment members of the second example aerosol texturing system, with the first adjustment member in a fully open position.

FIG. 3 illustrates that the second example aerosol dispensing system 120 comprises a conduit 140 defining a conduit passageway 142. The conduit 140 is supported by the container 130 such that the conduit passageway 142 defines a conduit inlet 144 (FIG. 2) arranged within the chamber 132 and a conduit outlet or outlet opening 146 arranged outside of the chamber 132. The example conduit 140 is formed by an inlet tube 150 (FIGS. 2 and 3), a valve housing 152 (FIGS. 2 and 3), an actuator member 154 (FIGS. 3 and 7), and an outlet member 156 (FIG. 7). The conduit passageway 142 extends through the inlet tube 150, the valve housing 152, the actuator member 154, and the outlet member 156. The valve housing 152 is arranged between the conduit inlet 144 and the actuator member 154, and the actuator member 154 is arranged between the valve housing 152 and the conduit outlet 146. The outlet member 156 is supported by the actuator member 154 to define the conduit outlet 146.

Arranged within the valve housing 152 is a valve assembly 160. The example valve assembly 160 comprises a valve member 162, a valve seat 164, and a valve spring 166. The valve assembly 160 operates in a closed configuration and an open configuration. In the closed configuration, the valve spring 166 forces the valve member 162 against the valve seat 164 such that the valve assembly 160 substantially prevents flow of fluid along the conduit passageway 142. In the open configuration, the valve member 162 is displaced away from the valve seat 164 against the force of the valve spring 166 such that the valve assembly 160 allows flow of fluid along the conduit passageway 142 between the valve member 162 and the valve seat 164. Because the valve spring 166 biases the valve member 162 towards the valve seat 164, the example valve assembly 160 is normally closed. The valve assembly 160 engages the actuator member structure 154 such that the application of deliberate manual force on the actuator member 154 towards the container 130 moves the valve member 162 away from the valve seat 164 and thus places the valve system 160 in the open configuration.

A first flow adjustment system 170 having a first adjustment member 172 and a seal member 174 is arranged at an intermediate location along the conduit passageway 142 between the valve assembly 160 and the conduit outlet 146. In particular, rotation of the first adjustment member 172 relative to the actuator member 154 alters a cross-sectional area of the conduit passageway 142 between the valve system 160 and the second flow adjustment system 180.

A second flow adjustment system 180 having a second adjustment member 182 is arranged in the conduit passageway 142 to form at least a portion of the conduit outlet or outlet opening 146. In particular, the second adjustment member 182 defines a threaded surface 184 that engages the actuator member 154 such that rotation of the second adjustment member 182 relative to the actuator member 154 deforms the outlet member 156 and thereby alters a cross-sectional area of the conduit outlet or outlet opening 146.

The first flow adjustment system 170 is supported by the actuator member 154 between the valve assembly 160 and the second adjustment system 180 such that manual operation of the first adjustment member 172 affects the flow of fluid material along the conduit passageway 142. In particular, the second adjustment system 180 functions as a flow restrictor, where operation of the first adjustment member 172 variably reduces the size of the conduit passageway 142 such that a pressure of the fluid material upstream of the first flow adjustment system 170 is relatively higher than the pressure of the fluid material downstream of the first flow adjustment system 170.

The second adjustment system 180 is supported by the actuator member 154 downstream of the second adjustment system 180. The outlet member 156 is a resiliently deformable tube, and manual operation of the second adjustment member 182 deforms the walls of the outlet member 156 and thereby affects the flow of fluid material flowing out of the conduit passageway 142 through the conduit outlet or outlet opening 146. The second adjustment system 180 thus functions as a variable orifice. Operation of the second adjustment member 172 variably reduces the size of the conduit outlet or outlet opening 146 relative to the size of the conduit passageway 142 upstream of the second adjustment system 180.

The outlet member 156, first adjustment member 172, seal member 174, and second adjustment member 182 are supported by the actuator member 154 to define a control assembly 190. FIG. 2 further shows that the grip assembly 158 comprises a grip housing 192 and a trigger member 194. Additionally, the grip assembly 158 is combined with the control assembly 190 to form the actuator assembly 138, and the actuator assembly 138 is supported by the container assembly 130 as generally described above.

To operate the second example aerosol dispensing system 120, the container 130 and grip housing 192 are grasped such that the user's fingers can squeeze the trigger member 194, thereby depressing the actuator member 154. The conduit outlet or outlet opening 146 is initially aimed at a test surface and the actuator member 154 is depressed to place the valve assembly 160 in the open configuration such that the pressurized material 136 forces some of the stored material 134 out of the container 130 and onto the test surface to form a test texture pattern. The test texture pattern is compared to the pre-existing texture pattern defined by the textured portion of the target surface. If the test texture pattern does not match the pre-existing texture pattern, one or both of the first and second adjustment members is/are adjusted to alter the spray pattern of the droplets of dispensed material 122.

The process of spraying a test pattern and adjusting the first and second adjustment members 172 and 182 is repeated until the test pattern formed by the dispensed material 122 corresponds to a desired texture pattern that substantially matches the pre-existing texture pattern.

Leaving the first and second adjustment members 172 and 182 as they were when the test texture pattern corresponded to the desired texture pattern, the aerosol dispensing system 120 is then arranged such that the conduit outlet or outlet opening 146 is aimed at the un-textured portion of the target surface. The trigger member 194 is again squeezed to place the valve assembly 160 in the open configuration such that the pressurized material 136 forces the stored material 134 out of the container 130 and onto the un-textured portion of the target surface to form the desired texture pattern on the un-textured portion of the target surface, perhaps overlapping slightly with the textured portion of the target surface. Since the desired texture pattern substantially matches the pre-existing texture pattern, the dispensed material forms a coating on the previously un-textured portion of the target surface that substantially matches a physical appearance of the textured portion. One or more layers of primer and/or paint may next be applied over the cured layer of dispensed material on the target surface.

With the foregoing general understanding of the operation of the first example aerosol dispensing system 120 in mind, the details of construction and operation of this example aerosol dispensing system 120 will now be described in further detail.

Figure 4:
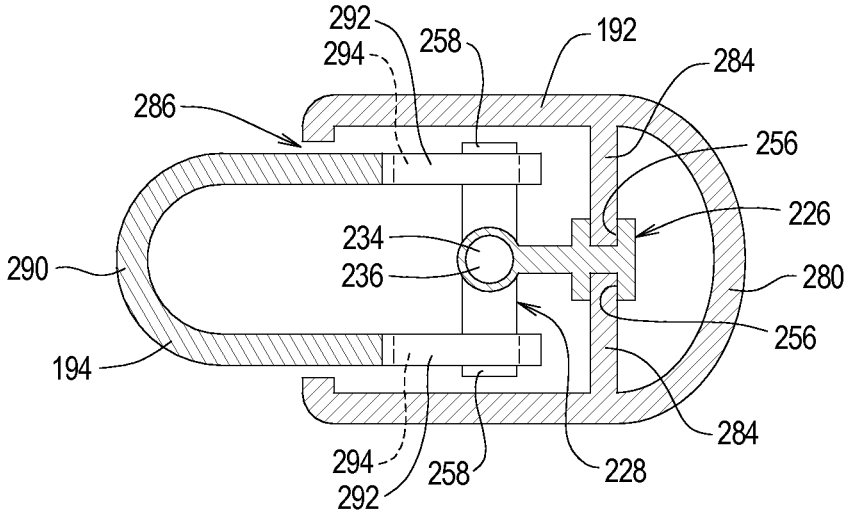
FIG. 4 is a section view taken along lines 4-4 in FIG. 3.
Figure 5:
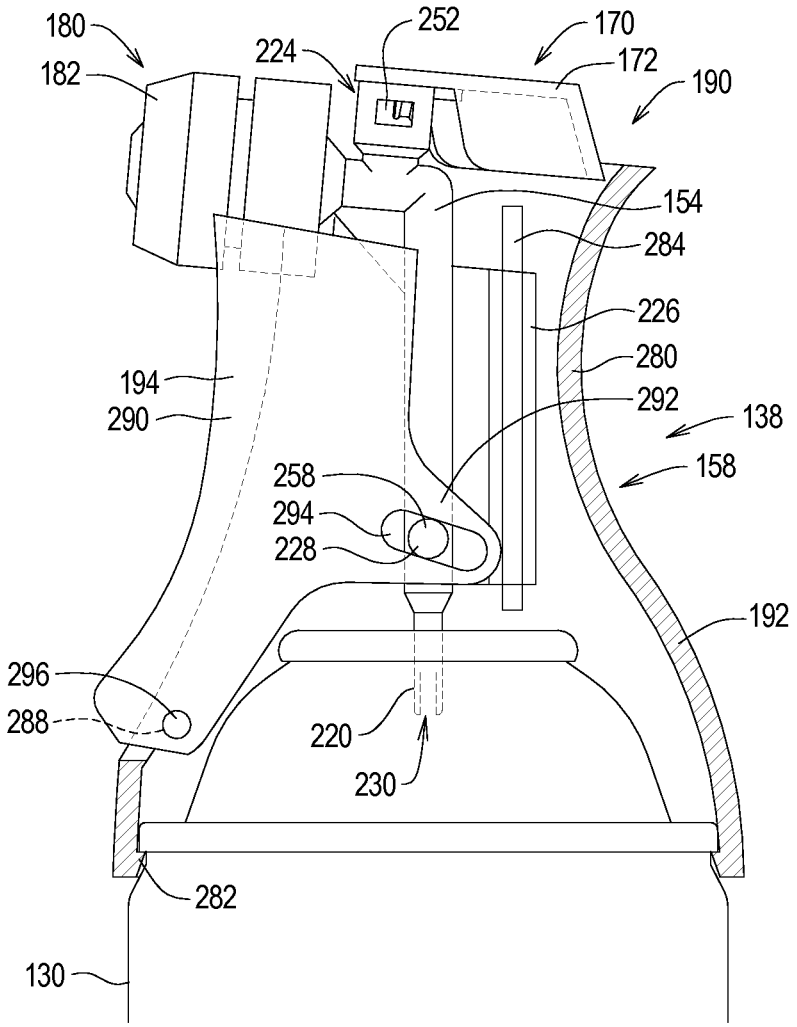
FIG. 5 is a side elevation, partial section view showing the second example aerosol texturing system in an open configuration.
Figure 6:
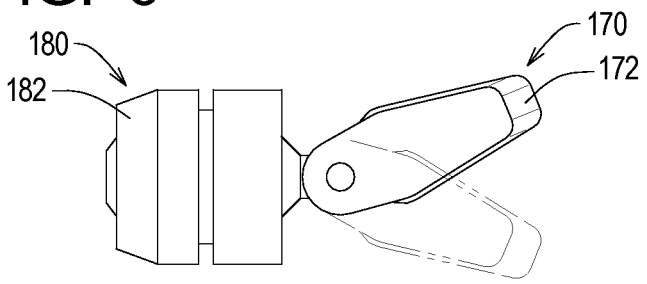
FIG. 6 is a top plan view of an actuator member and first and second adjustment members of the second example aerosol texturing system.

Referring now to FIGS. 3-5 and 7, the example actuator member 154 of the second example aerosol dispensing system 120 will now be described in further detail. The example actuator member 154 comprises an inlet portion 220 (FIGS. 3 and 5), an outlet portion 222 (FIG. 7), a socket portion 224 (FIGS. 3 and 7), a guide portion 226 (FIGS. 3-5), and a link portion 228 (FIGS. 3-5). The actuator member 154 further defines an actuator inlet 230 (FIGS. 3 and 5), an actuator outlet 232 (FIG. 7), and an actuator passageway 234 having a first portion 236 and a second portion 238 (FIGS. 3, 4, and 7). As perhaps best shown in FIG. 7, the outlet portion 222 of the actuator member 154 defines a threaded external surface 240, two or more fingers 242, a mounting projection 244 through which the actuator outlet 232 extends, and a mounting recess 246 formed around at least a portion of the mounting projection 244.

Figure 9:
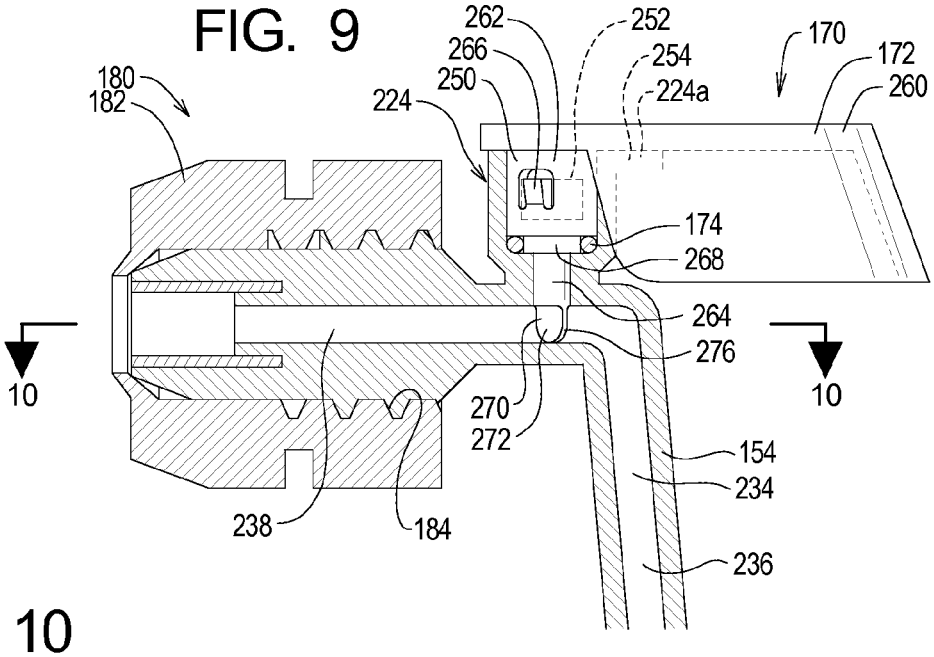
FIG. 9 is a side elevation, partial section view of an actuator member and first and second adjustment members of the second example aerosol texturing system, with the first adjustment member in a partially open position.
Figure 13:
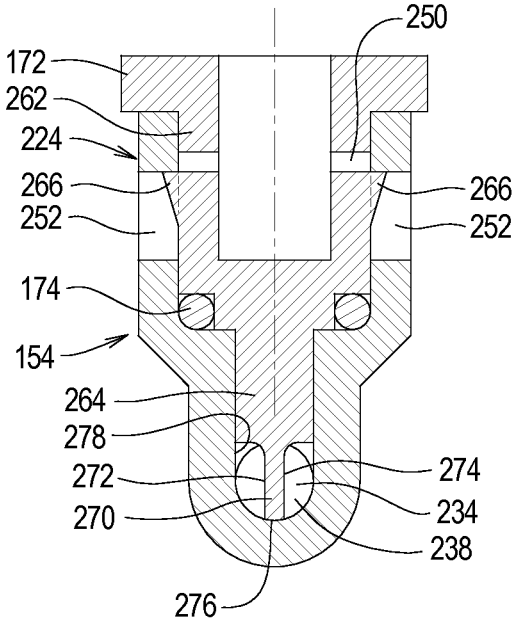
FIG. 13 is a section view taken along lines 13-13 in FIG. 12.

FIGS. 7, 9, and 13 illustrate that the socket portion 224 of the actuator member 154 defines a socket chamber 250 (FIGS. 7, 9, and 13), at least one socket window 252 (FIG. 13), and a support surface 254 (FIGS. 7 and 9). FIG. 4 illustrates that the guide portion 226 of the actuator member 154 defines at least one guide slot 256 and that the link portion 228 defines at least one link projection 258.

As perhaps best shown in FIG. 9, the example first adjustment member 172 comprises a handle portion 260, a plug portion 262, a valve portion 264, and at least one detent projection 266. Intersecting shoulder surfaces 268 are formed on the plug portion 262 adjacent to and surrounding the valve portion 264. A valve blade 270 extends from the valve portion 264. The example valve blade 270 defines first and second blade surfaces 272 and 274 and a perimeter surface 276. As will be described in further detail below, the actuator member 154 defines an actuator opening 278 that is in fluid communication with the socket chamber 250.

Referring now to FIGS. 3 and 5, it can be seen that the example grip housing 192 defines a grip wall 280 shaped to provide an ergonomic surface for grasping the dispensing system 120 during use. Extending around a bottom edge of the grip wall 280 is a latch projection 282 for detachably attaching the grip housing 192 to the container assembly as shown in FIGS. 3 and 5. FIGS. 3-5 illustrate that at least one guide rail 284 extends radially inwardly from the grip wall 280. The grip wall 280 defines a trigger slot 286. FIGS. 2 and 5 illustrate that at least one pivot opening 288 is formed in the grip wall 280.

FIGS. 3-5 illustrate that the trigger member 194 defines a trigger wall 290 and that at least one link flange 292 extends from the trigger wall 290. FIGS. 3-5 further illustrate that a link opening 294 is formed in each link flange 292. FIGS. 3-5 further illustrate that at least one pivot projection 296 extends outwardly from the trigger member 194.

The example dispensing system 120 is assembled as follows. The outlet member 156 and the first and second actuator members 172 and 182 are first assembled to the actuator member 154 to form the actuator assembly 138. The outlet member 156 is arranged between the fingers 242 such that a portion of the outlet member 156 extends over the mounting projection 244 and within the mounting recess 246. Friction is typically sufficient to hold the outlet member 156 in the position shown in FIG. 7, but adhesive may be used to ensure that the outlet member 156 is securely attached to the actuator member 154.

The second adjustment member 182 may then be attached to the actuator member 154 by engaging the threaded surface 184 on the second adjustment member 182 with the threaded surface 240 on the outlet portion 222 of the actuator member 154. At some point, continued rotation of the second adjustment member 182 relative to the actuator member 154 causes the adjustment member 182 to force the fingers 242 radially inwardly. When forced radially inwardly, the fingers 242 in turn act on the outlet member 156, pinching or deforming the outlet member 156 to reduce the cross-sectional area of the conduit outlet or outlet opening 146.

The first adjustment member 172 may then be attached to the actuator member 154. The seal member 174 is first placed into the socket chamber 250, and then first adjustment member 172 is displaced such that the valve portion 264 enters the socket chamber 250 and the detent projections 266 in their original positions contact the socket portion 224 of the actuator member 154. Continued displacement of the first adjustment member 172 into the socket chamber 250 causes the detent projections 266 to resiliently deform slightly towards each other into a deformed position such that the plug portion 262 enters the socket chamber 250. When the plug portion 262 is fully within the socket chamber 250, the shoulder surfaces 268 engage and compress the seal member 174 to seal the annular space between the plug portion 262 and the socket portion 224, and the detent projections 266 move outwardly to their original positions and into the socket windows 252. At this point, the valve blade 270 extends through the actuator opening 278 and into the actuator passageway 234.

When returned to their original positions relative to the plug portion 262, the detent projections 266 engage the socket portion 224 around the socket windows 252 to inhibit movement of the first adjustment member 172 out of the socket chamber 250 (and thus maintain the valve blade 270 within the second portion of the actuator passageway 234). However, the socket windows 252 are slightly oversized relative to the detent projections 266, so the first adjustment member 172 is capable of rotating within a limited range of movement relative to the socket portion 224 about a longitudinal axis defined by the socket chamber 250. If necessary, the first adjustment member 172 may be removed from the actuator member 154 by pushing the detent projections 266 through socket windows 252 such that the detent projections 266 no longer engage the socket portion 224.

The control assembly 190 is formed when the outlet member 156, first adjustment member 172, seal member 174, and second adjustment member 182 are secured to the actuator member 154 as described above. At this point, the control assembly 190 is attached to the grip assembly 158 to form the actuator assembly. In particular, the pivot projections 296 on the trigger member 194 are inserted into the pivot openings 288 of the grip housing 192 such that the trigger wall 290 extends or is accessible through the trigger slot 286. The trigger member 194 rotates relative to the grip housing 192 about a pivot axis A.

As is perhaps best shown in FIG. 4, the actuator assembly 138 is then formed by displacing the control assembly 190 into the space between the grip housing 192 and the trigger member 194 such that the link projections 258 extend into the link openings 294 in the link flanges 292 of the trigger member 194. Accordingly, as the trigger member 194 pivots relative to the grip housing 192, the link flanges 292 around the link openings 294 engage the link projections 258 to displace the control assembly 190 relative to the grip assembly 158. Because the link openings 294 are slightly elongated and angled with respect to a container axis $A_C$ defined by the container assembly 130, however, the control assembly 190 is capable of linear, in addition to (at this point) pivoting, movement relative to the grip assembly 158, as will be described in further detail below.

The actuator assembly 138 is then attached to the container assembly 130 by inserting the inlet portion 220 of the actuator member 154 through the valve seat 164 such that the inlet portion 220 engages the valve member 162 as shown in FIG. 3. At the same time, the latch projection 282 on the grip housing 192 snaps into place around a lip on the container assembly 130.

With the actuator assembly 138 attached to the container assembly 130, the grip housing 192 supports the trigger member 194 for pivoting movement relative to the container assembly 130, and the control assembly 190 is supported by the trigger member 194 and the valve seat 164 for linear movement relative to the container assembly 130. Squeezing the trigger member 194 relative to the grip member 192 towards the control assembly 190 results in movement of the control assembly 190 towards the container assembly 130 from a first position (e.g., FIG. 3) and into a second position (e.g., FIG. 5). When the control assembly 190 is in the first position, the valve system 160 is in its closed configuration. When the control assembly 190 is in the second position, the valve system 160 is in its open configuration. The valve spring 166 returns the valve member 162 towards the valve seat and thus forces the control assembly 190 from the second position and into the first position when the trigger member 194 is released.

The example second actuator member 182 operates to deform the outlet member 156 and alter a cross-sectional area of the conduit outlet or outlet opening 146 as generally described in U.S. Pat. Nos. 6,116,473 and 7,845,532, which are incorporated herein by reference, and thus will not be described or depicted herein in detail. The Applicant notes that other systems and methods for altering the cross-sectional area of a conduit outlet or outlet opening may be used in place of the resiliently deformable outlet member 156, second adjustment member 182, and fingers 242 described herein. U.S. Pat. No. 7,500,621, which is incorporated herein by reference, discloses a number of examples of systems and methods for adjusting the outlet opening of an aerosol system in the context of dispensing texture material.

Figure 8:
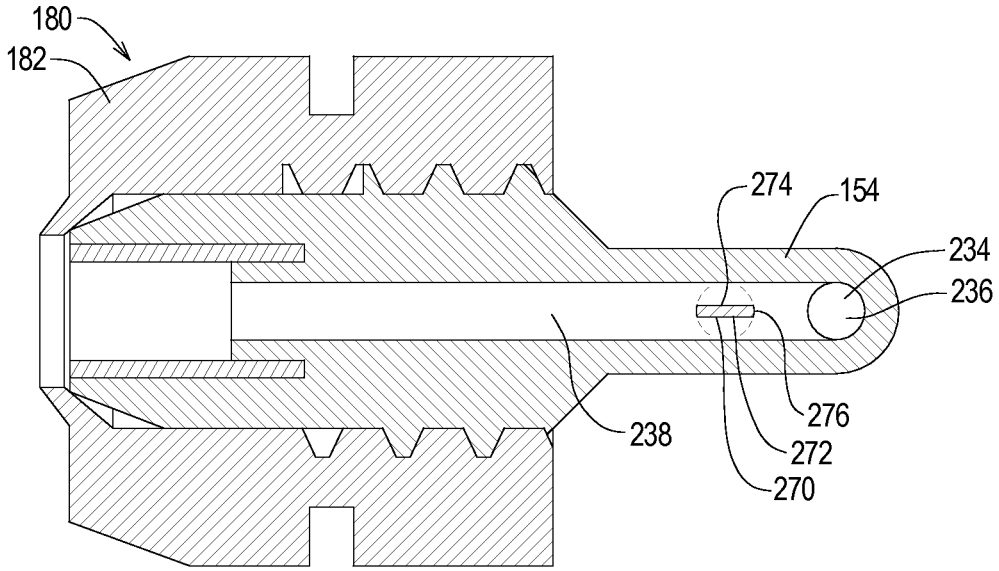
FIG. 8 is a section view taken along lines 8-8 in FIG. 7.
Figure 10:
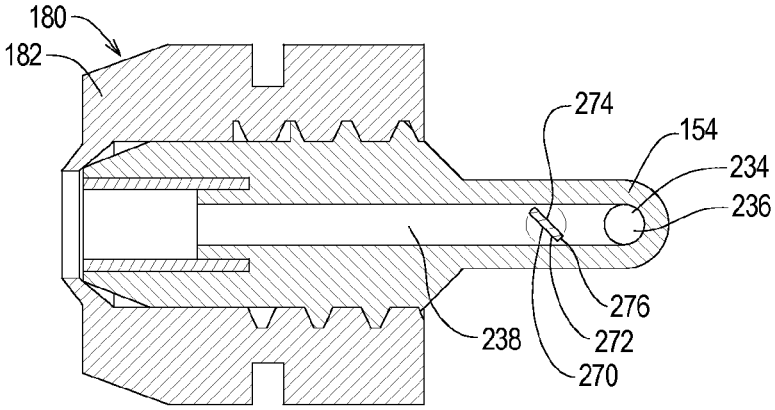
FIG. 10 is a section view taken along lines 10-10 in FIG. 9.
Figure 11:
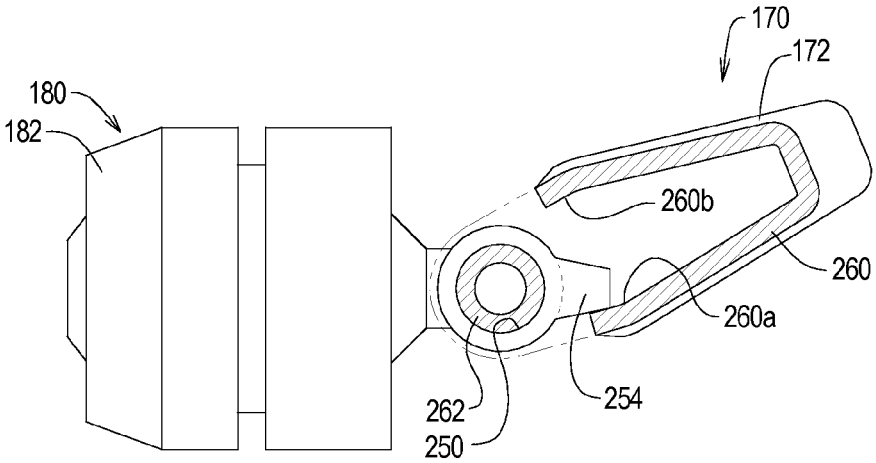
FIG. 11 is a top plan, partial section view taken along liens 11-11 in FIG. 7.
Figure 12:
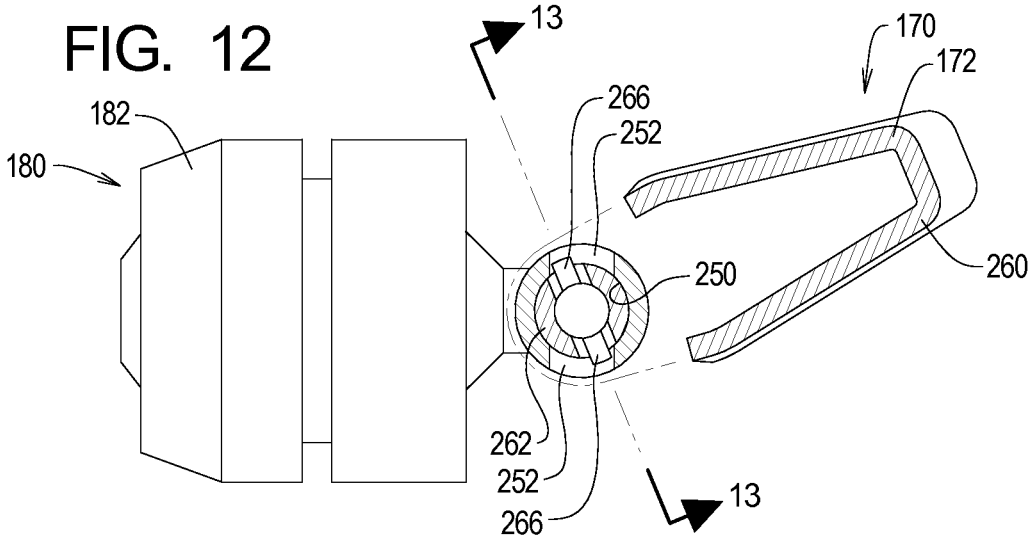
FIG. 12 is a top plan, partial section view taken along lines 12-12 in FIG. 7.

The operation of the first adjustment system 170 is perhaps best understood with reference to FIGS. 7-13 of the drawing. FIGS. 7, 8, and 13 illustrate the first adjustment system 170 in a maximum opening configuration, while FIGS. 9 and 10 illustrate the first adjustment system 170 in a minimum opening configuration. As shown, the valve blade 270 extends into the actuator passageway 234 such that the valve blade 270 restricts flow of fluid flowing through the actuator passageway 234, in this example embodiment the second portion 238 of the passageway 234. As will be described in further detail below, the amount of restriction depends on the angular position of the valve blade 270 with respect to an outlet axis $A_O$ defined by second portion 238 of the actuator passageway 234. The angular position of the valve blade 270 with respect to the outlet axis $A_O$ can be altered by displacing the handle portion 260 of the first adjustment member 172 relative to the actuator member 154.

In the example first adjustment system 170, a projection 224*a* extending from the socket portion 224 (FIG. 11) engages the interior surfaces of side walls 260*a* and 260*b* of the handle portion 260 to may determine the limits of rotation of the first adjustment member 172 relative to the actuator member 154. Optionally, the size and shape of the socket windows 252 in relation to the size and shape of the detent projections 266 may be used to may determine the limits of rotation of the first adjustment member 172 relative to the actuator member 154 to a predetermined adjustment range.

Additionally, FIG. 13 perhaps best shows that the perimeter edge 276 of the valve blade 270 is configured to follow the curvature of the actuator passageway second portion 238 where the adjustment opening 278 intersects this passageway second portion 238. Accordingly, the first adjustment member 172 is capable of being rotated such that the valve blade 270 rotates between a fully open position of FIGS. 7, 8, and 13 and a terminal (partly open) position in which the blade surfaces 272 and 274 are extend at approximately a 45 degree angle with respect to the outlet axis $A_O$. In practice, it is typically not required that the valve blade 270 be operable in the fully closed position given that the valve system 160 is more appropriately configured to prevent flow of fluid through the actuator passageway 234 in a fluid tight manner.

In one example implementation of the first flow adjustment system 170, the first adjustment system 170 is operable in a plurality or continuum of configurations ranging between a fully open configuration and a terminal configuration. The fully open configuration typically represents no restriction of the cross-sectional area of the conduit passageway 142 and may be numerically represented as 100% open (i.e., the cross-sectional area defined by the first adjustment system is substantially the same as the cross-sectional area of the conduit passageway upstream of the first adjustment system). The terminal configuration typically represents the greatest amount of restriction of the cross-sectional area of the conduit passageway 142 and may be numerically represented as a fraction of the cross-sectional area of the conduit passageway, such as 12% open (i.e., the cross-sectional area defined by the first adjustment system is approximately 12% of the cross-sectional area of the conduit passageway upstream of the first adjustment system).

In general, the predetermined adjustment range associated with the example first adjustment system 170 will be determined for a particular dispensing system 120. With respect to the first example adjustment system 180, the system variable controlled by this first adjustment system 170 may be referred to as percentage closure of the cross-sectional area of the actuator passageway 234. Relative to the cross-sectional area of the unobstructed actuator passageway second portion 238, the fully open position of the valve blade 270 will be block, for example, a percentage of this cross-sectional area. The predetermined adjustment range allowed by the first adjustment member allows the valve blade 270 to rotate from the fully open position (FIGS. 7, 8, 13) to a terminal position (e.g., FIGS. 9 and 10) in which, for example, another percentage of the cross-sectional area the unobstructed actuator passageway second portion 238 is blocked.

The following Table B represents example ranges and dimensions for constructing a physical embodiment of a flow adjustment system that may be used as the example first flow adjustment system 170:

TABLE B

| Config. | Units | Example | First Range | Second Range |
|---|---|---|---|---|
| Fully Open | % Passageway | 100 | 95-100 | 90-100 |
| | Square Inches | .00385 | 0.00424-0.00347 | 0.00578-0.00193 |
| Terminal | % Passageway | 12 | 8-16 | 5-20 |
| | Square Inches | .00045 | 0.00050-0.00041 | 0.00068-0.00023 |

In this context, the actual cross-sectional area of the unobstructed passageway second portion 238 will be determined by such factors as the characteristics of the stored material 134 (e.g., composition, viscosity) and of the propellant material (e.g., composition, percentage by weight used), and the nature and physical shapes of the desired texture patterns to be obtained using the dispensing system 120.

III. Third Example Aerosol Dispensing System

Referring now to FIGS. 14-18 of the drawing, depicted at 320 therein is a third example aerosol dispensing system constructed in accordance with, and embodying, the principles of the present invention. Like the first example aerosol dispensing system 20, the third example dispensing system is adapted to spray droplets of dispensed material 322 onto a target surface (not shown). In the example use of the dispensing system 320 depicted in FIG. 14, the dispensed material 322 is or contains texture material, and the dispensing system 320 is being used to form a coating on an untextured portion of the target surface having a desired texture pattern that substantially matches a pre-existing texture pattern of a textured portion of the target surface.

Figure 14:
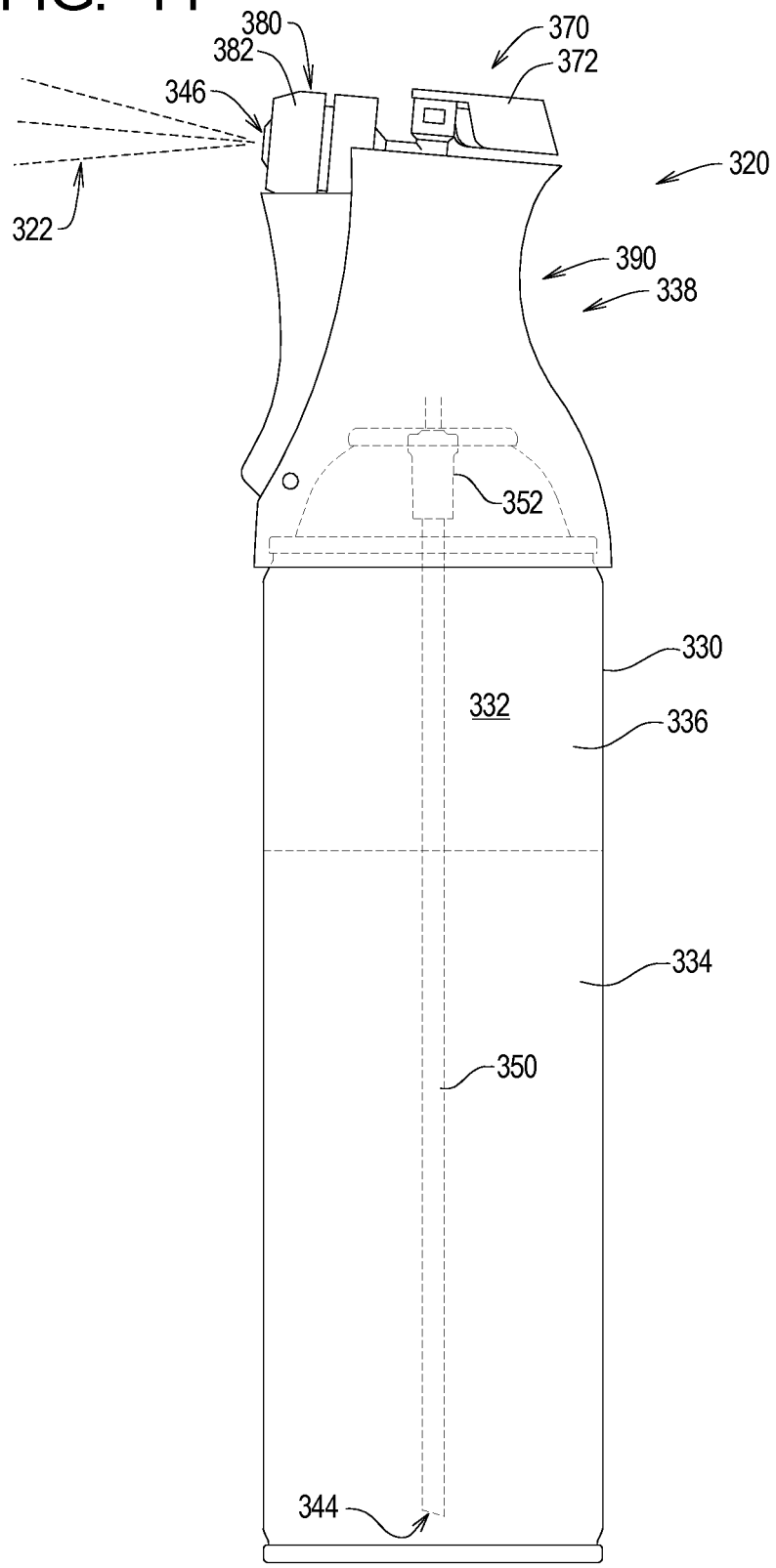
FIG. 14 is a side elevation view of a third example aerosol texturing system of the present invention.

FIG. 14 further illustrates that the example dispensing system 320 comprises a container 330 defining a chamber 332 in which stored material 334 and pressurized material 336 are contained. Like the stored material 34 described above, the stored material 334 is a mixture of texture material and propellant material in liquid phase, while the pressurized material is propellant material in gas phase. An actuator assembly 338 is mounted on the container assembly 330 to facilitate the dispensing of the dispensed material 322 as will be described in further detail below.

Figure 15:
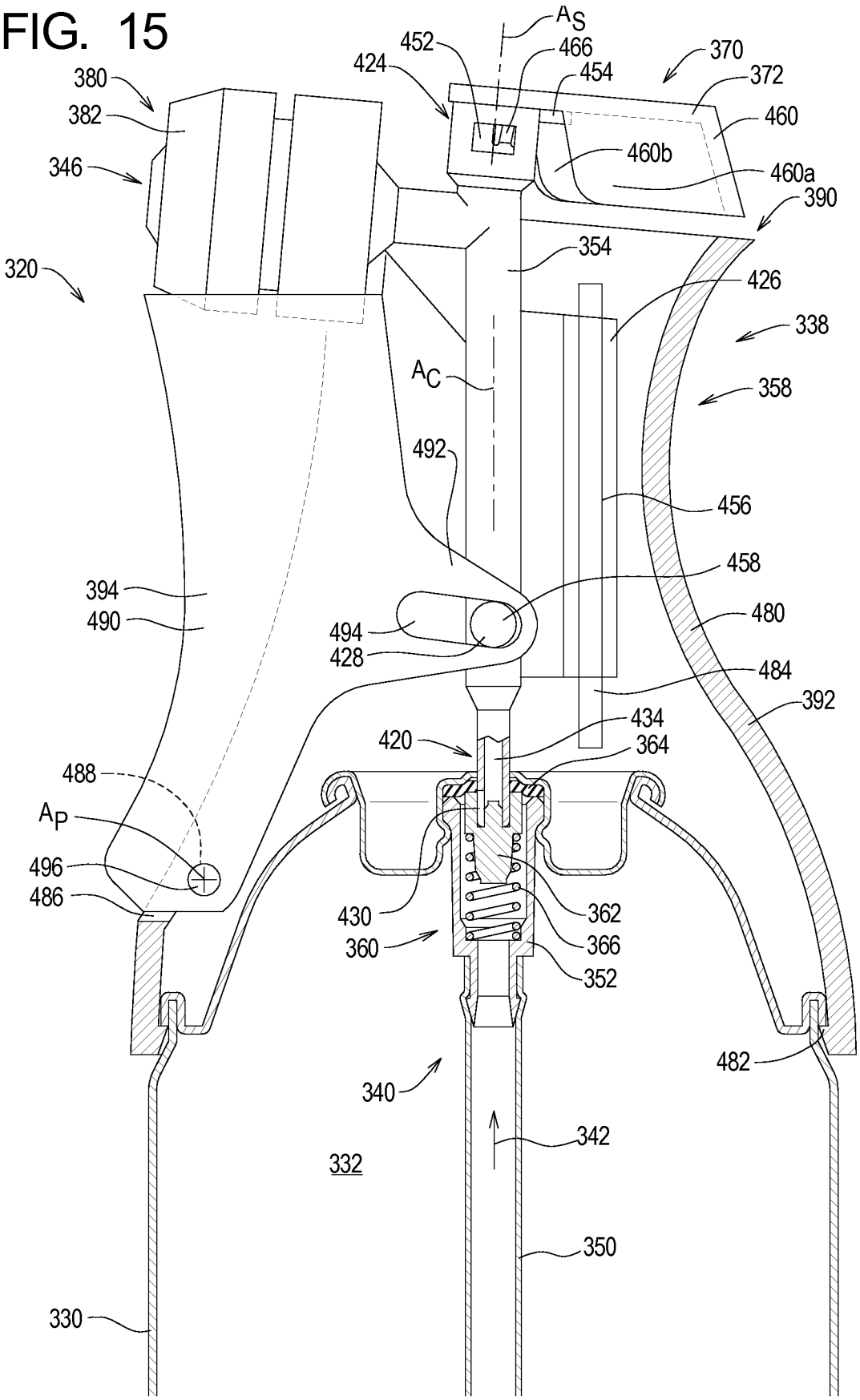
FIG. 15 is a side elevation, partial section view of the third example aerosol texturing system in a closed configuration.
Figure 16:
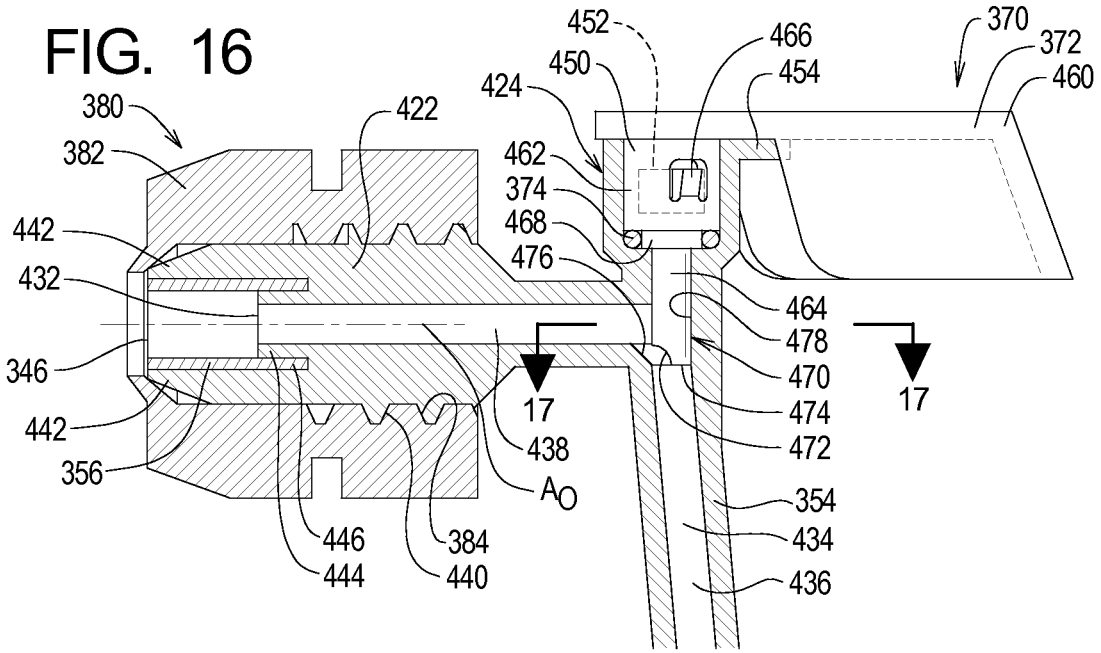
FIG. 16 is a side elevation, partial section view of an actuator member and first and second adjustment members of the third example aerosol texturing system, with the first adjustment member in a fully open position.

FIG. 15 illustrates that the third example aerosol dispensing system 320 comprises a conduit 340 defining a conduit passageway 342. The conduit 340 is supported by the container 330 such that the conduit passageway 342 defines a conduit inlet 344 (FIG. 14) arranged within the chamber 332 and a conduit outlet or outlet opening 346 arranged outside of the chamber 332. The example conduit 340 is formed by an inlet tube 350 (FIGS. 14 and 15), a valve housing 352 (FIGS. 14 and 15), an actuator member 354 (FIGS. 14-18), and an outlet member 356 (FIGS. 16 and 18). The conduit passageway 342 extends through the inlet tube 350, the valve housing 352, the actuator member 354, and the outlet member 356. The valve housing 352 is arranged between the conduit inlet 344 and the actuator member 354, and the actuator member 354 is arranged between the valve housing 352 and the conduit outlet 346. The outlet member 356 is supported by the actuator member 354 to define the conduit outlet 346.

As shown in FIG. 15, arranged within the valve housing 352 is a valve assembly 360. The example valve assembly 360 comprises a valve member 362, a valve seat 364, and a valve spring 366. The valve assembly 360 operates in a closed configuration and an open configuration. In the closed configuration, the valve spring 366 forces the valve member 362 against the valve seat 364 such that the valve assembly 360 substantially prevents flow of fluid along the conduit passageway 342. In the open configuration, the valve member 362 is displaced away from the valve seat 364 against the force of the valve spring 366 such that the valve assembly 360 allows flow of fluid along the conduit passageway 342 between the valve member 362 and the valve seat 364. Because the valve spring 366 biases the valve member 362 towards the valve seat 364, the example valve assembly 360 is normally closed. As will be described in further detail below, the valve assembly 360 engages the actuator member structure 354 such that the application of deliberate manual force on the actuator member 354 towards the container 330 moves the valve member 362 away from the valve seat 364 and thus places the valve system 360 in the open configuration.

A first flow adjustment system 370 having a first adjustment member 372 and a seal member 374 is arranged at an intermediate location along the conduit passageway 342 between the valve assembly 360 and the conduit outlet 346. In particular, rotation of the first adjustment member 372 relative to the actuator member 354 alters a cross-sectional area of the conduit passageway 342 between the valve system 360 and the second flow adjustment system 380.

A second flow adjustment system 380 having a second adjustment member 382 is arranged in the conduit passageway 342 to form at least a portion of the conduit outlet or outlet opening 346. In particular, the second adjustment member 382 defines a threaded surface 384 that engages the actuator member 354 such that rotation of the second adjustment member 382 relative to the actuator member 354 deforms the outlet member 356 and thereby alters a cross-sectional area of the conduit outlet or outlet opening 346.

The first flow adjustment system 370 is supported by the actuator member 354 between the valve assembly 360 and the second adjustment system 380 such that manual operation of the first adjustment member 372 affects the flow of fluid material along the conduit passageway 342. In particular, the second adjustment system 380 functions as a flow restrictor, where operation of the first adjustment member 372 variably reduces the size of the conduit passageway 342 such that a pressure of the fluid material upstream of the first flow adjustment system 370 is relatively higher than the pressure of the fluid material downstream of the first flow adjustment system 370.

The second adjustment system 380 is supported by the actuator member 354 downstream of the second adjustment system 380. The outlet member 356 is a resiliently deformable tube, and manual operation of the second adjustment member 382 deforms the walls of the outlet member 356 and thereby affects the flow of fluid material flowing out of the conduit passageway 342 through the conduit outlet or outlet opening 346. The second adjustment system 380 thus functions as a variable orifice. Operation of the second adjustment member 382 variably reduces the size of the conduit outlet or outlet opening 346 relative to the size of the conduit passageway 342 upstream of the second adjustment system 380.

The outlet member 356, first adjustment member 372, seal member 374, and second adjustment member 382 are supported by the actuator member 354 to define a control assembly 390. FIG. 15 further shows that the grip assembly 358 comprises a grip housing 392 and a trigger member 394. Additionally, the grip assembly 358 is combined with the control assembly 390 to form the actuator assembly 338, and the actuator assembly 338 is supported by the container assembly 330 as generally described above.

To operate the third example aerosol dispensing system 320, the container 330 and grip housing 392 are grasped such that the user's fingers can squeeze the trigger member 394, thereby depressing the actuator member 354. The conduit outlet or outlet opening 346 is initially aimed at a test surface and the actuator member 354 is depressed to place the valve assembly 360 in the open configuration such that the pressurized material 336 forces some of the stored material 334 out of the container 330 and onto the test surface to form a test texture pattern. The test texture pattern is compared to the pre-existing texture pattern defined by the textured portion of the target surface. If the test texture pattern does not match the pre-existing texture pattern, one or both of the first and second adjustment members is/are adjusted to alter the spray pattern of the droplets of dispensed material 322.

The process of spraying a test pattern and adjusting the first and second adjustment members 372 and 382 is repeated until the test pattern formed by the dispensed material 322 corresponds to a desired texture pattern that substantially matches the pre-existing texture pattern.

Leaving the first and second adjustment members 372 and 382 as they were when the test texture pattern corresponded to the desired texture pattern, the aerosol dispensing system 320 is then arranged such that the conduit outlet or outlet opening 346 is aimed at the un-textured portion of the target surface. The trigger member 394 is again squeezed to place the valve assembly 360 in the open configuration such that the pressurized material 336 forces the stored material 334 out of the container 330 and onto the un-textured portion of the target surface to form the desired texture pattern on the un-textured portion of the target surface, perhaps overlapping slightly with the textured portion of the target surface. Since the desired texture pattern substantially matches the pre-existing texture pattern, the dispensed material forms a coating on the previously un-textured portion of the target surface that substantially matches a physical appearance of the textured portion. One or more layers of primer and/or paint may next be applied over the cured layer of dispensed material on the target surface.

With the foregoing general understanding of the operation of the first example aerosol dispensing system 320 in mind, the details of construction and operation of this example aerosol dispensing system 320 will now be described in further detail.

Referring now to FIGS. 15-18, the example actuator member 354 of the third example aerosol dispensing system 320 will now be described in further detail. The example actuator member 354 comprises an inlet portion 420 (FIG. 15), an outlet portion 422 (FIGS. 16 and 18), a socket portion 424 (FIGS. 15, 16, and 18), a guide portion 426 (FIG. 15), and a link portion 428 (FIG. 15). The actuator member 354 further defines an actuator inlet 430 (FIG. 15), an actuator outlet 432 (FIGS. 16 and 18), and an actuator passageway 434 having a first portion 436 and a second portion 438 (FIGS. 16 and 18). As perhaps best shown in FIGS. 16 and 18, the outlet portion 422 of the actuator member 354 defines a threaded external surface 440, two or more fingers 442, a mounting projection 444 through which the actuator outlet 432 extends, and a mounting recess 446 formed around at least a portion of the mounting projection 444.

FIGS. 16 and 18 illustrate that the socket portion 424 of the actuator member 354 defines a socket chamber 450, at least one socket window 452 (FIGS. 15, 16, and 18), and a support surface 454 (FIGS. 15, 16, and 18). As shown in FIG. 15, the guide portion 426 of the actuator member 354 defines at least one guide slot 456, and the link portion 428 defines at least one link projection 458.

As perhaps best shown in FIGS. 15, 16, and 18, the example first adjustment member 372 comprises a handle portion 460, a plug portion 462, a valve portion 464, and at least one detent projection 466. Intersecting shoulder surfaces 468 are formed on the plug portion 462 adjacent to and surrounding the valve portion 464. A valve blade 470 extends from the valve portion 464. The example valve blade 470 defines a valve surface 472 and a bottom surface 474. A transition surface 476 is formed on the actuator member 354 at the juncture of the first and second portions 436 and 438 of the actuator passageway 434.

Referring now to FIG. 15, it can be seen that the example grip housing 392 defines a grip wall 480 shaped to provide an ergonomic surface for grasping the dispensing system 320 during use. Extending around a bottom edge of the grip wall 480 is a latch projection 482 for detachably attaching the grip housing 392 to the container assembly as will be discussed further below. FIG. 15 illustrates that at least one guide rail 484 extends radially inwardly from the grip wall 480. The grip wall 480 defines a trigger slot 486. At least one pivot opening 488 is formed in the grip wall 480.

FIG. 15 illustrates that the trigger member 394 defines a trigger wall 490 and that at least one link flange 492 extends from the trigger wall 490. A link opening 494 is formed in each link flange 492. FIG. 15 further illustrates that at least one pivot projection 496 extends outwardly from the trigger member 394.

The example dispensing system 320 is assembled as follows. The outlet member 356 and the first and second actuator members 372 and 382 are first assembled to the actuator member 354 to form the actuator assembly 338. The outlet member 356 is arranged between the fingers 442 such that a portion of the outlet member 356 extends over the mounting projection 444 and within the mounting recess 446. Friction is typically sufficient to hold the outlet member 356 in the position shown in FIGS. 16 and 18, but adhesive may optionally be used to adhere the outlet member 356 to the actuator member 354.

The second adjustment member 382 may then be attached to the actuator member 354 by engaging the threaded surface 384 on the second adjustment member 382 with the threaded surface 440 on the outlet portion 422 of the actuator member 354. At some point, continued rotation of the second adjustment member 382 relative to the actuator member 354 causes the adjustment member 382 to force the fingers 442 radially inwardly. When forced radially inwardly, the fingers 442 in turn act on the outlet member 356, pinching or deforming the outlet member 356 to reduce the cross-sectional area of the conduit outlet or outlet opening 346.

The first adjustment member 372 may then be attached to the actuator member 354. The seal member 374 is first placed into the socket chamber 450, and then first adjustment member 372 is displaced such that the valve portion 464 enters the socket chamber 450 and the detent projections 466 in their original positions contact the socket portion 424 of the actuator member 354. Continued displacement of the first adjustment member 372 into the socket chamber 450 causes the detent projections 466 to resiliently deform slightly towards each other into a deformed position such that the plug portion 462 enters the socket chamber 450. When the plug portion 462 is fully within the socket chamber 450, the shoulder surfaces 468 engage and compress the seal member 374 to seal the annular space between the plug portion 462 and the socket portion 424, and the detent projections 466 move outwardly to their original positions and into the socket windows 452. At this point, the valve blade 470 extends through the adjustment opening 478 and into the actuator passageway 434.

When returned to their original positions relative to the plug portion 462, the detent projections 466 engage the socket portion 424 around the socket windows 452 to inhibit movement of the first adjustment member 372 out of the socket chamber 450 (and thus maintain the valve blade 470 within the second portion of the actuator passageway 434). However, the socket windows 452 are slightly oversized relative to the detent projections 466. As shown by a comparison of FIGS. 16 and 18, the first adjustment member 372 is capable of rotating within a limited range of movement relative to the socket portion 424 about a socket axis $A_S$ defined by the socket chamber 450. If necessary, the first adjustment member 372 may be removed from the actuator member 354 by pushing the detent projections 466 through socket windows 452 such that the detent projections 466 no longer engage the socket portion 424.

The control assembly 390 is formed when the outlet member 356, first adjustment member 372, seal member 374, and second adjustment member 382 are secured to the actuator member 354 as described above. At this point, the control assembly 390 is attached to the grip assembly 358 to form the actuator assembly. In particular, the pivot projections 496 on the trigger member 394 are inserted into the pivot openings 488 of the grip housing 392 such that the trigger wall 490 extends or is accessible through the trigger slot 486. The trigger member 394 rotates relative to the grip housing 392 about a pivot axis A.

As is perhaps best shown in FIG. 15, the actuator assembly 338 is then formed by displacing the control assembly 390 into the space between the grip housing 392 and the trigger member 394 such that the link projections 458 extend into the link openings 494 in the link flanges 492 of the trigger member 394. Accordingly, as the trigger member 394 pivots relative to the grip housing 392, the link flanges 492 around the link openings 494 engage the link projections 458 to displace the control assembly 390 relative to the grip assembly 358. Because the link openings 494 are slightly elongated and angled with respect to a container axis $A_C$ defined by the container assembly 330, however, the control assembly 390 is capable of linear, in addition to (at this point) pivoting, movement relative to the grip assembly 358, as will be described in further detail below.

The actuator assembly 338 is then attached to the container assembly 330 by inserting the inlet portion 420 of the actuator member 354 through the valve seat 364 such that the inlet portion 420 engages the valve member 362 as shown in FIG. 15. At the same time, the latch projection 482 on the grip housing 392 snaps into place around a lip on the container assembly 330.

With the actuator assembly 338 attached to the container assembly 330, the grip housing 392 supports the trigger member 394 for pivoting movement relative to the container assembly 330, and the control assembly 390 is supported by the trigger member 394 and the valve seat 364 for linear movement relative to the container assembly 330. Squeezing the trigger member 394 relative to the grip member 392 towards the control assembly 390 results in movement of the control assembly 390 towards the container assembly 330 from a first position and into a second position. When the control assembly 390 is in the first position, the valve system 360 is in its closed configuration. When the control assembly 390 is in the second position, the valve system 360 is in its open configuration. The valve spring 366 returns the valve member 362 towards the valve seat and thus forces the control assembly 390 from the second position and into the first position when the trigger member 392 is released.

The example second actuator member 382 operates to deform the outlet member 356 and alter a cross-sectional area of the conduit outlet or outlet opening 346 as generally described in U.S. Pat. Nos. 6,116,473 and 7,845,532, which are incorporated herein by reference, and thus will not be described or depicted herein in detail. The Applicant notes that other systems and methods for altering the cross-sectional area of a conduit outlet or outlet opening may be used in place of the resiliently deformable outlet member 356, second adjustment member 382, and fingers 442 described herein. U.S. Pat. No. 7,500,621, which is incorporated herein by reference, discloses a number of examples of systems and methods for adjusting the outlet opening of an aerosol system in the context of dispensing texture material.

Figure 17:
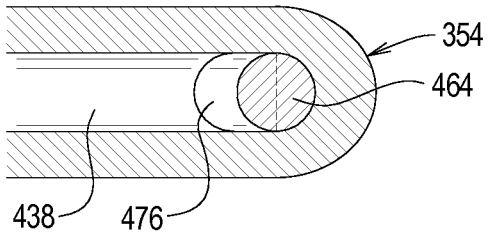
FIG. 17 is a section view taken along lines 17-17 in FIG. 16.
Figure 18:
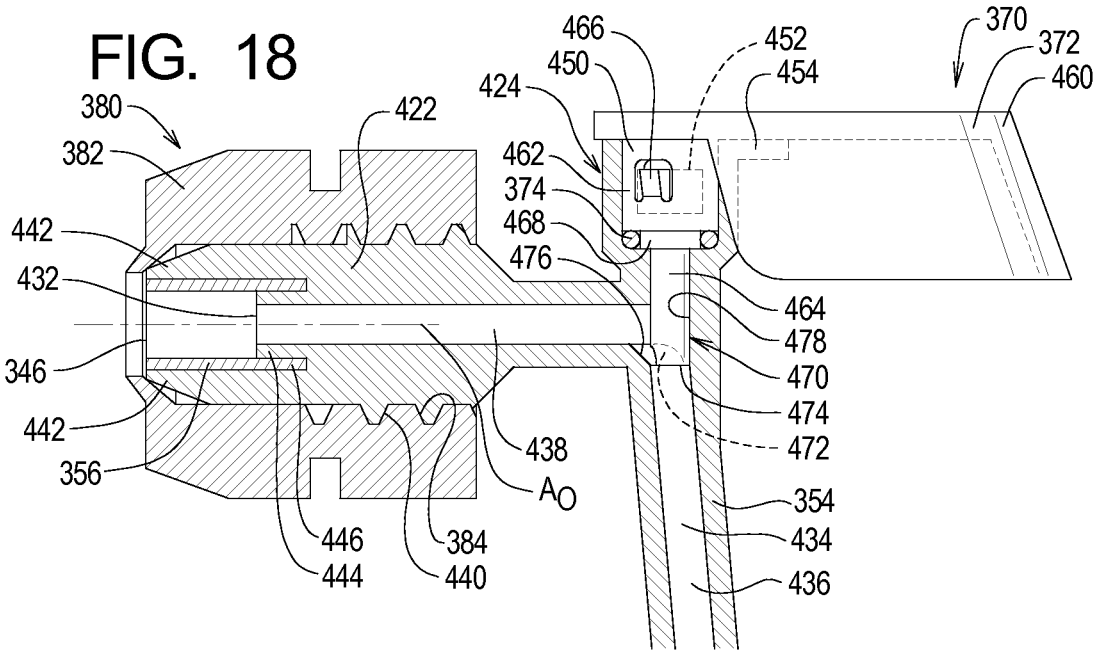
FIG. 18 is a side elevation, partial section view of an actuator member and first and second adjustment members of the third example aerosol texturing system, with the first adjustment member in a partially open position.

The operation of the first adjustment system 370 is perhaps best understood with reference to FIGS. 16-18 of the drawing. FIGS. 16 and 17 illustrate the first adjustment system 370 in a maximum opening configuration, while FIG. 18 illustrates the first adjustment system 370 in a minimum opening configuration. As shown, the valve blade 470 extends into the second portion 438 of the actuator passageway 434 such that the valve blade 470 restricts flow of fluid flowing through the actuator passageway second portion 438. As will be described in further detail below, the amount of restriction depends on the angular position of the valve blade 470 with respect to at least one of the transition surface 476 and an outlet axis $A_O$ defined by the actuator passageway second portion 438. The angular position of the valve blade 470 can be altered by displacing the handle portion 460 of the first adjustment member 372 relative to the actuator member 354.

In the example first adjustment system 370, a projection 424*a* extending from the socket portion 424 (FIGS. 15, 16, and 18) engages the interior surfaces of side walls 260*a* and 260*b* of the handle portion 260 to may determine the limits of rotation of the first adjustment member 172 relative to the actuator member 154. Optionally, the size and shape of the socket windows 452 in relation to the size and shape of the detent projections 466 may determine the limits of rotation of the first adjustment member 372 relative to the actuator member 354 to a predetermined adjustment range.

Additionally, FIGS. 16 and 18 perhaps best show that the bottom surface 474 of the valve blade 470 is configured generally to conform to a contour or shape of the actuator passageway 434 where the adjustment opening 478 intersects this passageway 434. Accordingly, the first adjustment member 372 is capable of being rotated such that the valve blade 470 rotates between a fully open position (FIG. 16) and a terminal (partly closed) position (FIG. 18) in which a cross-sectional area of the actuator passageway 434 adjacent to the transition surface is minimized, but not necessarily fully blocked. In practice, the valve blade 470 need not be operable in the fully closed position given that the valve system 360 is more appropriately configured to prevent flow of fluid through the actuator passageway 434 in a fluid tight manner.

In general, the predetermined adjustment range associated with the example first adjustment system 370 and the shape of the valve surface 472 will be determined for a particular dispensing system 320. The example valve surface 472 is a curved surface that cooperates with the transition surface 476 to define the minimum cross-sectional dimensions of the actuator passageway 434.

In general, the predetermined adjustment range associated with the example first adjustment system 370 will be determined for a particular dispensing system 320. With respect to the first example adjustment system 380, the system variable controlled by this first adjustment system 370 may be referred to as percentage closure of the cross-sectional area of the actuator passageway 434. Relative to the cross-sectional area of the unobstructed actuator passageway second portion 438, the fully open position of the valve blade 470 will be block a first percentage of this cross-sectional area. The predetermined adjustment range allowed by the first adjustment member allows the valve blade 470 to rotate from the fully open position to a terminal position in which, for example, a second percentage of the cross-sectional area the unobstructed actuator passageway second portion 438 is blocked.

The following Table C represents example ranges and dimensions for constructing a physical embodiment of a flow adjustment system that may be used as the example first flow adjustment system 370:

TABLE C

| Config. | Units | Example | First Range | Second Range |
|---|---|---|---|---|
| Fully Open | % Passageway | 75 | 70-80 | 60-95 |
| | Square Inches | 0.00385 | 0.00424-0.00347 | 0.00578-0.00193 |
| Terminal | % Passageway | 12 | 8-16 | 5-20 |
| | Square Inches | 0.00045 | 0.00050-0.00041 | 0.00068-0.00023 |

In this context, the actual cross-sectional area of the unobstructed passageway second portion 438 will be determined by such factors as the characteristics of the stored material 334 (e.g., composition, viscosity) and of the propellant material (e.g., composition, percentage by weight used), and the nature and physical shapes of the desired texture patterns to be obtained using the dispensing system 320.

IV. Fourth Example Aerosol Dispensing System

Referring now to FIGS. 19-25 of the drawing, depicted at 520 therein is a fourth example aerosol dispensing system constructed in accordance with, and embodying, the principles of the present invention. Like the first example aerosol dispensing system 20, the fourth example dispensing system is adapted to spray droplets of dispensed material 522 onto a target surface (not shown). In the example use of the dispensing system 520 depicted in FIG. 19, the dispensed material 522 is or contains texture material, and the dispensing system 520 is being used to form a coating on an untextured portion of the target surface having a desired texture pattern that substantially matches a pre-existing texture pattern of a textured portion of the target surface.

Figure 19:
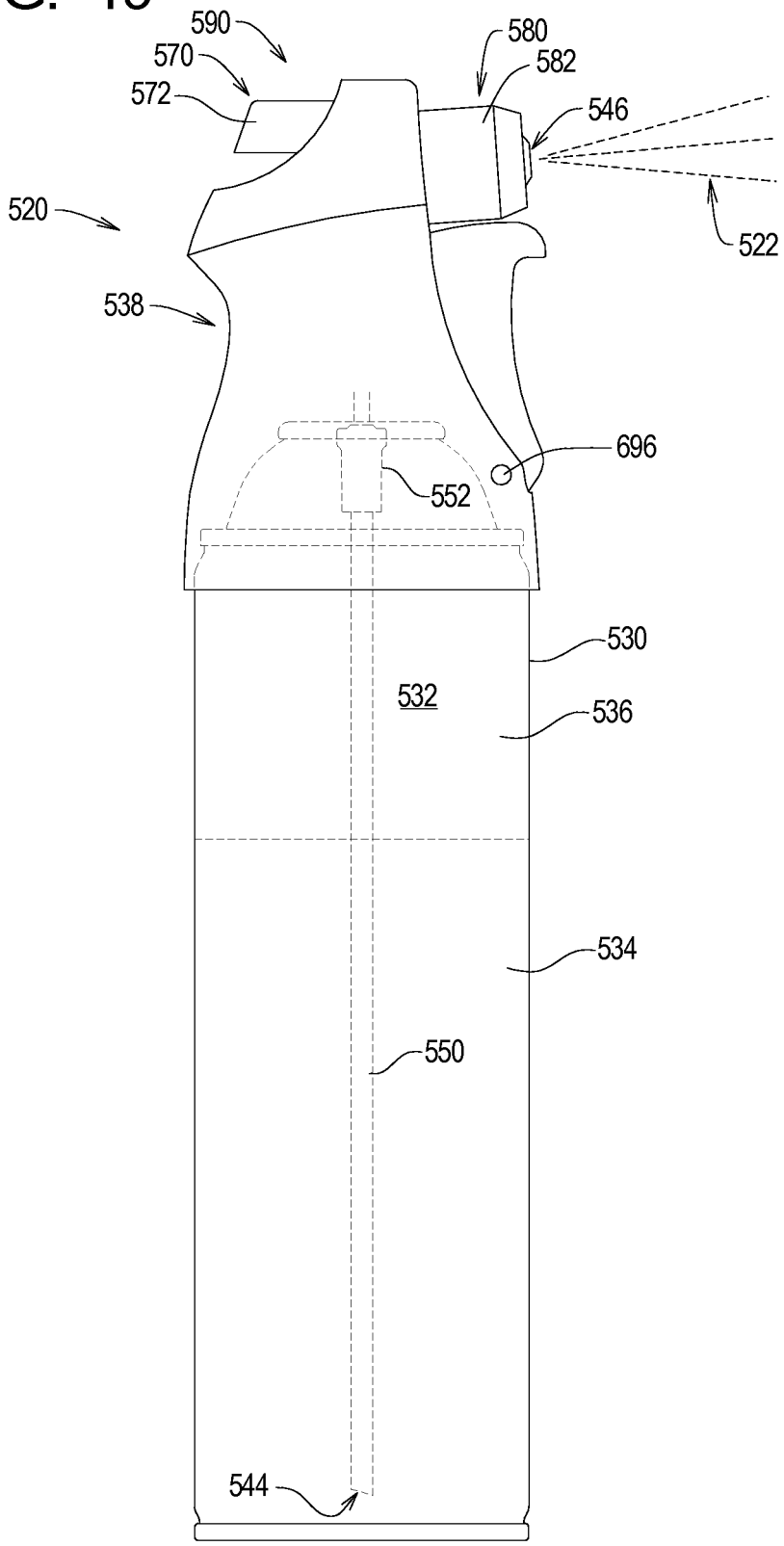
FIG. 19 is a side elevation view of a fourth example aerosol texturing system of the present invention.

FIG. 19 further illustrates that the example dispensing system 520 comprises a container 530 defining a chamber 532 in which stored material 534 and pressurized material 536 are contained. Like the stored material 34 described above, the stored material 534 is a mixture of texture material and propellant material in liquid phase, while the pressurized material is propellant material in gas phase. An actuator assembly 538 is mounted on the container assembly 530 to facilitate the dispensing of the dispensed material 522 as will be described in further detail below.

Figure 20:
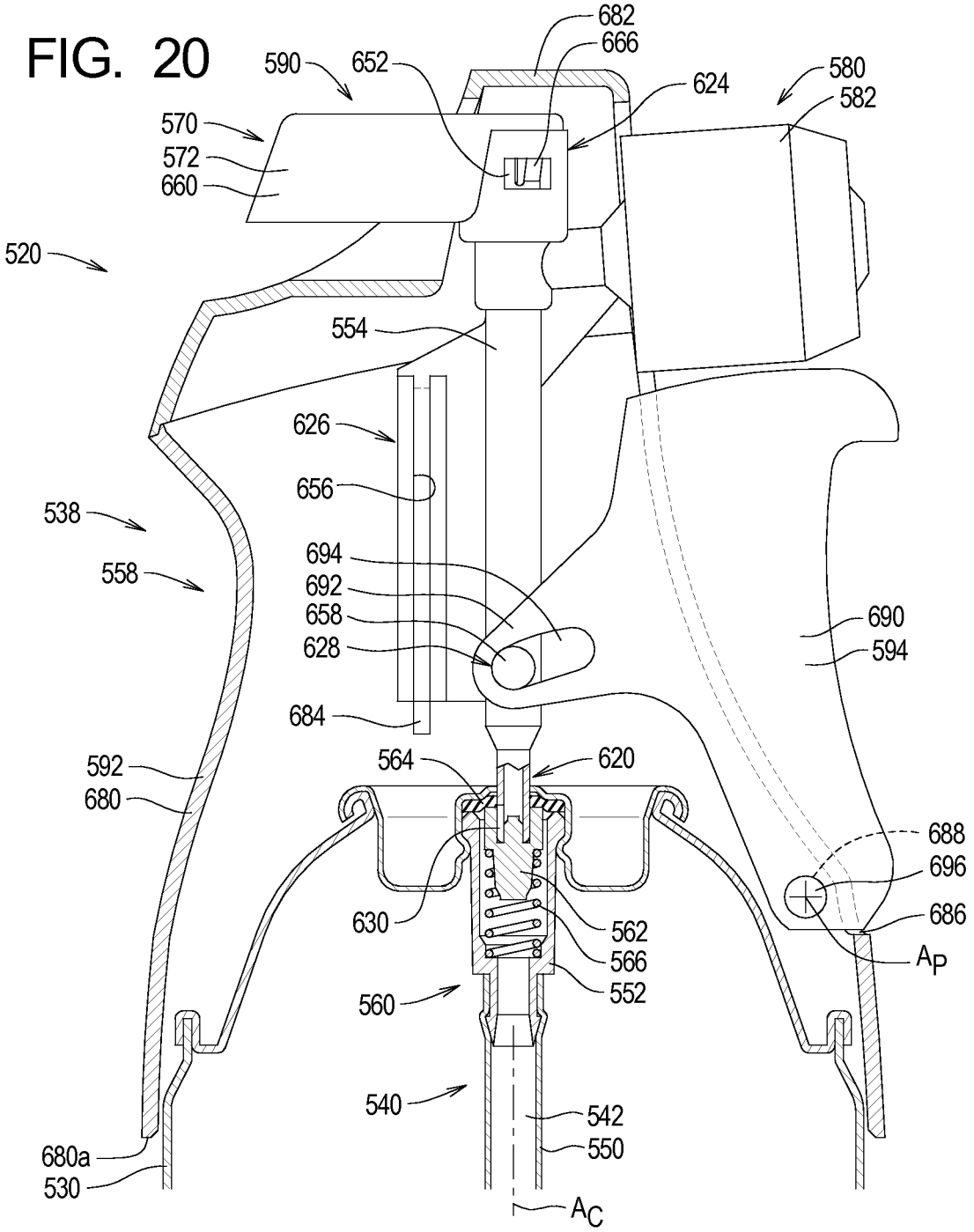
FIG. 20 is a side elevation, partial section view of the fourth example aerosol texturing system in a closed configuration.
Figure 21:
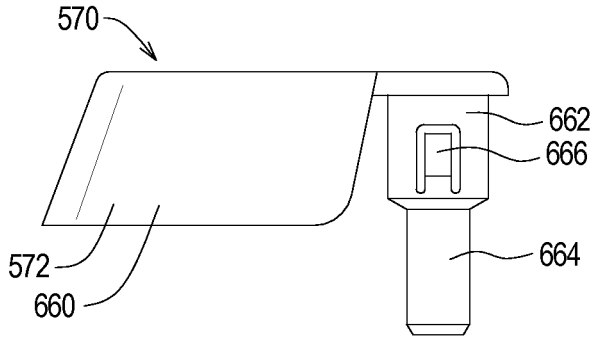
FIG. 21 is a side elevation view of an example first adjustment member of the fourth example aerosol texturing system.

FIG. 20 illustrates that the fourth example aerosol dispensing system 520 comprises a conduit 540 defining a conduit passageway 542. The conduit 540 is supported by the container 530 such that the conduit passageway 542 defines a conduit inlet 544 (FIG. 19) arranged within the chamber 532 and a conduit outlet or outlet opening 546 arranged outside of the chamber 532. The example conduit 540 is formed by an inlet tube 550 (FIGS. 19 and 20), a valve housing 552 (FIGS. 19 and 20), an actuator member 554 (FIGS. 20, 22-25), and an outlet member 556 (FIGS. 22-25). The conduit passageway 542 extends through the inlet tube 550, the valve housing 552, the actuator member 554, and the outlet member 556. The valve housing 552 is arranged between the conduit inlet 544 and the actuator member 554, and the actuator member 554 is arranged between the valve housing 552 and the conduit outlet 546. The outlet member 556 is supported by the actuator member 554 to define the conduit outlet 546.

As shown in FIG. 20, arranged within the valve housing 552 is a valve assembly 560. The example valve assembly 560 comprises a valve member 562, a valve seat 564, and a valve spring 566. The valve assembly 560 operates in a closed configuration and an open configuration. In the closed configuration, the valve spring 566 forces the valve member 562 against the valve seat 564 such that the valve assembly 560 substantially prevents flow of fluid along the conduit passageway 542. In the open configuration, the valve member 562 is displaced away from the valve seat 564 against the force of the valve spring 566 such that the valve assembly 560 allows flow of fluid along the conduit passageway 542 between the valve member 562 and the valve seat 564. Because the valve spring 566 biases the valve member 562 towards the valve seat 564, the example valve assembly 560 is normally closed. As will be described in further detail below, the valve assembly 560 engages the actuator member structure 554 such that the application of deliberate manual force on the actuator member 554 towards the container 530 moves the valve member 562 away from the valve seat 564 and thus places the valve system 560 in the open configuration.

A first flow adjustment system 570 having a first adjustment member 572 and a seal member 574 is arranged at an intermediate location along the conduit passageway 542 between the valve assembly 560 and the conduit outlet 546. In particular, rotation of the first adjustment member 572 relative to the actuator member 554 alters a cross-sectional area of the conduit passageway 542 between the valve system 560 and the second flow adjustment system 580.

A second flow adjustment system 580 having a second adjustment member 582 is arranged in the conduit passageway 542 to form at least a portion of the conduit outlet or outlet opening 546. In particular, the second adjustment member 582 defines a threaded surface 584 that engages the actuator member 554 such that rotation of the second adjustment member 582 relative to the actuator member 554 deforms the outlet member 556 and thereby alters a cross-sectional area of the conduit outlet or outlet opening 546.

The first flow adjustment system 570 is supported by the actuator member 554 between the valve assembly 560 and the second adjustment system 580 such that manual operation of the first adjustment member 572 affects the flow of fluid material along the conduit passageway 542. In particular, the second adjustment system 580 functions as a flow restrictor, where operation of the first adjustment member 572 variably reduces the size of the conduit passageway 542 such that a pressure of the fluid material upstream of the first flow adjustment system 570 is relatively higher than the pressure of the fluid material downstream of the first flow adjustment system 570.

The second adjustment system 580 is supported by the actuator member 554 downstream of the second adjustment system 580. The outlet member 556 is a resiliently deformable tube, and manual operation of the second adjustment member 582 deforms the walls of the outlet member 556 and thereby affects the flow of fluid material flowing out of the conduit passageway 542 through the conduit outlet or outlet opening 546. The second adjustment system 580 thus functions as a variable orifice. Operation of the second adjustment member 582 variably reduces the size of the conduit outlet or outlet opening 546 relative to the size of the conduit passageway 542 upstream of the second adjustment system 580.

The outlet member 556, first adjustment member 572, seal member 574, and second adjustment member 582 are supported by the actuator member 554 to define a control assembly 590. FIG. 20 further shows that the grip assembly 558 comprises a grip housing 592 and a trigger member 594. Additionally, the grip assembly 558 is combined with the control assembly 590 to form the actuator assembly 538, and the actuator assembly 538 is supported by the container assembly 530 as generally described above.

To operate the fourth example aerosol dispensing system 520, the container 530 and grip housing 592 are grasped such that the user's fingers can squeeze the trigger member 594, thereby depressing the actuator member 554. The conduit outlet or outlet opening 546 is initially aimed at a test surface and the actuator member 554 is depressed to place the valve assembly 560 in the open configuration such that the pressurized material 536 forces some of the stored material 534 out of the container 530 and onto the test surface to form a test texture pattern. The test texture pattern is compared to the pre-existing texture pattern defined by the textured portion of the target surface. If the test texture pattern does not match the pre-existing texture pattern, one or both of the first and second adjustment members is/are adjusted to alter the spray pattern of the droplets of dispensed material 522.

The process of spraying a test pattern and adjusting the first and second adjustment members 572 and 582 is repeated until the test pattern formed by the dispensed material 522 corresponds to a desired texture pattern that substantially matches the pre-existing texture pattern.

Leaving the first and second adjustment members 572 and 582 as they were when the test texture pattern corresponded to the desired texture pattern, the aerosol dispensing system 520 is then arranged such that the conduit outlet or outlet opening 546 is aimed at the un-textured portion of the target surface. The trigger member 594 is again squeezed to place the valve assembly 560 in the open configuration such that the pressurized material 536 forces the stored material 534 out of the container 530 and onto the un-textured portion of the target surface to form the desired texture pattern on the un-textured portion of the target surface, perhaps overlapping slightly with the textured portion of the target surface. Since the desired texture pattern substantially matches the pre-existing texture pattern, the dispensed material forms a coating on the previously un-textured portion of the target surface that substantially matches a physical appearance of the textured portion. One or more layers of primer and/or paint may next be applied over the cured layer of dispensed material on the target surface.

With the foregoing general understanding of the operation of the first example aerosol dispensing system 520 in mind, the details of construction and operation of this example aerosol dispensing system 520 will now be described in further detail.

Figure 22:
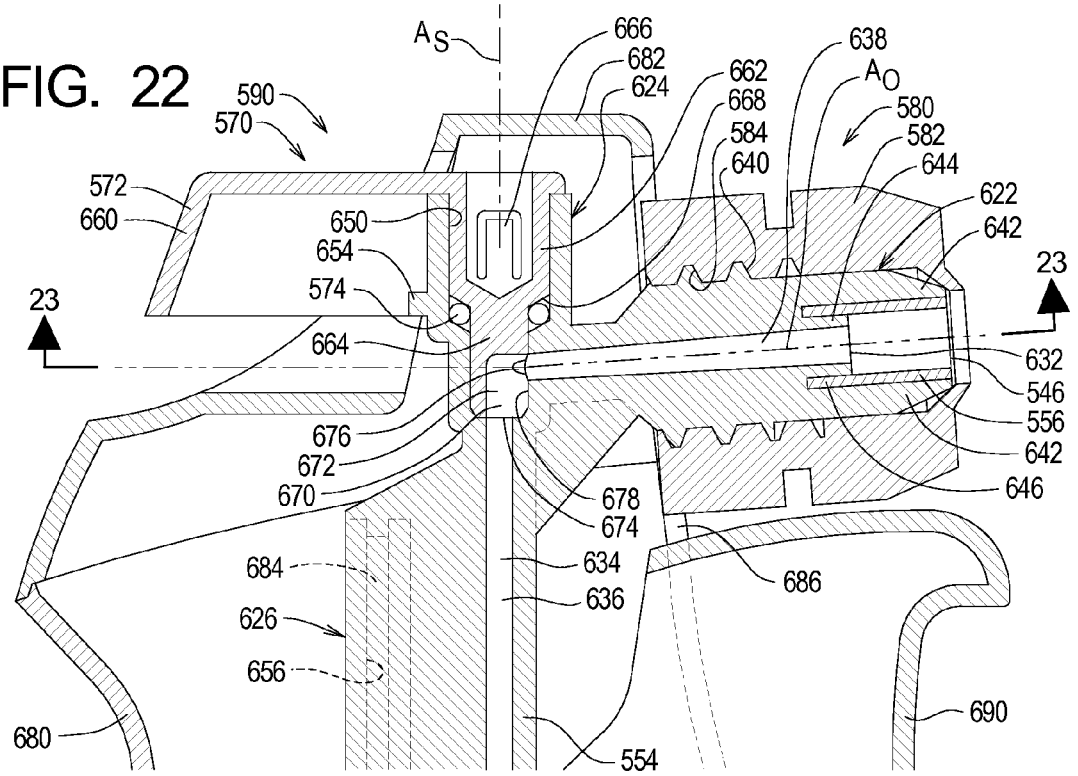
FIG. 22 is a section view of an actuator member and first and second adjustment members of the fourth example aerosol texturing system, with the first adjustment member in a fully open position.

Referring now to FIGS. 20 and 22-25, the example actuator member 554 of the fourth example aerosol dispensing system 520 will now be described in further detail. The example actuator member 554 comprises an inlet portion 620 (FIG. 20), an outlet portion 622 (FIGS. 22-25), a socket portion 624 (FIGS. 20 and 22-25), a guide portion 626 (FIG. 20), and a link portion 628 (FIG. 20). The actuator member 554 further defines an actuator inlet 630 (FIG. 20), an actuator outlet 632 (FIGS. 22-25), and an actuator passageway 634 having a first portion 636 and a second portion 638 (FIG. 22). As perhaps best shown in FIGS. 22-25, the outlet portion 622 of the actuator member 554 defines a threaded external surface 640, two or more fingers 642, a mounting projection 644 through which the actuator outlet 632 extends, and a mounting recess 646 formed around at least a portion of the mounting projection 644.

Figure 23:
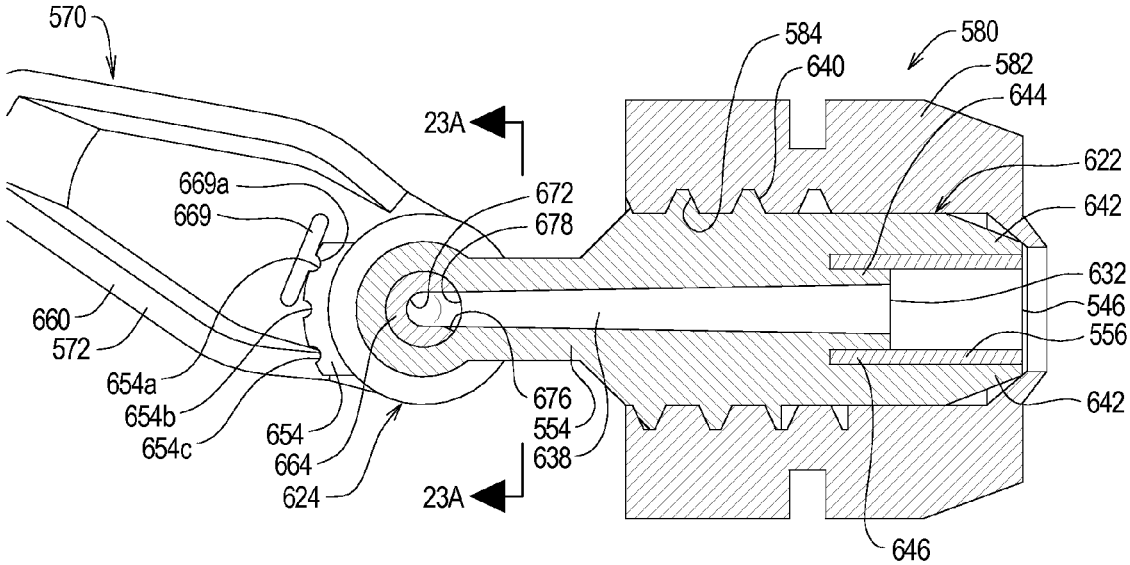
FIG. 23 is a section view taken along lines 23-23 in FIG. 22.
Figure 24A:
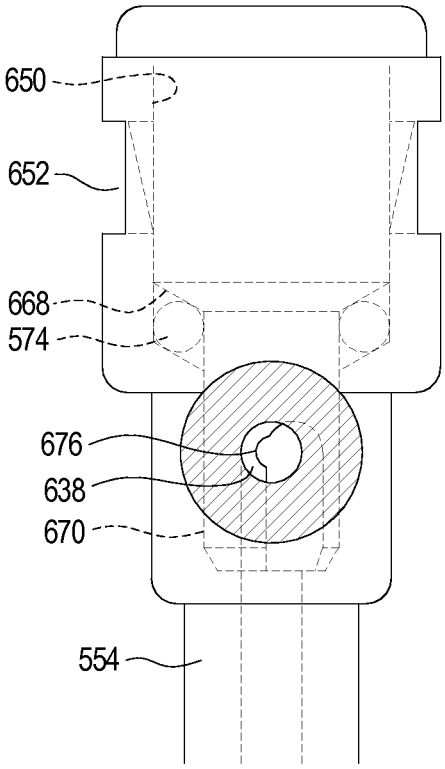
FIG. 24A is a section view taken along lines 24A-24A in FIG. 24.
Figure 24:
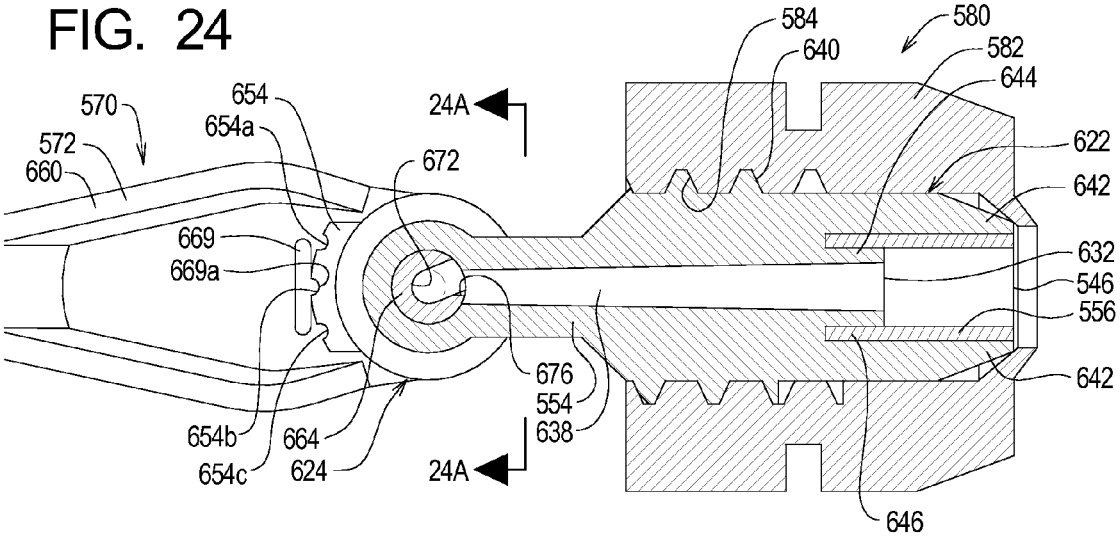
FIG. 24 is a top plan, partial section view taken along lines 23-23 in FIG. 22 of an actuator member and first and second adjustment members of the fourth example aerosol texturing system, with the first adjustment member in a first intermediate position.

The socket portion 624 of the actuator member 554 defines a socket chamber 650 (FIG. 22), at least one socket window 652 (FIG. 20), and a locator projection 654 defining a plurality of locator recesses 654*a*, 654*b*, and 654*c* (FIGS. 23-24). As shown in FIG. 20, the guide portion 656 of the actuator member 554 defines at least one guide slot 656, and the link portion 628 defines at least one link projection 658.

As perhaps best shown in FIGS. 21-25, the example first adjustment member 572 comprises a handle portion 660, a plug portion 662, a valve portion 664, and at least one detent projection 666. A shoulder surface 668 is formed on the plug portion 662 adjacent to and surrounding the valve portion 664. A locator arm 669 defining a locator bump 669*a* extends from the handle portion 660. A valve blade 670 extends from the valve portion 664. The example valve blade 670 defines a valve surface 672 and a bottom surface 674. A notch 676 is formed in the valve blade adjacent to the valve surface 672. A transition surface 678 is formed on the actuator member 554 at the juncture of the first and second portions 636 and 638 of the actuator passageway 634.

Referring now to FIG. 20, it can be seen that the example grip housing 592 defines a grip wall 680 shaped to provide an ergonomic surface for grasping the dispensing system 520 during use. A bottom edge 680*a* of the grip wall 680 is sized and dimensioned to frictionally engage the container assembly 530 to detachably attach the grip housing 592 to the container assembly 530 as will be discussed further below. A protection wall 682 extends in an arc between two portions of the grip wall 680. FIG. 20 illustrates that at least one guide rail 684 extends radially inwardly from the grip wall 680. The grip wall 680 defines a trigger slot 686. At least one pivot opening 688 is formed in the grip wall 680.

FIG. 20 illustrates that the trigger member 594 defines a trigger wall 690 and that at least one link flange 692 extends from the trigger wall 690. A link opening 694 is formed in each link flange 692. At least one pivot projection 696 extends outwardly from the trigger member 594.

The example dispensing system 520 is assembled as follows. The outlet member 556 and the first and second actuator members 572 and 582 are first assembled to the actuator member 554 to form the actuator assembly 538. The outlet member 556 is arranged between the fingers 642 such that a portion of the outlet member 556 extends over the mounting projection 644 and within the mounting recess 646. Friction is typically sufficient to hold the outlet member 556 in position, but adhesive may optionally be used to adhere the outlet member 556 to the actuator member 554.

The second adjustment member 582 may then be attached to the actuator member 554 by engaging the threaded surface 584 on the second adjustment member 582 with the threaded surface 640 on the outlet portion 622 of the actuator member 554. At some point, continued rotation of the second adjustment member 582 relative to the actuator member 554 causes the adjustment member 582 to force the fingers 642 radially inwardly. When forced radially inwardly, the fingers 642 in turn act on the outlet member 556, pinching or deforming the outlet member 556 to reduce the cross-sectional area of the conduit outlet or outlet opening 546.

The first adjustment member 572 may then be attached to the actuator member 554. The seal member 574 is first placed into the socket chamber 650, and then first adjustment member 572 is displaced such that the valve portion 664 enters the socket chamber 650 and the detent projections 666 in their original positions contact the socket portion 624 of the actuator member 554. Continued displacement of the first adjustment member 572 into the socket chamber 650 causes the detent projections 666 to resiliently deform slightly towards each other into a deformed position such that the plug portion 662 enters the socket chamber 650.

When the plug portion 662 is fully within the socket chamber 650, the shoulder surface 668 engages and compresses the seal member 574 to seal the annular space between the plug portion 662 and the socket portion 624, and the detent projections 666 move outwardly to their original positions and into the socket windows 652. At this point, the valve blade 670 extends through the adjustment opening 678 and into the actuator passageway 634. Additionally, the locator arm 669 extends from the handle portion 660 of the first adjustment member 572 adjacent to the locator projection 654 on the socket portion 624 such that the locator bump 669*a* is capable of being positively received by any one of the locator recesses 654*a*, 654*b*, or 654*c* as shown in FIGS. 23-25.

When returned to their original positions relative to the plug portion 662, the detent projections 666 engage the socket portion 624 around the socket windows 652 to inhibit movement of the first adjustment member 572 out of the socket chamber 650 (and thus maintain the valve blade 670 within the second portion of the actuator passageway 634). However, the socket windows 652 are slightly oversized relative to the detent projections 666. The first adjustment member 572 is thus capable of rotating within a limited range of movement relative to the socket portion 624 about a socket axis $A_S$ defined by the socket chamber 650. If necessary, the first adjustment member 572 may be removed from the actuator member 554 by pushing the detent projections 666 through socket windows 652 such that the detent projections 666 no longer engage the socket portion 624.

The control assembly 590 is formed when the outlet member 556, first adjustment member 572, seal member 574, and second adjustment member 582 are secured to the actuator member 554 as described above. At this point, the control assembly 590 is attached to the grip assembly 558 to form the actuator assembly 538. In particular, the pivot projections 696 on the trigger member 594 are inserted into the pivot openings 688 of the grip housing 592 such that the trigger wall 690 extends or is accessible through the trigger slot 686. The trigger member 594 rotates relative to the grip housing 592 about a pivot axis $A_P$.

As is perhaps best shown in FIG. 20, the actuator assembly 538 is then formed by displacing the control assembly 590 into the space between the grip housing 592 and the trigger member 594 such that the link projections 658 extend into the link openings 694 in the link flanges 692 of the trigger member 594. Accordingly, as the trigger member 594 pivots relative to the grip housing 592, the link flanges 692 around the link openings 694 engage the link projections 658 to displace the control assembly 590 relative to the grip assembly 558. Because the link openings 694 are slightly elongated and angled with respect to a container axis $A_C$ defined by the container assembly 530, however, the control assembly 590 is capable of linear, in addition to (at this point) pivoting, movement relative to the grip assembly 558, as will be described in further detail below.

The actuator assembly 538 is then attached to the container assembly 530 by inserting the inlet portion 620 of the actuator member 554 through the valve seat 564 such that the inlet portion 520 engages the valve member 562 as shown in FIG. 20. At the same time, the perimeter edge 680*a* of the grip housing 592 frictionally engages the container assembly 530.

With the actuator assembly 538 attached to the container assembly 530, the grip housing 592 supports the trigger member 594 for pivoting movement relative to the container assembly 530, and the control assembly 590 is supported by the trigger member 594 and the valve seat 564 for linear movement relative to the container assembly 530. At the same time, the protection wall 682 extends over the top of the actuator assembly 538 to prevent inadvertent contact with the actuator assembly 538 that might place the valve system 560 in the open configuration.

Squeezing the trigger member 594 relative to the grip member 592 towards the control assembly 590 results in movement of the control assembly 590 towards the container assembly 530 from a first position and into a second position. When the control assembly 590 is in the first position, the valve system 560 is in its closed configuration. When the control assembly 590 is in the second position, the valve system 560 is in its open configuration. The valve spring 566 returns the valve member 562 towards the valve seat and thus forces the control assembly 590 from the second position and into the first position when the trigger member 594 is released.

The example second actuator member 582 operates to deform the outlet member 556 and alter a cross-sectional area of the conduit outlet or outlet opening 546 as generally described in U.S. Pat. Nos. 6,116,473 and 7,845,532, which are incorporated herein by reference, and thus will not be described or depicted herein in detail. The Applicant notes that other systems and methods for altering the cross-sectional area of a conduit outlet or outlet opening may be used in place of the resiliently deformable outlet member 556, second adjustment member 582, and fingers 642 described herein. U.S. Pat. No. 7,500,621, which is incorporated herein by reference, discloses a number of examples of systems and methods for adjusting the outlet opening of an aerosol system in the context of dispensing texture material.

Figure 23A:
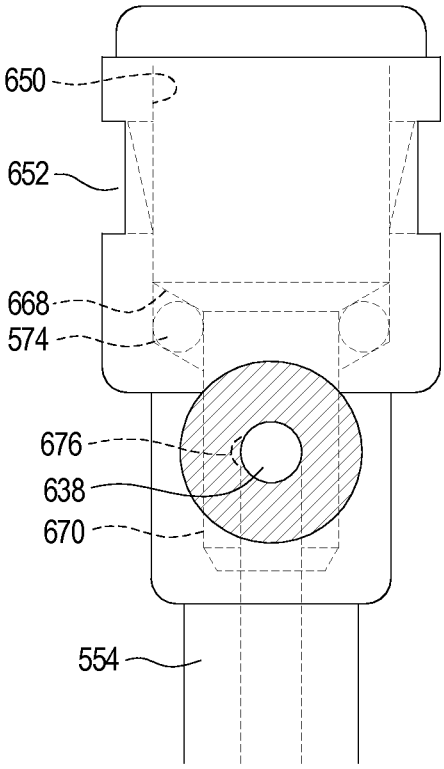
FIG. 23A is a section view taken along lines 23A-23A in FIG. 23.
Figure 25A:
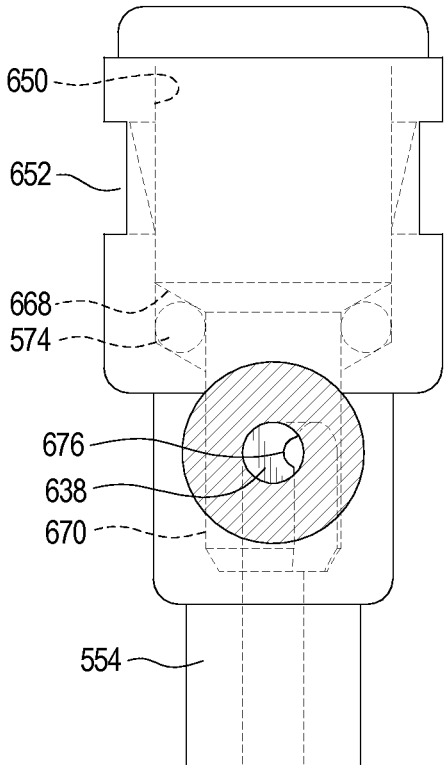
FIG. 25A is a section view taken along lines 25A-25A in FIG. 25.
Figure 25:
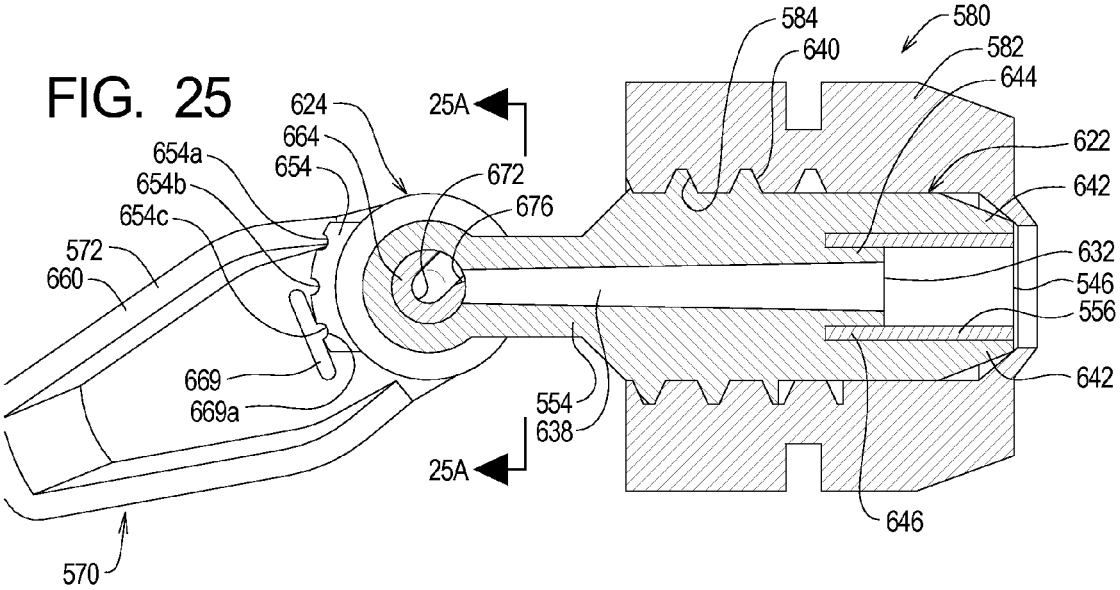
FIG. 25 is a top plan, partial section view taken along lines 23-23 in FIG. 22 of an actuator member and first and second adjustment members of the fourth example aerosol texturing system, with the first adjustment member in a second intermediate position.

The operation of the first adjustment system 570 is perhaps best understood with reference to FIGS. 22-25A of the drawing. FIGS. 23 and 23A illustrate the first adjustment system 570 in a maximum opening configuration. FIGS. 24 and 24A illustrate the first adjustment system 570 in an intermediate opening configuration. FIGS. 25 and 25A illustrate the first adjustment system 570 in a minimum opening configuration. The valve blade 670 thus extends into the actuator passageway 634 such that the valve blade 670 is capable of restricting flow of fluid flowing through the actuator passageway 634. As will be described in further detail below, the amount of restriction depends on the angular position of the valve blade 670 with respect to at least one of the transition surface 678, an outlet axis $A_O$ defined by the actuator passageway 634, and/or the socket axis $A_S$.

The angular position of the valve blade 670 can be altered by displacing the handle portion 660 of the first adjustment member 572 relative to the actuator member 554. The use of the optional locator projection 654 and locator arm 668 allows the first adjustment member 572 to be locked into any one of a plurality (two or more, three in this case) of positions relative to the actuator member 554. Optionally, the size and shape of the socket windows 652 in relation to the size and shape of the detent projections 666 or other structure may be used to determine absolute limits of rotation of the first adjustment member 572 relative to the actuator member 554.

Additionally, the bottom surface 672 of the valve blade 670 is configured to follow the curvature of the actuator passageway 634 where the adjustment opening 678 intersects this passageway 634. The example valve surface 672 is configured to cooperate with the transition surface 678 to define a plurality of discrete cross-sectional dimensions of the actuator passageway 634.

In the example first adjustment system 570, the first adjustment member 572 is capable of being rotated such that the valve blade 670 rotates between a fully open position (FIG. 23A), an intermediate position (FIG. 24A, and a terminal position (FIG. 25A). FIG. 23A shows that the fully open position leaves the actuator passageway substantially unrestricted. FIG. 24A shows that the intermediate position reduces the size of the actuator passageway by a first predetermined amount. FIG. 25A shows that the intermediate position reduces the size of the actuator passageway by a second predetermined amount determined substantially by the dimensions of the notch 676 in the valve blade 670.

Accordingly, as the first adjustment member moves from the fully open position to the terminal position through the intermediate position, a cross-sectional area of the actuator passageway 634 adjacent to the transition surface becomes smaller but is never fully blocked. Each of the three positions allowed by the first adjustment member 572 are predetermined or tuned for a particular aerosol dispensing system.

Accordingly, in the example first adjustment system 570, the system variable controlled by this first adjustment system 570 may be referred to as percentage closure of the cross-sectional area of the actuator passageway 634. Relative to the cross-sectional area of the unobstructed actuator passageway 634, the fully open position of the valve blade 670 will be block a first predetermined percentage (e.g., 0%) of this cross-sectional area. The predetermined adjustment range allowed by the first adjustment member allows the valve blade 670 to rotate from the fully open position to the terminal position in which a second predetermined percentage of this cross-sectional area the unobstructed actuator passageway 634 is blocked. In the intermediate position a third predetermined percentage of this cross-sectional area the unobstructed actuator passageway 634 is blocked.

The following Table D represents example ranges and dimensions for constructing a physical embodiment of a flow adjustment system that may be used as the example first flow adjustment system 570:

TABLE D

| Config. | Units | Example | First Range | Second Range |
|---|---|---|---|---|
| Fully Open | % Passageway | 100 | 95-100 | 90-100 |
| | Square Inches | .00385 | 0.00424-0.00347 | 0.00578-0.00193 |
| Intermed. | % Passageway | 60 | 55-65 | 40-70 |
| | Square Inches | .00230 | 0.00253-0.00207 | 0.00345-0.00115 |
| Terminal | % Passageway | 12 | 8-16 | 5-20 |
| | Square Inches | .00045 | 0.00050-0.00041 | 0.00068-0.00023 |

In this context, the actual cross-sectional area of the unobstructed passageway second portion 638 will be determined by such factors as the characteristics of the stored material 534 (e.g., composition, viscosity) and of the propellant material (e.g., composition, percentage by weight used), and the nature and physical shapes of the desired texture patterns to be obtained using the dispensing system 520.

V. Fifth Example Aerosol Dispensing System

Referring now to FIGS. 26-34A of the drawing, depicted at 720 therein is a fifth example aerosol dispensing system constructed in accordance with, and embodying, the principles of the present invention. Like the first example aerosol dispensing system 20, the fifth example dispensing system is adapted to spray droplets of dispensed material 722 onto a target surface (not shown). In the example use of the dispensing system 720 depicted in FIG. 26, the dispensed material 722 is or contains texture material, and the dispensing system 720 is being used to form a coating on an untextured portion of the target surface having a desired texture pattern that substantially matches a pre-existing texture pattern of a textured portion of the target surface.

Figure 26:
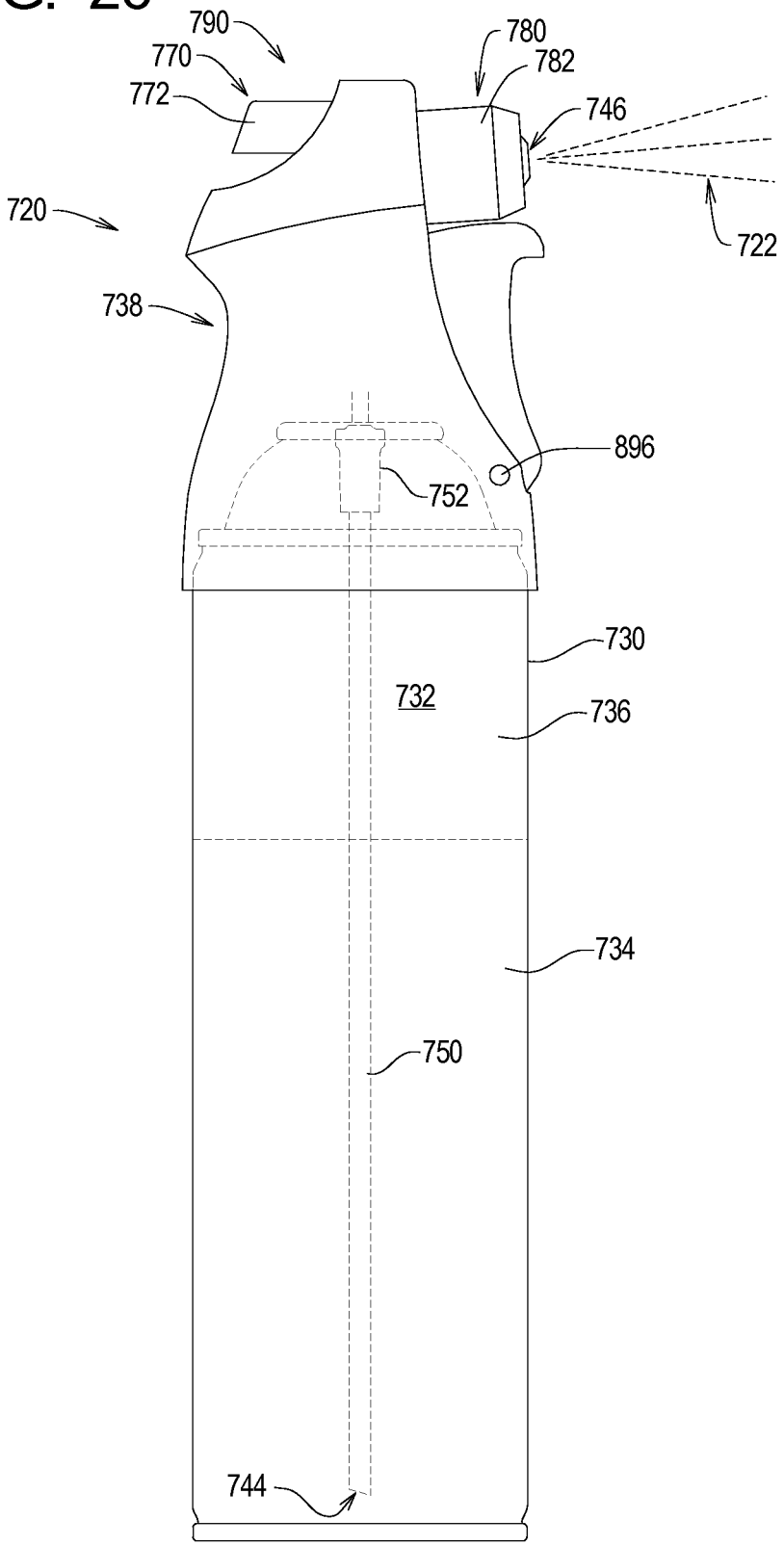
FIG. 26 is a side elevation view of a fifth example aerosol texturing system of the present invention.

FIG. 26 further illustrates that the example dispensing system 720 comprises a container 730 defining a chamber 732 in which stored material 734 and pressurized material 736 are contained. Like the stored material 34 described above, the stored material 734 is a mixture of texture material and propellant material in liquid phase, while the pressurized material is propellant material in gas phase. An actuator assembly 738 is mounted on the container assembly 730 to facilitate the dispensing of the dispensed material 722 as will be described in further detail below.

Figure 27:
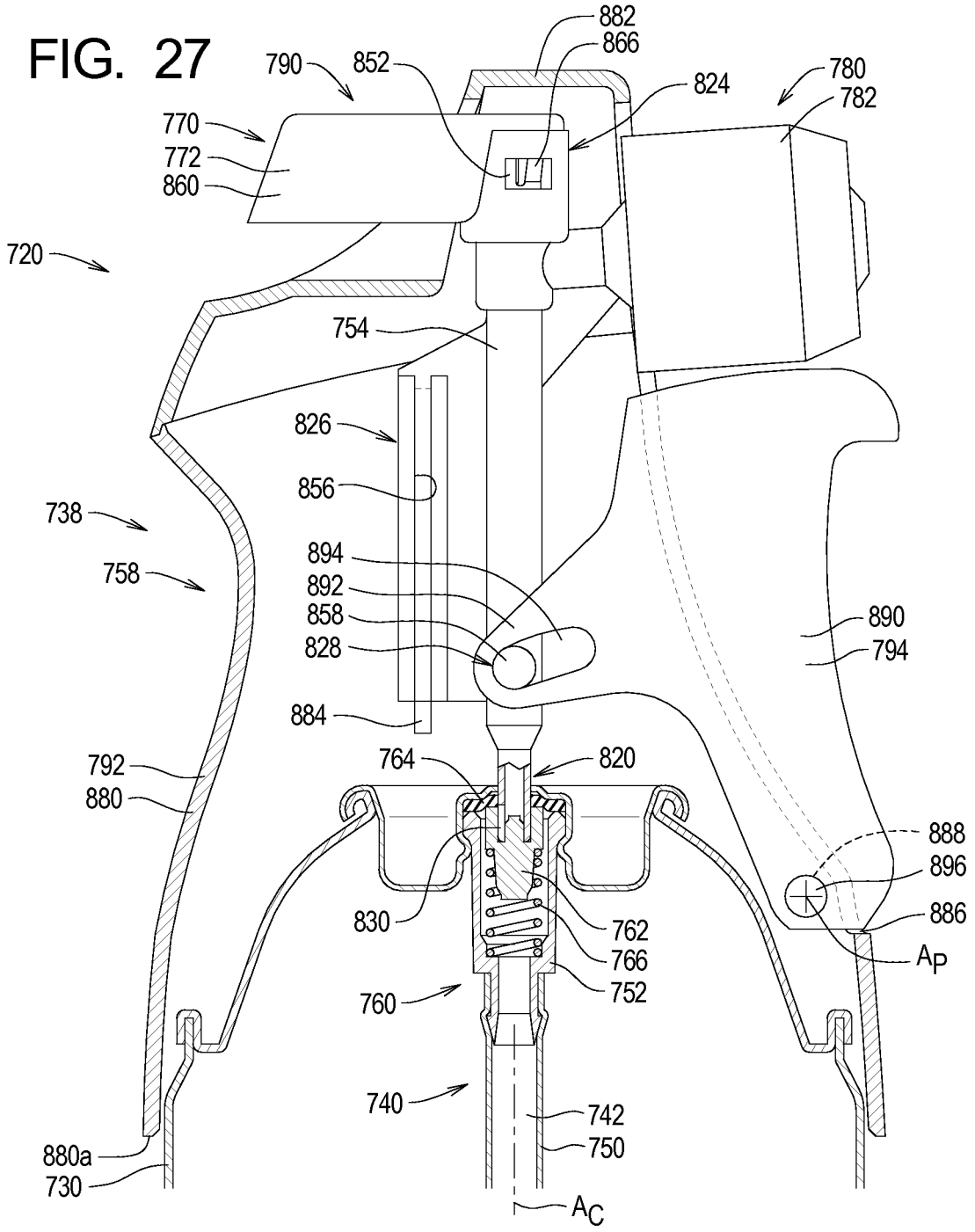
FIG. 27 is a side elevation, partial section view of the fifth example aerosol texturing system in a closed configuration.
Figure 28:
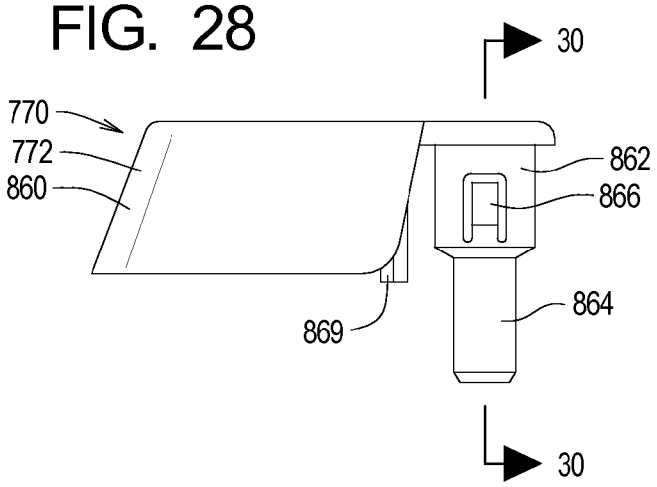
FIG. 28 is a side elevation view of an example first adjustment member of the fifth example aerosol texturing system.

FIG. 27 illustrates that the fifth example aerosol dispensing system 720 comprises a conduit 740 defining a conduit passageway 742. The conduit 740 is supported by the container 730 such that the conduit passageway 742 defines a conduit inlet 744 (FIG. 26) arranged within the chamber 732 and a conduit outlet or outlet opening 746 arranged outside of the chamber 732. The example conduit 740 is formed by an inlet tube 750 (FIGS. 26 and 27), a valve housing 752 (FIGS. 26 and 27), an actuator member 754 (FIGS. 27, 31), and an outlet member 756 (FIGS. 31-34). The conduit passageway 742 extends through the inlet tube 750, the valve housing 752, the actuator member 754, and the outlet member 756. The valve housing 752 is arranged between the conduit inlet 744 and the actuator member 754, and the actuator member 754 is arranged between the valve housing 752 and the conduit outlet 746. The outlet member 756 is supported by the actuator member 754 to define the conduit outlet 746.

As shown in FIG. 27, arranged within the valve housing 752 is a valve assembly 760. The example valve assembly 760 comprises a valve member 762, a valve seat 764, and a valve spring 766. The valve assembly 760 operates in a closed configuration and an open configuration. In the closed configuration, the valve spring 766 forces the valve member 762 against the valve seat 764 such that the valve assembly 760 substantially prevents flow of fluid along the conduit passageway 742. In the open configuration, the valve member 762 is displaced away from the valve seat 764 against the force of the valve spring 766 such that the valve assembly 760 allows flow of fluid along the conduit passageway 742 between the valve member 762 and the valve seat 764. Because the valve spring 766 biases the valve member 762 towards the valve seat 764, the example valve assembly 760 is normally closed. As will be described in further detail below, the valve assembly 760 engages the actuator member structure 754 such that the application of deliberate manual force on the actuator member 754 towards the container 730 moves the valve member 762 away from the valve seat 764 and thus places the valve system 760 in the open configuration.

A first flow adjustment system 770 having a first adjustment member 772 and a seal member 774 is arranged at an intermediate location along the conduit passageway 742 between the valve assembly 760 and the conduit outlet 746. In particular, rotation of the first adjustment member 772 relative to the actuator member 754 alters a cross-sectional area of the conduit passageway 742 between the valve system 760 and the second flow adjustment system 780.

A second flow adjustment system 780 having a second adjustment member 782 is arranged in the conduit passageway 742 to form at least a portion of the conduit outlet or outlet opening 746. In particular, the second adjustment member 782 defines a threaded surface 784 that engages the actuator member 754 such that rotation of the second adjustment member 782 relative to the actuator member 754 deforms the outlet member 756 and thereby alters a cross-sectional area of the conduit outlet or outlet opening 746.

The first flow adjustment system 770 is supported by the actuator member 754 between the valve assembly 760 and the second adjustment system 780 such that manual operation of the first adjustment member 772 affects the flow of fluid material along the conduit passageway 742. In particular, the second adjustment system 780 functions as a flow restrictor, where operation of the first adjustment member 772 variably reduces the size of the conduit passageway 742 such that a pressure of the fluid material upstream of the first flow adjustment system 770 is relatively higher than the pressure of the fluid material downstream of the first flow adjustment system 770.

The second adjustment system 780 is supported by the actuator member 754 downstream of the second adjustment system 780. The outlet member 756 is a resiliently deformable tube, and manual operation of the second adjustment member 782 deforms the walls of the outlet member 756 and thereby affects the flow of fluid material flowing out of the conduit passageway 742 through the conduit outlet or outlet opening 746. The second adjustment system 780 thus functions as a variable orifice. Operation of the second adjustment member 782 variably reduces the size of the conduit outlet or outlet opening 746 relative to the size of the conduit passageway 742 upstream of the second adjustment system 780.

The outlet member 756, first adjustment member 772, seal member 774, and second adjustment member 782 are supported by the actuator member 754 to define a control assembly 790. FIG. 27 further shows that the grip assembly 758 comprises a grip housing 792 and a trigger member 794. Additionally, the grip assembly 758 is combined with the control assembly 790 to form the actuator assembly 738, and the actuator assembly 738 is supported by the container assembly 730 as generally described above.

To operate the fifth example aerosol dispensing system 720, the container 730 and grip housing 792 are grasped such that the user's fingers can squeeze the trigger member 794, thereby depressing the actuator member 754. The conduit outlet or outlet opening 746 is initially aimed at a test surface and the actuator member 754 is depressed to place the valve assembly 760 in the open configuration such that the pressurized material 736 forces some of the stored material 734 out of the container 730 and onto the test surface to form a test texture pattern. The test texture pattern is compared to the pre-existing texture pattern defined by the textured portion of the target surface. If the test texture pattern does not match the pre-existing texture pattern, one or both of the first and second adjustment members is/are adjusted to alter the spray pattern of the droplets of dispensed material 722.

The process of spraying a test pattern and adjusting the first and second adjustment members 772 and 782 is repeated until the test pattern formed by the dispensed material 722 corresponds to a desired texture pattern that substantially matches the pre-existing texture pattern.

Leaving the first and second adjustment members 772 and 782 as they were when the test texture pattern corresponded to the desired texture pattern, the aerosol dispensing system 720 is then arranged such that the conduit outlet or outlet opening 746 is aimed at the un-textured portion of the target surface. The trigger member 794 is again squeezed to place the valve assembly 760 in the open configuration such that the pressurized material 736 forces the stored material 734 out of the container 730 and onto the un-textured portion of the target surface to form the desired texture pattern on the un-textured portion of the target surface, perhaps overlapping slightly with the textured portion of the target surface. Since the desired texture pattern substantially matches the pre-existing texture pattern, the dispensed material forms a coating on the previously un-textured portion of the target surface that substantially matches a physical appearance of the textured portion. One or more layers of primer and/or paint may next be applied over the cured layer of dispensed material on the target surface.

With the foregoing general understanding of the operation of the first example aerosol dispensing system 720 in mind, the details of construction and operation of this example aerosol dispensing system 720 will now be described in further detail.

Figure 31:
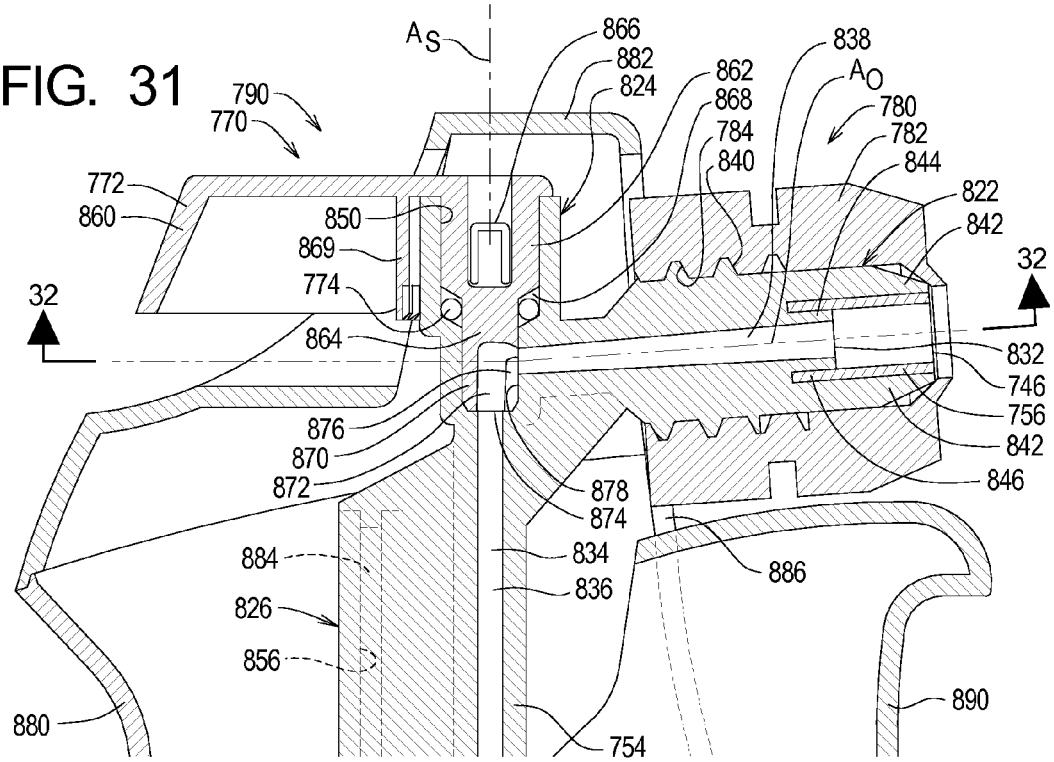
FIG. 31 is side elevation, section view an actuator member, first and second adjustment members, grip housing, and trigger member of the fifth example aerosol texturing system, with the first adjustment member in a first intermediate position.

Referring now to FIGS. 27 and 31-34, the example actuator member 754 of the fifth example aerosol dispensing system 720 will now be described in further detail. The example actuator member 754 comprises an inlet portion 820 (FIG. 27), an outlet portion 822 (FIGS. 31-34), a socket portion 824 (FIGS. 27 and 31-34), a guide portion 826 (FIG. 27), and a link portion 828 (FIG. 27). The actuator member 754 further defines an actuator inlet 830 (FIG. 27), an actuator outlet 832 (FIGS. 31-34), and an actuator passageway 834 having a first portion 836 and a second portion 838 (FIG. 31). As perhaps best shown in FIGS. 31-34, the outlet portion 822 of the actuator member 754 defines a threaded external surface 840, two or more fingers 842, a mounting projection 844 through which the actuator outlet 832 extends, and a mounting recess 846 formed around at least a portion of the mounting projection 844.

Figure 32:
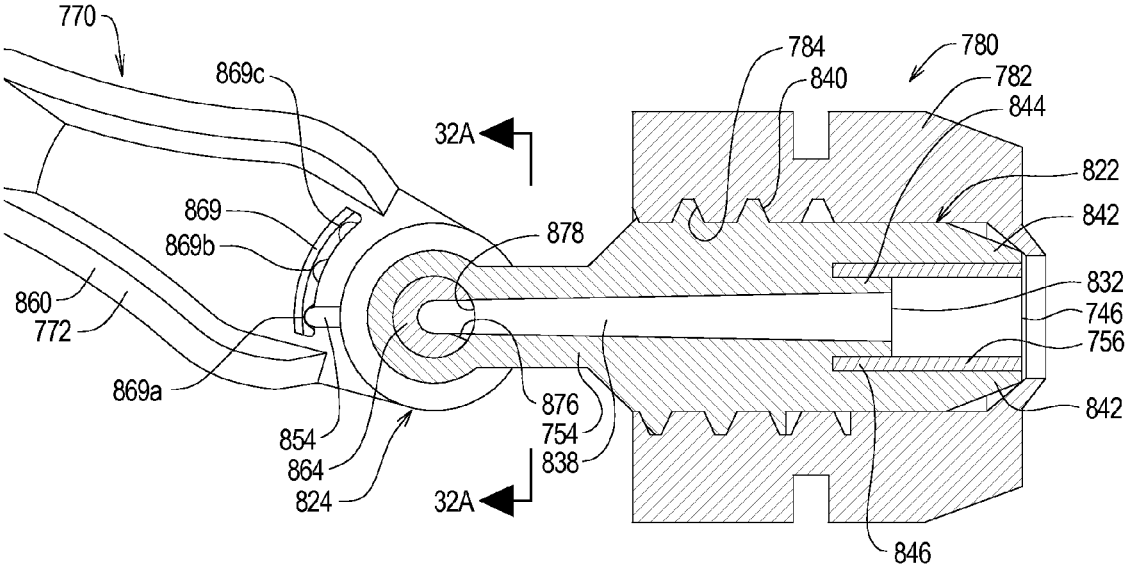
FIG. 32 is a top plan, partial section view taken along lines 32-32 in FIG. 31 of an actuator member and first and second adjustment members of the fifth example aerosol texturing system, with the first adjustment member in a fully open position.
Figure 33A:
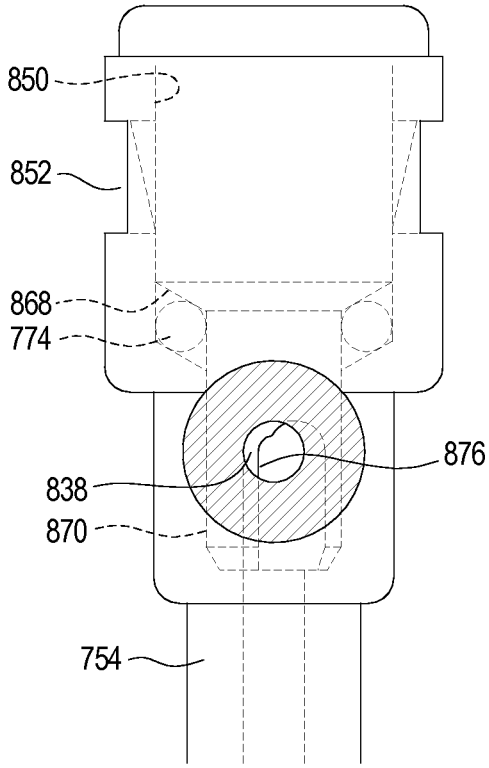
FIG. 33A is a section view taken along lines 33A-33A in FIG. 33.
Figure 34A:
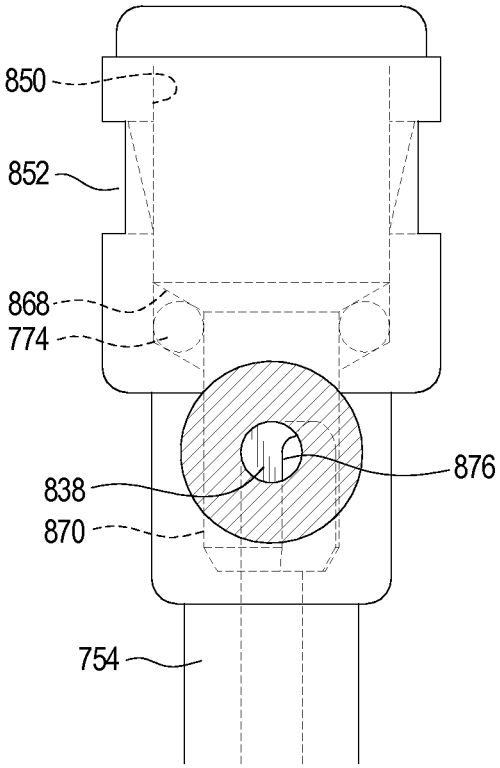
FIG. 34A is a section view taken along lines 34A-34A in FIG. 34.
Figure 33:
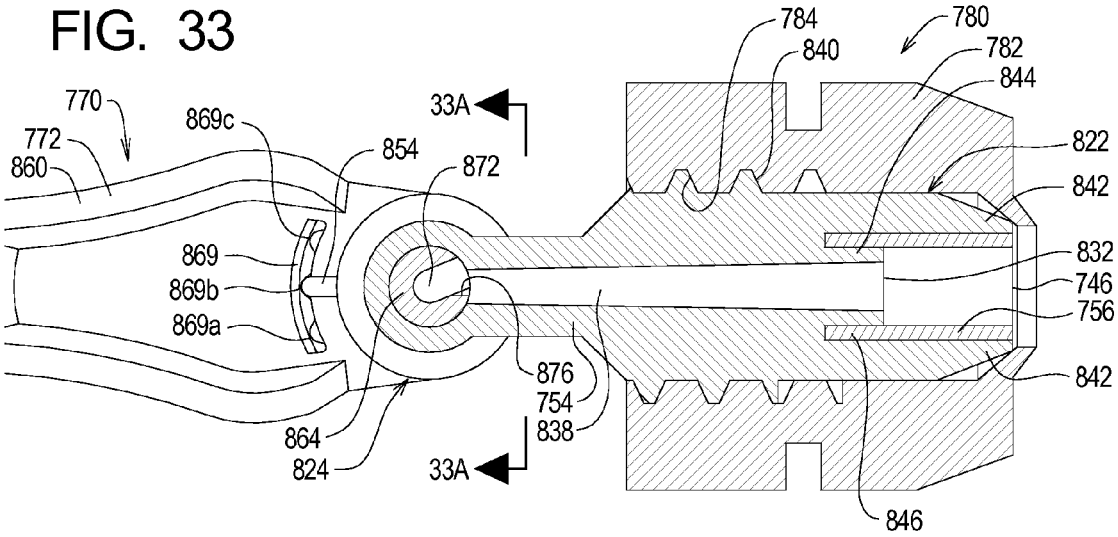
FIG. 33 is a top plan, partial section view taken along lines 32-32 in FIG. 31 of an actuator member and first and second adjustment members of the fifth example aerosol texturing system, with the first adjustment member in a first intermediate position.
Figure 34:
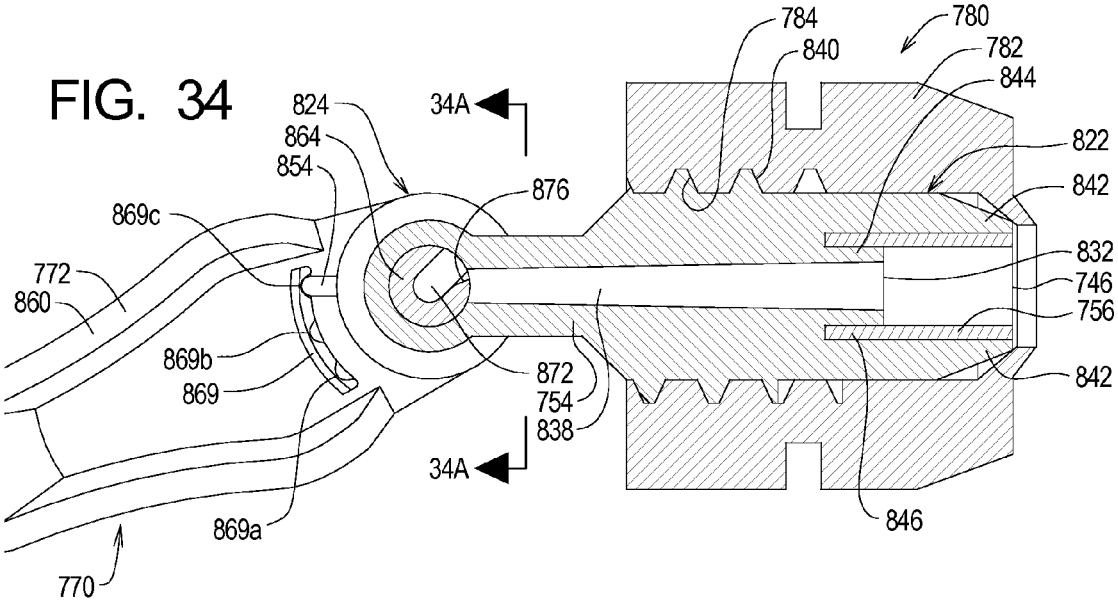
FIG. 34 is a top plan, partial section view taken along lines 32-32 in FIG. 31 of an actuator member and first and second adjustment members of the fifth example aerosol texturing system, with the first adjustment member in a second intermediate position.

The socket portion 824 of the actuator member 754 defines a socket chamber 850 (FIG. 31), at least one socket window 852 (FIG. 27), and a locator projection 854 (FIGS. 32-34). As shown in FIG. 27, the guide portion 856 of the actuator member 754 defines at least one guide slot 856, and the link portion 828 defines at least one link projection 858.

As perhaps best shown in FIGS. 28-34, the example first adjustment member 772 comprises a handle portion 860, a plug portion 862, a valve portion 864, and at least one detent projection 866. A frustoconical shoulder surface 868 is formed on the plug portion 862 adjacent to and surrounding the valve portion 864. A locator arm 869 defining a plurality of locator recesses 869*a*, 869*b*, and 869*c* extends from the handle portion 860. A valve blade 870 extends from the valve portion 864.

Figure 29:
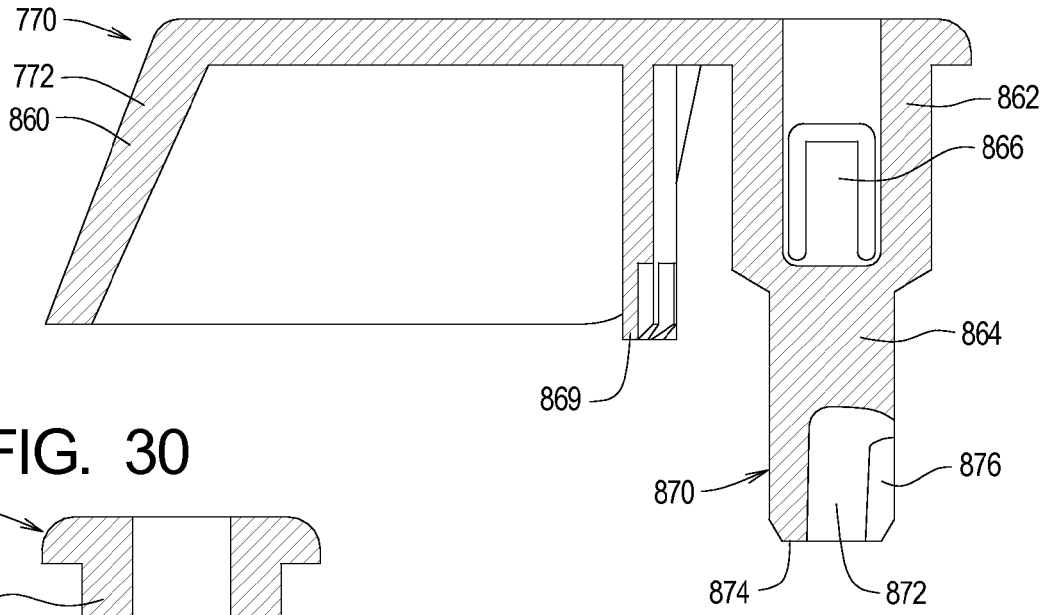
FIG. 29 a side elevation, section view of the example first adjustment member of the fifth example aerosol texturing system.
Figure 30:
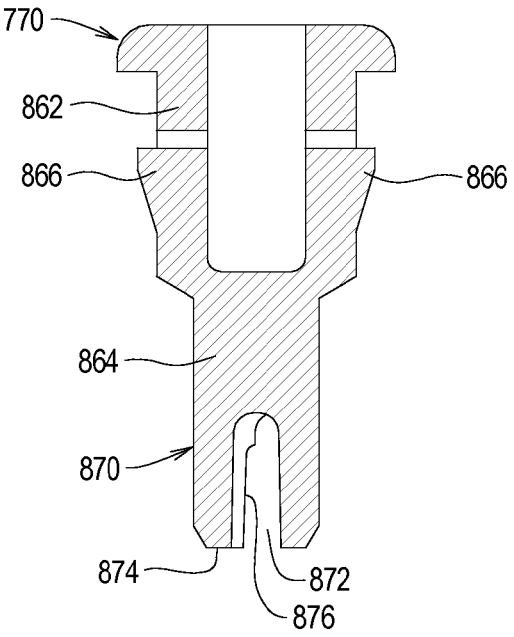
FIG. 30 is a section view taken along lines 30-30 in FIG. 28.

As perhaps best shown in FIGS. 29 and 30, the example valve blade 870 defines a valve slot 872 and a bottom surface 874. A side notch 876 is formed in the valve blade adjacent to the valve slot 872. A transition surface 878 is formed on the actuator member 754 at the juncture of the first and second portions 836 and 838 of the actuator passageway 834. As will be explained in further detail below with reference to FIGS. 32-34 and 32A-34A, the valve slot 872 and associated side notch 876 define a valve blade shape that, when oriented with respect to the transition surface 878, yields a continuum of restriction profiles for the cross-sectional area of the actuator passageway 834 and also to allow the actuator member 754 easily to be injection molded from plastic.

Referring now to FIG. 27, it can be seen that the example grip housing 792 defines a grip wall 880 shaped to provide an ergonomic surface for grasping the dispensing system 720 during use. A bottom edge 880*a* of the grip wall 880 is sized and dimensioned to frictionally engage the container assembly 730 to detachably attach the grip housing 792 to the container assembly 730 as will be discussed further below. A protection wall 882 extends in an arc between two portions of the grip wall 880. FIG. 27 illustrates that at least one guide rail 884 extends radially inwardly from the grip wall 880. The grip wall 880 defines a trigger slot 886. At least one pivot opening 888 is formed in the grip wall 880.

FIG. 27 illustrates that the trigger member 794 defines a trigger wall 890 and that at least one link flange 892 extends from the trigger wall 890. A link opening 894 is formed in each link flange 892. At least one pivot projection 896 extends outwardly from the trigger member 794.

The example dispensing system 720 is assembled as follows. The outlet member 756 and the first and second actuator members 772 and 782 are first assembled to the actuator member 754 to form the actuator assembly 738. The outlet member 756 is arranged between the fingers 842 such that a portion of the outlet member 756 extends over the mounting projection 844 and within the mounting recess 846. Friction is typically sufficient to hold the outlet member 756 in position, but adhesive may optionally be used to adhere the outlet member 756 to the actuator member 754.

The second adjustment member 782 may then be attached to the actuator member 754 by engaging the threaded surface 784 on the second adjustment member 782 with the threaded surface 840 on the outlet portion 822 of the actuator member 754. At some point, continued rotation of the second adjustment member 782 relative to the actuator member 754 causes the adjustment member 782 to force the fingers 842 radially inwardly. When forced radially inwardly, the fingers 842 in turn act on the outlet member 756, pinching or deforming the outlet member 756 to reduce the cross-sectional area of the conduit outlet or outlet opening 746.

The first adjustment member 772 may then be attached to the actuator member 754. The seal member 774 is first placed into the socket chamber 850, and then first adjustment member 772 is displaced such that the valve portion 864 enters the socket chamber 850 and the detent projections 866 in their original positions contact the socket portion 824 of the actuator member 754. Continued displacement of the first adjustment member 772 into the socket chamber 850 causes the detent projections 866 to resiliently deform slightly towards each other into a deformed position such that the plug portion 862 enters the socket chamber 850.

When the plug portion 862 is fully within the socket chamber 850, the shoulder surface 868 engages and compresses the seal member 774 to seal the annular space between the plug portion 862 and the socket portion 824, and the detent projections 866 move outwardly to their original positions and into the socket windows 852. At this point, the valve blade 870 extends through the adjustment opening 878 and into the actuator passageway 834. Additionally, the locator arm 869 extends from the handle portion 860 of the first adjustment member 772 adjacent to the locator projection 854 on the socket portion 824 such that the locator bump 854 is capable of being positively received by any one of the locator recesses 869*a*, 869*b*, or 869*c* s shown in FIGS. 32-34.

When returned to their original positions relative to the plug portion 862, the detent projections 866 engage the socket portion 824 around the socket windows 852 to inhibit movement of the first adjustment member 772 out of the socket chamber 850 (and thus maintain the valve blade 870 within the second portion of the actuator passageway 834). However, the socket windows 852 are slightly oversized relative to the detent projections 866. The first adjustment member 772 is thus capable of rotating within a limited range of movement relative to the socket portion 824 about a socket axis $A_S$ defined by the socket chamber 850. If necessary, the first adjustment member 772 may be removed from the actuator member 754 by pushing the detent projections 866 through socket windows 852 such that the detent projections 866 no longer engage the socket portion 824.

The control assembly 790 is formed when the outlet member 756, first adjustment member 772, seal member 774, and second adjustment member 782 are secured to the actuator member 754 as described above. At this point, the control assembly 790 is attached to the grip assembly 758 to form the actuator assembly 738. In particular, the pivot projections 896 on the trigger member 794 are inserted into the pivot openings 888 of the grip housing 792 such that the trigger wall 890 extends or is accessible through the trigger slot 886. The trigger member 794 rotates relative to the grip housing 792 about a pivot axis A.

As is perhaps best shown in FIG. 27, the actuator assembly 738 is then formed by displacing the control assembly 790 into the space between the grip housing 792 and the trigger member 794 such that the link projections 858 extend into the link openings 894 in the link flanges 892 of the trigger member 794. Accordingly, as the trigger member 794 pivots relative to the grip housing 792, the link flanges 892 around the link openings 894 engage the link projections 858 to displace the control assembly 790 relative to the grip assembly 758. Because the link openings 894 are slightly elongated and angled with respect to a container axis $A_C$ defined by the container assembly 730, however, the control assembly 790 is capable of linear, in addition to (at this point) pivoting, movement relative to the grip assembly 758, as will be described in further detail below.

The actuator assembly 738 is then attached to the container assembly 730 by inserting the inlet portion 820 of the actuator member 754 through the valve seat 764 such that the inlet portion 820 engages the valve member 762 as shown in FIG. 27. At the same time, the perimeter edge 880*a* of the grip housing 792 frictionally engages the container assembly 730.

With the actuator assembly 738 attached to the container assembly 730, the grip housing 792 supports the trigger member 794 for pivoting movement relative to the container assembly 730, and the control assembly 790 is supported by the trigger member 794 and the valve seat 764 for linear movement relative to the container assembly 730. At the same time, the protection wall 882 extends over the top of the actuator assembly 738 to prevent inadvertent contact with the actuator assembly 738 that might place the valve system 760 in the open configuration.

Squeezing the trigger member 794 relative to the grip member 792 towards the control assembly 790 results in movement of the control assembly 790 towards the container assembly 730 from a first position and into a second position. When the control assembly 790 is in the first position, the valve system 760 is in its closed configuration. When the control assembly 790 is in the second position, the valve system 760 is in its open configuration. The valve spring 766 returns the valve member 762 towards the valve seat and thus forces the control assembly 790 from the second position and into the first position when the trigger member 794 is released.

The example second actuator member 782 operates to deform the outlet member 756 and alter a cross-sectional area of the conduit outlet or outlet opening 746 as generally described in U.S. Pat. Nos. 6,116,473 and 7,845,532, which are incorporated herein by reference, and thus will not be described or depicted herein in detail. The Applicant notes that other systems and methods for altering the cross-sectional area of a conduit outlet or outlet opening may be used in place of the resiliently deformable outlet member 756, second adjustment member 782, and fingers 842 described herein. U.S. Pat. No. 7,500,621, which is incorporated herein by reference, discloses a number of examples of systems and methods for adjusting the outlet opening of an aerosol system in the context of dispensing texture material.

Figure 32A:
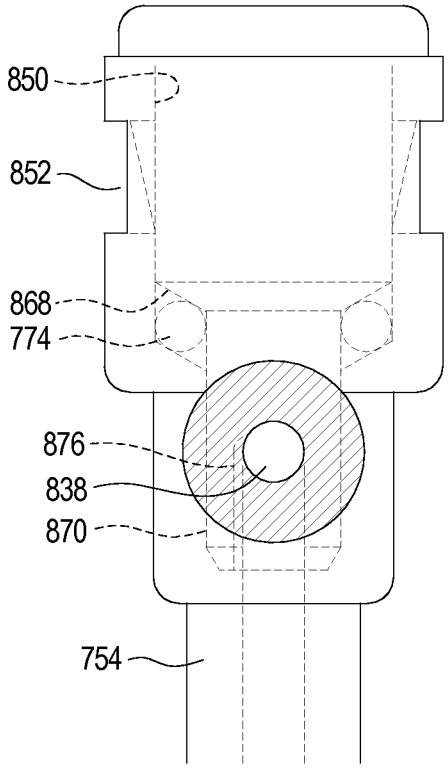
FIG. 32A is a section view taken along lines 32A-32A in FIG. 32.

The operation of the first adjustment system 770 is perhaps best understood with reference to FIGS. 31-34A of the drawing. FIGS. 32 and 32A illustrate the first adjustment system 770 in a maximum opening configuration. FIGS. 33 and 33A illustrate the first adjustment system 770 in an intermediate opening configuration. FIGS. 34 and 34A illustrate the first adjustment system 770 in a minimum opening configuration. The valve blade 870 thus extends into the actuator passageway 834 such that the valve blade 870 is capable of restricting flow of fluid flowing through the actuator passageway 834. As will be described in further detail below, the amount of restriction depends on the angular position of the valve blade 870 with respect to at least one of the transition surface 878, an outlet axis $A_O$ defined by the actuator passageway 834, and/or the socket axis $A_S$.

The angular position of the valve blade 870 can be altered by displacing the handle portion 860 of the first adjustment member 772 relative to the actuator member 754. The use of the optional locator projection 854 and locator arm 869 allows the first adjustment member 772 to be locked into any one of a plurality (two or more, three in this case) of positions relative to the actuator member 754. Optionally, the size and shape of the socket windows 852 in relation to the size and shape of the detent projections 866 may determine the limits of rotation of the first adjustment member 772 relative to the actuator member 754 to a predetermined adjustment range.

Additionally, the bottom surface 872 of the valve blade 870 is configured to follow the curvature of the actuator passageway 834 where the adjustment opening 878 intersects this passageway 834. The example valve slot 872 is configured to cooperate with the transition surface 878 to define a plurality of discrete cross-sectional dimensions of the actuator passageway 834.

In the example first adjustment system 770, the first adjustment member 772 is capable of being rotated such that the valve blade 870 rotates between a fully open position (FIG. 32A), an intermediate position (FIG. 33A, and a terminal position (FIG. 34A). FIG. 32A shows that the fully open position leaves the actuator passageway unrestricted (0% blocked). FIG. 33A shows that the intermediate position reduces the size of the actuator passageway by a first predetermined amount. FIG. 34A shows that the terminal position reduces the size of the actuator passageway by a second predetermined amount determined substantially by the dimensions of the notch 876 in the valve blade 870.

Accordingly, as the first adjustment member moves from the fully open position to the terminal position through the intermediate position, a cross-sectional area of the actuator passageway 834 adjacent to the transition surface becomes smaller but is never fully blocked. Each of the three positions allowed by the first adjustment member 772 are predetermined or tuned for a particular aerosol dispensing system.

Accordingly, in the example first adjustment system 770, the system variable controlled by this first adjustment system 770 may be referred to as percentage closure of the cross-sectional area of the actuator passageway 834. Relative to the cross-sectional area of the unobstructed actuator passageway 834, the fully open position of the valve blade 870 will block a first predetermined percentage (e.g., 0%) of this cross-sectional area. The predetermined adjustment range allowed by the first adjustment member allows the valve blade 870 to rotate from the fully open position to the terminal position in which a second predetermined percentage of this cross-sectional area the unobstructed actuator passageway 834 is blocked. In the intermediate position a third predetermined percentage of this cross-sectional area the unobstructed actuator passageway 834 is blocked.

The following Table E represents example ranges and dimensions for constructing a physical embodiment of a flow adjustment system that may be used as the example first flow adjustment system 770:

TABLE E

| Config. | Units | Example | First Range | Second Range |
|---|---|---|---|---|
| Fully Open | % Passageway | 100 | 95-100 | 90-100 |
| | Square Inches | .00385 | 0.00424-0.00347 | 0.00578-0.00193 |
| Intermed. | % Passageway | 60 | 55-65 | 40-70 |
| | Square Inches | .00230 | 0.00253-0.00207 | 0.00345-0.00115 |
| Terminal | % Passageway | 12 | 8-16 | 5-20 |
| | Square Inches | .00045 | 0.00050-0.00041 | 0.00068-0.00023 |

In this context, the actual cross-sectional area of the unobstructed passageway second portion 838 will be determined by such factors as the characteristics of the stored material 734 (e.g., composition, viscosity) and of the propellant mate rial (e.g., composition, percentage by weight used), and the nature and physical shapes of the desired texture patterns to be obtained using the dispensing system 720.

The embodiments described herein may be embodied in other specific forms without departing from their spirit or essential characteristics. The described embodiments are to be considered in all respects only as illustrative and not restrictive. The scope of the invention is, therefore, indicated by the claims to be appended hereto rather than by the foregoing description. All changes which come within the meaning and range of equivalency of such claims are to be embraced within the scope of the claims.

TABLE A-4

| Ref. | Material | Commercial Example | Function/Description | Example | First Range | Second Range |
|---|---|---|---|---|---|---|
| A | Diacetone alcohol | | Medium-evaporating, low odor solvent | 3.85 | 3.85 ± 5% | 3.85 ± 10% |
| B | Propylene Carbonate | | Slow evaporating, low odor solvent | 2.31 | 2.31 ± 5% | 2.31 ± 10% |
| C | Denatured Ethanol | PM 6193-200 | Fast evaporating, low odor solvent | 13.33 | 13.33 ± 5% | 13.33 ± 10% |
| D | Resin | TB-044 resin (Dai) | Acrylic resin/binder (soluble in "weak" solvents) | 4.93 | 4.93 ± 5% | 4.93 ± 10% |
| E | Clay Pigment | Bentone 34 | Anti-settle/anti-sag clay pigment | 1.26 | 1.26 ± 5% | 1.26 ± 10% |
| F | Fumed Silica | Aerosil R972 | Anti-settle fumed silica | 0.08 | 0.08 ± 5% | 0.08 ± 10% |
| G | Dispersant | Byk Anti-Terra 204 | Dispersing aid | 0.51 | 0.51 ± 5% | 0.51 ± 10% |
| H | Calcium carbonate | MarbleWhite 200 (Specialty Minerals) | filler/extender | 33.87 | 33.87 ± 5% | 33.87 ± 10% |
| I | Nepheline syenite | Minex 4 | filler/extender | 33.87 | 33.87 ± 5% | 33.87 ± 10% |
| J | Denatured Ethanol | PM 6193-200 | Fast evaporating, low odor solvent | 4.00 | 4.00 ± 5% | 4.00 ± 10% |
| K | Denatured Ethanol | PM 6193-200 | Fast evaporating, low odor solvent | 1.99 | 1.99 ± 5% | 1.99 ± 10% |
| | | | | 100 | | |

TABLE A-5

| Ref. | Material | Commercial Example | Function/Description | Example | First Range | Second Range |
|---|---|---|---|---|---|---|
| A | Diacetone alcohol | | Medium-evaporating, low odor solvent | 13.73 | 5-15% | 0-20% |
| B | Propylene Carbonate | | Slow evaporating, low odor solvent | 2.11 | 1-3% | 0-5% |
| C | Denatured Ethanol | PM 6193-200 | Fast evaporating, low odor solvent | 10.56 | 5-15% | 0-20% |
| D | Resin | TB-044 resin (Dai) | Acrylic resin/binder (soluble in "weak" solvents) | 4.93 | 2-6% | 1-10% |
| E | Clay Pigment | Bentone 34 | Anti-settle/anti-sag clay pigment | 1.26 | 0.5-1.5% | 0.1-2.0% |
| F | Fumed Silica | Aerosil R972 | Anti-settle fumed silica | 0.08 | 0-0.20% | 0-0.50% |
| G | Dispersant | Byk Anti-Terra 204 | Dispersing aid | 0.51 | 0.3-0.7% | 0.1-1.5% |
| H | Calcium carbonate | MarbleWhite 200 (Specialty Minerals) | filler/extender | 33.87 | 20-40% | 0-70% |
| I | Nepheline syenite | Minex 4 | filler/extender | 33.87 | 20-40% | 0-70% |
| J | Titanium Dioxide | | White pigment | 0.00 | 0-5% | 0-20% |
| K | Calcined clay | Optiwhite | White extender pigment | 0.00 | 0-10% | 0-20% |
| L | Hexane | | Very fast evaporating, low odor solvent | 0.00 | 0-10% | 0-20% |

What is claimed is:

1. An aerosol dispensing system for dispensing stored material in a spray, comprising:

a container defining a chamber containing the stored material and pressurized material;

a conduit defining a conduit passageway having a conduit inlet and a conduit outlet, where the conduit inlet is arranged within the chamber and the conduit outlet is arranged outside of the chamber;

a valve system arranged selectively to allow and prevent flow of stored material along the conduit passageway;

a first adjustment system arranged to control flow of stored material along the conduit passageway, where the first adjustment system is arranged between the conduit inlet and the conduit outlet; and a second adjustment system arranged to control flow of stored material along the conduit passageway, where the second adjustment system is arranged between the first adjustment system and the conduit outlet.

2. An aerosol dispensing system as recited in claim 1, in which the stored material is texture material.

3. An aerosol dispensing system as recited in claim 1, in which the first adjustment system is arranged to define an effective cross-sectional area of the conduit passageway.

4. An aerosol dispensing system as recited in claim 1, in which the second adjustment system is arranged to define an effective cross-sectional area of the conduit outlet.

5. An aerosol dispensing system as recited in claim 3, in which the second adjustment system is arranged to define an effective cross-sectional area of the conduit outlet.

6. An aerosol dispensing system as recited in claim 1, in which the first adjustment system restricts flow of fluid along the conduit passageway.

7. An aerosol dispensing system as recited in claim 1, in which the first adjustment system allows pressure of fluid material upstream of the first flow adjustment system to be greater than the pressure of fluid material downstream of the first flow adjustment system.

8. An aerosol dispensing system as recited in claim 1, in which the conduit comprises:

a valve housing, and an actuator structure; whereby displacement of the actuator structure relative to the valve housing operates the valve system.

9. An aerosol dispensing system as recited in claim 8, in which the actuator structure supports the first and second adjustment systems.

10. An aerosol dispensing system as recited in claim 9, in which:

the actuator structure defines an actuator passageway;

the first adjustment system comprises a first adjustment member;

the actuator structure supports the first adjustment member such that an adjustment portion of the first adjustment member extends into the actuator passageway, and movement of the first adjustment member relative to the actuator structure causes the adjustment portion to alter a cross-sectional area of the actuator passageway.

11. An aerosol dispensing system as recited in claim 10, in which the adjustment portion of the first adjustment member is shaped such that rotation of the first adjustment member relative to the actuator structure alters the cross-sectional area of the actuator passageway.

12. An aerosol dispensing system as recited in claim 10, further comprising a seal member arranged to prevent fluid flow between the first adjustment member and the actuator structure.

13. An aerosol dispensing system as recited in claim 8, in which the second adjustment system comprises an outlet member defining the conduit outlet and a second adjustment member, where the actuator structure supports the second adjustment member such that movement of the second adjustment member relative to the outlet member alters an effective cross-sectional area of the conduit outlet.

14. An aerosol dispensing system as recited in claim 13, in which the second adjustment member deforms the outlet member to alter the effective cross-sectional area of the conduit outlet.

15. An aerosol dispensing system as recited in claim 14, in which the actuator structure defines a plurality of fingers that support the outlet member, where the second adjustment member deforms the fingers to deform the outlet member.

16. An aerosol dispensing system for dispensing stored material in a spray, comprising:

a container defining a chamber containing the stored material and pressurized material;

a conduit comprising an inlet tube defining a conduit inlet, a valve housing, an actuator member, an outlet member defining a conduit outlet, and a conduit passageway, where the conduit passageway extends through the conduit inlet defined by the inlet tube, the valve housing, the actuator member, and the conduit outlet defined by the outlet member;

a valve assembly supported by the valve housing, where the valve assembly is normally in a closed configuration in which fluid is substantially prevented from flowing along the conduit passageway, and the actuator member is supported relative to the valve assembly such that displacement of the actuator member towards the container places the valve assembly in an open configuration in which fluid is allowed to flow along the conduit passageway;

a first adjustment system comprising a first adjustment member supported for movement relative to the actuator member, where a valve portion of the first adjustment member is arranged within the conduit passageway, and movement of the first adjustment member relative to the actuator member causes the valve portion of the first adjustment member to alter an effective cross-sectional area of the conduit passageway at a first location, and a seal member arranged to prevent fluid flow between the first adjustment member and the actuator member; and a second adjustment member supported for movement relative to the actuator member, where movement of the second adjustment member relative to the actuator member deforms the outlet member to alter an effective cross-sectional area of the conduit passageway at a second location.

17. An aerosol dispensing system as recited in claim 16, in which the stored material is texture material.

18. An aerosol dispensing system as recited in claim 16, in which the actuator member supports the first and second adjustment members.

19. An aerosol dispensing system as recited in claim 16, in which an adjustment portion of the first adjustment member is shaped such that rotation of the first adjustment member relative to the actuator member alters a cross-sectional area of an actuator passageway defined by the actuator member.

20. An aerosol dispensing system as recited in claim 16, in which the actuator member defines a plurality of fingers that support the outlet member, where the second adjustment member deforms the fingers to deform the outlet member.

21. An aerosol dispensing system as recited in claim 16, in which the actuator member defines an actuator passageway that defines a portion of the conduit passageway, where the valve portion extends into the actuator passageway.

22. An aerosol dispensing system as recited in claim 17, in which the texture material comprises:

a first solvent having a first evaporation rate;

a second solvent having a second evaporation rate, where the second evaporation rate is lower than the first evaporation rate;

a third solvent having a third evaporation rate, where the third evaporation rate is higher than the first evaporation rate;

a binder;

a pigment;

fumed silica;

a dispersant;

a first filler extender;

a second filler extender.

23. An aerosol dispensing system for dispensing stored material in a spray, comprising:

a container defining a chamber containing the stored material and pressurized material;

a conduit comprising an inlet tube defining a conduit inlet, a valve housing, an actuator member, an outlet member defining a conduit outlet, and a conduit passageway, where the conduit passageway extends through the conduit inlet defined by the inlet tube, the valve housing, the actuator member, and the conduit outlet defined by the outlet member;

a valve assembly supported by the valve housing, where the valve assembly is normally in a closed configuration in which fluid is substantially prevented from flowing along the conduit passageway, and the actuator member is supported relative to the valve assembly such that displacement of the actuator member towards the container places the valve assembly in an open configuration in which fluid is allowed to flow along the conduit passageway;

a first adjustment system comprising a first adjustment member supported for movement relative to the actuator member, where a valve portion of the first adjustment member is arranged within the conduit passageway, and movement of the first adjustment member relative to the actuator member causes the valve portion of the first adjustment member to alter an effective cross-sectional area of the conduit passageway at a first location, and a seal member arranged to prevent fluid flow between the first adjustment member and the actuator member; and a second adjustment member supported for movement relative to the actuator member, where movement of the second adjustment member relative to the actuator member deforms the outlet member to alter an effective cross-sectional area of the conduit passageway at a second location; wherein the valve portion defines a valve blade shaped to alter an effective area of the conduit passageway as the first adjustment member moves relative to the actuator member.

24. An aerosol dispensing system for dispensing stored material in a spray, comprising:

a container defining a chamber containing the stored material and pressurized material;

a conduit comprising an inlet tube defining a conduit inlet, a valve housing, an actuator member, an outlet member defining a conduit outlet, and a conduit passageway, where the conduit passageway extends through the conduit inlet defined by the inlet tube, the valve housing, the actuator member, and the conduit outlet defined by the outlet member;

a valve assembly supported by the valve housing, where the valve assembly is normally in a closed configuration in which fluid is substantially prevented from flowing along the conduit passageway, and the actuator member is supported relative to the valve assembly such that displacement of the actuator member towards the container places the valve assembly in an open configuration in which fluid is allowed to flow along the conduit passageway;

a first adjustment system comprising a first adjustment member supported for movement relative to the actuator member, where a valve portion of the first adjustment member is arranged within the conduit passageway, and movement of the first adjustment member relative to the actuator member causes the valve portion of the first adjustment member to alter an effective cross-sectional area of the conduit passageway at a first location, and a seal member arranged to prevent fluid flow between the first adjustment member and the actuator member; and a second adjustment member supported for movement relative to the actuator member, where movement of the second adjustment member relative to the actuator member deforms the outlet member to alter an effective cross-sectional area of the conduit passageway at a second location; wherein the actuator member defines an actuator passageway that defines a portion of the conduit passageway, where the valve portion extends into the actuator passageway;

the actuator passageway defines a first portion substantially aligned with an axis of the container, and a second portion that extends at an angle with respect to the axis of the container; and the valve portion of the first adjustment member is arranged at a juncture of the first and second portions of the actuator passageway.

25. An aerosol dispensing system as recited in claim 24, in which:

a transition surface on the actuator member defines a portion of the actuator passageway at the juncture of the first and second portions of the actuator passageway;

the valve portion of the first adjustment member defines a valve slot; and the transition surface and the valve slot cooperate as the first adjustment member rotates relative to the actuator member to control flow of fluid along the conduit passageway.

26. An aerosol dispensing system as recited in claim 24, in which a transition surface on the actuator member defines a portion of the actuator passageway at the juncture of the first and second portions of the actuator passageway;

the valve portion of the first adjustment member defines a valve slot and a side notch; and the transition surface, the valve slot, and the side notch cooperate as the first adjustment member rotates relative to the actuator member to control flow of fluid along the conduit passageway.

* * * * *